US007979004B2

(12) United States Patent
Tanaka et al.

(10) Patent No.: US 7,979,004 B2
(45) Date of Patent: Jul. 12, 2011

(54) ELECTROPHOTOGRAPHIC BELT, PRODUCTION METHOD OF ELECTROPHOTOGRAPHIC BELT, AND ELECTROPHOTOGRAPHIC APPARATUS

(75) Inventors: Atsushi Tanaka, Susono (JP); Takashi Kusaba, Sunto-gun (JP); Hidekazu Matsuda, Numazu (JP); Yuji Sakurai, Susono (JP); Akihiko Nakazawa, Sunto-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 1562 days.

(21) Appl. No.: 11/345,342

(22) Filed: Feb. 2, 2006

(65) Prior Publication Data

US 2006/0127617 A1 Jun. 15, 2006

Related U.S. Application Data

(63) Continuation of application No. PCT/JP2005/018061, filed on Sep. 22, 2005.

(30) Foreign Application Priority Data

Sep. 24, 2004 (JP) ..... 2004-277567

(51) Int. Cl.
*G03G 15/00* (2006.01)

(52) U.S. Cl. ..... 399/162; 399/159

(58) Field of Classification Search ..... 399/162
See application file for complete search history.

(56) References Cited

U.S. PATENT DOCUMENTS

| | | | | |
|---|---|---|---|---|
| 6,600,893 | B2 | 7/2003 | Ashibe et al. | 399/302 |
| 6,737,133 | B2 | 5/2004 | Kusaba et al. | 428/35.7 |
| 7,208,211 | B2 | 4/2007 | Tanaka et al. | 428/36.9 |
| 2005/0201783 | A1 * | 9/2005 | Kurotaka et al. | 399/329 |
| 2006/0067747 | A1 | 3/2006 | Matsuda et al. | 399/308 |
| 2006/0226572 | A1 | 10/2006 | Tanaka et al. | 264/176.1 |

FOREIGN PATENT DOCUMENTS

| | | |
|---|---|---|
| JP | 2886350 | 2/1999 |
| JP | 11-344025 | 12/1999 |
| JP | 2001-064389 | 3/2001 |
| JP | 2004-237261 | 8/2004 |
| JP | 2005-266772 | 9/2005 |

* cited by examiner

*Primary Examiner* — David M Gray
*Assistant Examiner* — Roy Yi
(74) *Attorney, Agent, or Firm* — Fitzpatrick, Cella, Harper & Scinto

(57) ABSTRACT

The electrophotographic belt of the present invention is characterized that, in the electrophotographic belt composed of the thermoplastic resin composition containing thermoplastic resin, with respect to a flake-shaped portion having an arc length of 5% of the inner peripheral length of the electrophotographic belt, when the thickness of the flake-shaped portion is measured at intervals of 1 mm in the peripheral direction, the difference between the maximum value and the minimum value of the measured value is 2% or more and 20% or less of an arithmetic average value.

8 Claims, 14 Drawing Sheets

ELECTROPHOTOGRAPHIC BELT, PRODUCTION METHOD OF ELECTROPHOTOGRAPHIC BELT, AND ELECTROPHOTOGRAPHIC APPARATUS

This application is a continuation of International Application No. PCT/JP2005/018061, filed Sep. 22, 2005, which claims the benefit of Japanese Patent Application No. 2004-277567, filed Sep. 24, 2004.

BACKGROUND OF THE INVENTION

1. Field of the Invention

The present invention relates to a belt member such as a transfer material conveying belt, an intermediate transfer belt, and the like, and a so-called electrophotographic belt, which are used in an electrophotographic apparatus, and further, it relates to the production method of the electrophotographic belt, and the electrophotographic apparatus having the electrophotographic belt.

2. Related Background Art

In recent years, a so-called electrophotographic belt such as a transfer material conveying belt, an intermediate transfer belt, and the like has often come into use for a color electrophotographic apparatus. These electrophotographic belts are usually stretched across by two or more rollers, and are installed within the electrophotographic apparatus, and are driven by at least a roller (driving roller) of these rollers.

The color electrophotographic apparatus using the electrophotographic belt is classified broadly into the following two types.

A first type, as shown in FIGS. 1 and 2, is a so-called tandem type color electrophotographic apparatus in which different color toner images formed respectively on the surfaces of plural electrophotographic photosensitive members are transferred in order on the transfer material or the intermediate transfer belt conveyed by the transfer material conveying belt.

A second type, as shown in FIG. 3, is a so-called four pass type color electrophotographic apparatus using an electrophotographic photosensitive member and an intermediate transfer belt, and after the intermediate transfer belt makes four turns, collectively transferring on the transfer material.

Nowadays, since the color electrophotographic apparatus has been solicited to improve an image output speed, the tandem type color electrophotographic apparatus has been on the increase, which is advantageous in speeding up among the color electrophotographic apparatuses.

Against such a background, as one of the characteristics required for the transfer material conveying belt and the intermediate transfer belt, stability of the peripheral speed is cited. If the peripheral speed is not stable, different color toner images cannot be superposed at a desired position of the transfer material on the transfer material conveying belt or the intermediate transfer belt, thereby causing a color shift. Although some variable factors of the peripheral speed are believed to exist, as a cause arising from the electrophotographic belt itself, unevenness of its thickness can be cited.

In the four pass type color electrophotographic apparatus, the intermediate transfer belt is allowed to make one turn in order to transfer the next color. Consequently, fluctuation of the peripheral speed generated by unevenness of the thickness of the intermediate transfer belt and the color shift generated by fluctuation of the peripheral speed are cancelled in theory. Accordingly, the four pass type color electrophotographic apparatus rather than the tandem type color electrophotographic apparatus is advantageous in controlling the color shift. Naturally, even if the four pass type color electrophotographic apparatus is advantageous, in reality, it is not that the color shift does not disappear at all, but that the color shift generated by fluctuation of the peripheral speed occurs more or less.

In contrast to this, in the case of the tandem type color electrophotographic apparatus, since the transfer of the next color is performed before the transfer material conveying belt or the intermediate transfer belt makes one turn, the effect on the color shift by the thickness of these belts is great. Hence, the electrophotographic belt such as the transfer material conveying belt and the intermediate transfer belt used for the tandem type color electrophotographic apparatus is required to have much fewer unevenness in thickness.

Further, at present, regardless of the tandem type color electrophotographic apparatus and the four pass type color electrophotographic apparatus, since the demand for price-reduction is remarkable, the electrophotographic belt much lower in price has been solicited.

The electrophotographic belt (transfer material conveying belt and the intermediate transfer belt) used currently on the market can be classified broadly into three types in terms of materials and production processes.

A first type is a so-called thermosetting resin belt in which resin (precursor) before hardening is added with conductive agent and the like, and after that, is solidified by cure reaction by heating. As its representative example, for example, a belt using polyimide resin is cited. This is disclosed in Japanese Patent Application Laid-Open No. 2001-064389 (Patent Document 1).

The thermosetting resin belt is often produced by a centrifugal compacting method, in which coating material becoming the material of the belt is coated inside a mold, and the coating material is uniformly extended within the mold by the centrifugal force. Hence, the acquired belt has an advantage of being excellent in thickness uniformity. Consequently, in general, this type of the belt is believed to be advantageous in color shift.

However, there has been a problem in that it is only immediately after starting using the belt that the color shift of this type of the belt is very few, and as the belt is repeatedly used, the color shift becomes worse. Further, since the thermosetting resin belt takes a long stretch of time in heat curing and evaporation of solvent at the production time, it is not suited to a lower cost production.

A second type is a so-called rubber belt produced in such a manner that unvulcanized rubber is added with the conductive agent and the like, and after that, is vulcanized and grinded. The rubber belt can be made excellent in durability by weaving a core of fabric into rubber.

However, since vulcanization and grinding require a long stretch of time, the rubber belt is not suited to a lower cost production. Further, since the rubber belt is prone to be elastically deformed at the rotational driving time, and easily generate microscopic fluctuation in peripheral speed, the color shift is easily generated.

A third type is a so-called thermoplastic resin belt obtained in such a manner that thermoplastic resin composition added with the conductive agent and the like on thermoplastic resin is extruded into a tube shape, and is cut off in a predetermined length. Since the thermoplastic resin belt can be produced by continuous extrusion at a lower cost, it is most advantageous in keeping the cost down.

However, since it is difficult to completely uniformize a gap in the outlet (die lip) of an annular die used when extruding the thermoplastic resin composition in its peripheral direction, there is a problem in that unevenness of the thickness (polarized thickness) is prone to be generated.

Further, with respect to the production of the belt by extrusion, various investigations have been conducted so far.

For example, in Japanese Patent Publication No. 2886350 (Patent Document 2), a method is disclosed in which the tube extruded from the annular die is brought into contact with a heat regulated mandrel, and at the same time, is sprayed with heat regulated gas. Since the tub extruded by this method is produced by contacting the mandrel, microscopic protrusions of the inner peripheral surface are crushed and made flat, and the irregularity of thickness becomes within ±5%.

However, according to the researches conducted by the present inventors, it has been found very difficult to remove the unevenness of thickness in the peripheral direction. From among the belts prepared by the above described method, the belt having the smallest thickness was selected, and when the color shift arisen from the usage was confirmed, though the initial color shift was not so much developed, deterioration of the color shift due to repeated usage was worse.

Further, in Japanese Patent Application Laid-Open No. H11-344025 (Patent Document 3), it is disclosed that, if the temperature of the annular die is changed in the peripheral direction, the belt having the unevenness of thickness controlled within ±5% can be obtained.

However, according to the researches conducted by the present inventors, even by this technology, the unevenness of thickness has been unable to be sufficiently reduced. The present inventors presume that this is due to the fact that the annular die is usually made of metal. That is, since metal is good in heat conduction, in case the temperature of the annular die is changed in the peripheral direction, heat is also transferred to the heated periphery. As a result, temperature distribution of the peripheral direction in the annular die becomes broadened, and therefore, removal of microscopic polarized thickness becomes difficult. Eventually, the obtained belt has been a belt that creates a great color shift.

Further, in Japanese Patent Application Laid-Open No. H11-344025, it is disclosed that plural places of the extruded tube are sprayed with air different in quantity and pressure, thereby obtaining a belt with the unevenness of thickness controlled within ±5%.

However, according to the researches conducted by the present inventors, there is a space between adjacent nozzles, and in that space, no correction effect of thickness can be obtained. Hence, it has been not possible to sufficiently reduce the unevenness of thickness. If the number of nozzles is increased, the space is made smaller, but, since an air content for one each nozzle is reduced, in the space between the nozzles, it has been not possible to obtain the thickness correction effect after all, and it has been not possible to sufficiently reduce the unevenness of the thickness. The obtained belt has been a belt that creates a great color shift.

SUMMARY OF THE INVENTION

As described above, according to the conventional technology aiming at controlling thickness unevenness in the peripheral direction within ±whichever %, there is no guarantee that small color shift can be always obtained. In addition, there has been a problem in that, even if few belts having few color shifts are selected, the color shift becomes worse due to repeated usage.

An object of the present invention is to provide an electrophotographic belt sufficiently controlled in color shift from the initial period till after repeated use by using a low cost thermoplastic resin composition, and further to provide an electrophotographic apparatus having such electrophotographic belt.

The present invention is characterized by being an electrophotographic belt comprising thermoplastic resin composition including thermoplastic resin, wherein, in a flake-shaped portion having an arc length of 5% of the inner peripheral length of the electrophotographic belt, when the thickness of the flake-shaped portion is measured at intervals of one millimeter in the peripheral direction, the difference between the maximum value and the minimum value of the measured value is 2% or more and 20% or less of an arithmetic average value, and wherein, when the thickness of the electrophotographic belt is measured at equal intervals at 20 points across the entire periphery in the peripheral direction of the electrophotographic belt, and the measured values are taken as $t_n$(n=1, 2, . . . 20) (μm), respectively, a center of gravity Z found by the following formula (1):

$$z=\sqrt{X^2+Y^2} \tag{1}$$

(in the formula (I), X and Y are, $$X = \frac{\sum_{n=1}^{20} t_n \cos\left\{\frac{360^\circ\ (n-1)}{20}\right\}}{20}$$

and $$Y = \frac{\sum_{n=1}^{20} t_n \sin\left\{\frac{360^\circ\ (n-1)}{20}\right\}}{20}$$

and respectively)

is 2.0 μm or less.

Further, the present invention is an electrophotographic apparatus having the above described electrophotographic belt, a driving roller for rotationally driving the electrophotographic belt, and plural electrophotographic photosensitive members disposed around the electrophotographic belt.

According to the present invention, the electrophotographic belt having sufficiently controlled the color shift from the initial period till after repeated usage can be provided by using a low cost thermoplastic resin composition, and further, an electrophotographic apparatus having such electrophotographic belt can be provided.

DESCRIPTION OF THE PREFERRED EXAMPLES

The present inventors have realized as a result of preparing and evaluating various types of the electrophotographic belts that even if thickness unevenness of the electrophotographic belt is simply reduced, inhibitory effect on the color shift is not sufficiently obtained. That is, at the initial usage period, even if the electrophotographic belt having few color shift is selected, when this belt is repeatedly used, the color shift has often grown more serious. On the contrary, we have realized that even if the color shift of the initial period is great, and is repeatedly used, there are some electrophotographic belts available where the color shift does not become serious any more.

The present inventors have conducted serious researches on this point, and as a result, have reached the conclusion that, in order to prevent deterioration of the color shift by repeated usage, the unevenness of a short period in the peripheral direction of the thickness of the electrophotographic belt is rather preferable to exist to a certain extent. The reason why can be considered as follows.

As the belt is repeatedly used, the rear surface (inner side surface contacting the roller) of the electrophotographic belt is adhered with scraped foreign matters of the driving roller, paper dust, toner, and the like. As a result, friction coefficient between the driving roller and the rear surface of the electrophotographic belt is lowered, thereby allowing the electrophotographic belt to easily slip.

However, if there exists an unevenness of a short period in the peripheral direction of the thickness of the electrophotographic belt, it is presumed that this thickness unevenness plays a role of a wedge (wedge effect) for the driving roller, thereby preventing the lowering of the friction coefficient.

Figure 4:
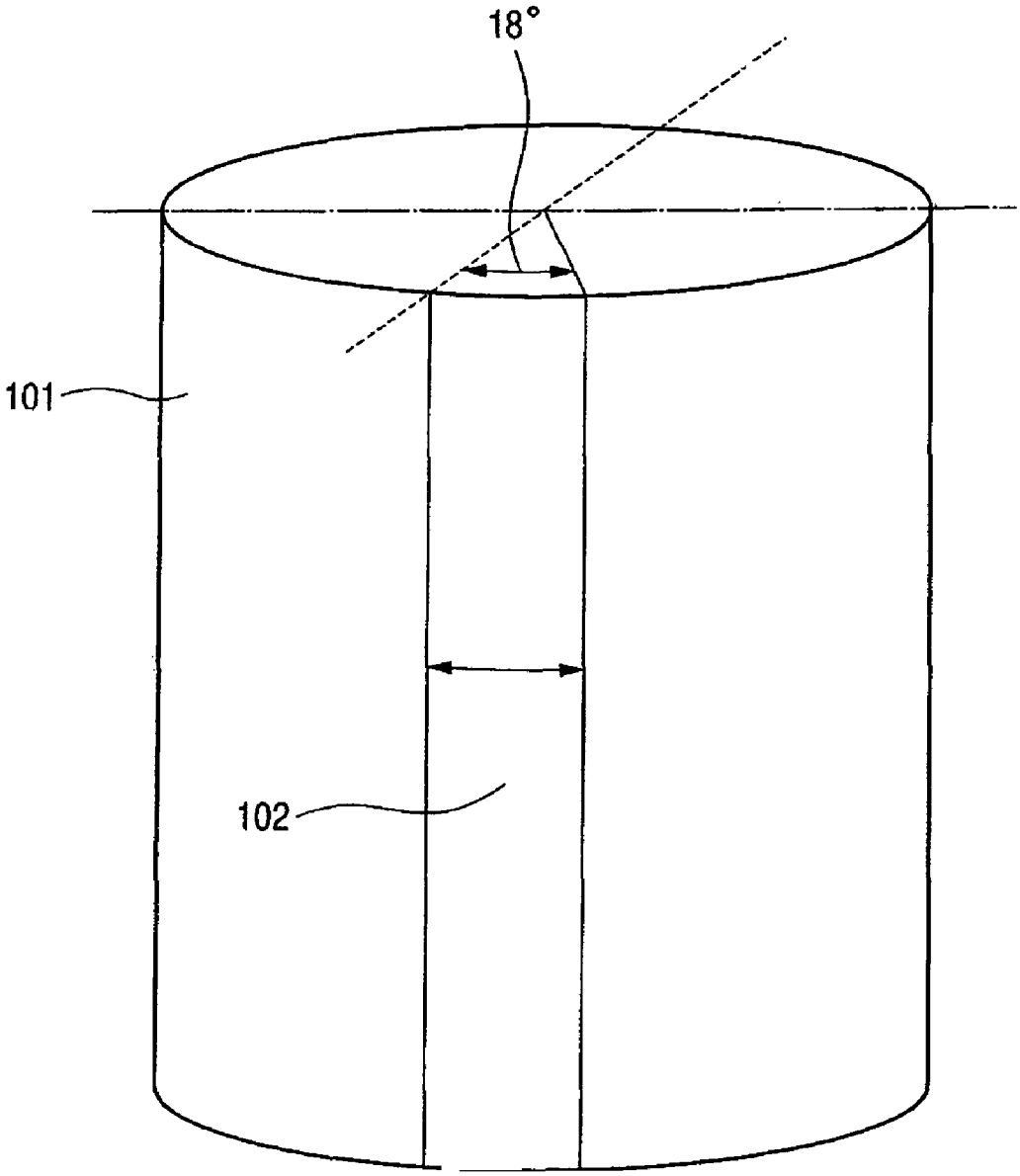
FIG. 4 is a view showing a method in which the thickness of the electrophotographic belt is measured at intervals of one millimeter in the peripheral direction by a length equivalent to 5% of the inner peripheral length of the electrophotographic belt.

The present inventors, as shown in FIG. 4, with respect to the flake-shaped portion 102 having an arc length of 5% of the inner peripheral length of the electrophotographic belt 101, have checked a relation between the measured value measuring the thickness of the flake-shaped portion at intervals of one millimeter in the peripheral direction and the color shift. In FIG. 4, a film thickness of the flake-shaped portion 102 having an arc length of 5% of the inner peripheral length is measured at three places in the axial direction (see FIG. 13), and 5% of the inner peripheral length is 18° equivalent to one twentieth of the belt peripheral length, and this is within a measuring range (position is arbitrary) of the film thickness unevenness of the short period. As a result, the present inventors have found out that, if the difference between the maximum value and the minimum value of the measured value is 2% or more of the arithmetic average value, and more preferably 3% or more, deterioration of the color shift due to repeated usage can be effectively controlled.

Naturally, if the thickness unevenness is too large, an image defect (decrease in uniformity of output image density) arising from this unevenness is prone to be generated. Consequently, the difference between the maximum value and the minimum value of the measured value is required to be 20% or less of the arithmetic average value, and more preferably to be 15% or less.

The difference between the maximum value and the minimum value of the measure value is divided by the arithmetic average value, and a numerical value multiplying this quotient 100 times is referred to as "unevenness (%) of the short period of the thickness". The electrophotographic belt of the present invention is a belt having the unevenness of the short period of the thickness in the range of 2% or more and 20% or less. Further, a more preferable range of the unevenness of the short period of the thickness is in the range of 3% or more and 15% or less.

In the present invention, in order to measure the unevenness of the short period of the thickness, the thickness is measured only by the length of 5% of the inner peripheral length of the electrophotographic belt. The technological reason is as follows. That is, the winding amount (length) of the electrophotographic belt toward the driving roller to rotationally drive the electrophotographic belt is usually approximately 5% (approx. 3 to 7%) of the inner peripheral length of the electron-photographic belt. Consequently, if the measurement length of the thickness is presumed to be 5% of the inner peripheral length of the electrophotographic belt, the unevenness of the thickness of the electrophotographic belt of the portion, where the electrophotographic belt is wound by the driving roller, can be approximately realized. Next, the technology of reducing the color shift of the initial period will be described.

According to the investigations conducted by the present inventors, it has been found that the unevenness of the short period of the thickness of the electrophotographic belt does not sharply affect the color shift of the initial period, but the unevenness of the long period of the thickness of the electrophotographic belt greatly affects the color shift of the initial period. Hence, the present inventors have conducted extensive investigations on the unevenness of the long period of the thickness, and have introduced a value defined as Z by the formula (I) as a parameter to prescribe the unevenness of the long period of the thickness.

Here, the technological meaning of Z will be described.

The thickness of the electrophotographic belt is measured at 20 points at equal intervals across the entire periphery in the peripheral direction of the electrophotographic belt, and the measured values are taken as $t_n$ (n=1, 2, . . . 20) (μm), respectively. The measurement is performed by rotating the electrophotographic belt in one direction. When the measurement starting position (measuring point of $t_1$) of the thickness is taken as 0°, the thickness is measured at intervals of 18° in the way of the measuring point 0°, 18° (measuring point of $t_2$), 36° (measuring point of $t_3$), . . . 360° (measuring point of $t_{20}$). First, the obtained measured values are plotted in circular coordinates with a radius vector taken as $t_n$ and a deflection angle taken as 18×(n−1)° (provided that n is an integer number of 1 to 20). Next, the position of $t_n$ in the circular coordinates is considered to be expressed by XY orthogonal coordinates (Cartesian coordinates). Here, the orthogonal coordinates are taken as the coordinates where a X axis is taken in a horizontal direction, and a Y axis is taken in a vertical direction, and the intersecting point of the X axis and the Y axis is taken as an origin 0. Then, the X component ($tx_n$) of each $t_n$ in the XY orthogonal coordinates is expressed as $t_n \times \cos(18\times(n-1)°)$, and the Y component of ($ty_n$) of each $t_n$ is expressed as $t_n \times \sin(18\times(n-1)°)$ (provided that n is an integer number of 1 to 20).

Figure 5:
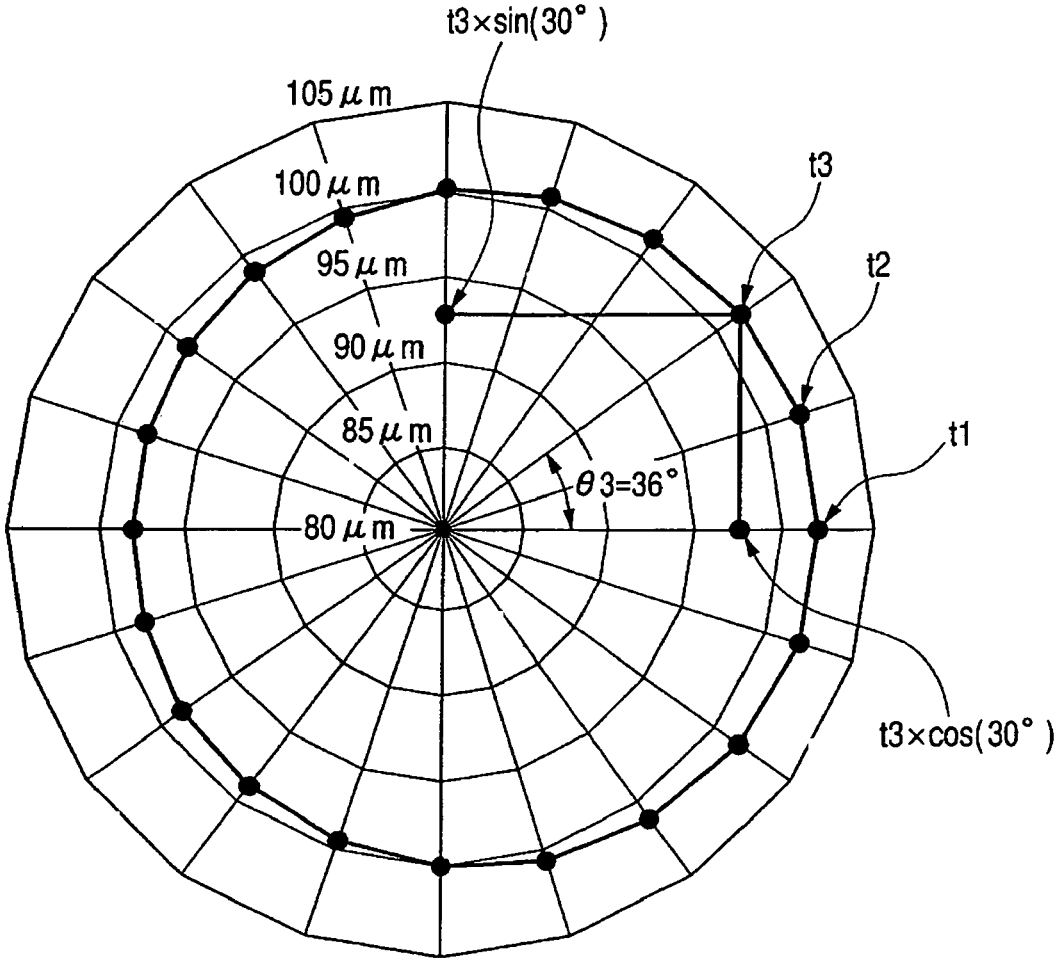
FIG. 5 is a view showing the thickness in the peripheral direction of the electrophotographic belt by a circle graph.

When a total sum of each $tx_n$ (n is an integer number of 1 to 20) is taken as X, and a total sum of each $ty_n$ (n is an integer number of 1 to 20) is taken as Y, the value of Z found by the formula (1) are equivalent to the distance between the center of gravity of a closed surface made by tying the points ($t_n$) of 20 places adjacent to one another by straight lines and the origin 0 of the XY orthogonal coordinates when each $t_n$ is plotted in the XY orthogonal coordinates (see FIG. 5). Because of such reason, in the present invention, the value of Z defined by the formula (1) is positioned as a polarization (polarized thickness) of the thickness of the electrophotographic belt, that is, a parameter to express the unevenness of the long period of the thickness.

Next, a relation between the waveform of the circular graph of FIG. 5 and the center of gravity Z will be examined.

It is to be noted that the waveform of the circular graph, as described above, is hereinafter referred to as the visible outline of the closed surface made by plotting each $t_n$ (n is an integer number of 1 to 20) in circular coordinates and tying each point ($t_n$) of 20 places adjacent to one another by straight lines (see FIG. 5). In FIGS. 5 to 8, each $t_n$ is plotted in the circular coordinates, and after that, the coordinate system is replaced from the circular coordinates to the XY orthogonal coordinates. When replacing the coordinates, in order that the intersecting point between the X axis (horizontal direction) and the Y axis (vertical direction) in the XY orthogonal coordinates, that is, the origin 0 and the singular points (0 and θ) of the circular coordinates, that is, the position of a radius vector 0 are matched, the circular coordinates are replaced by the XY orthogonal coordinates.

Figure 6:
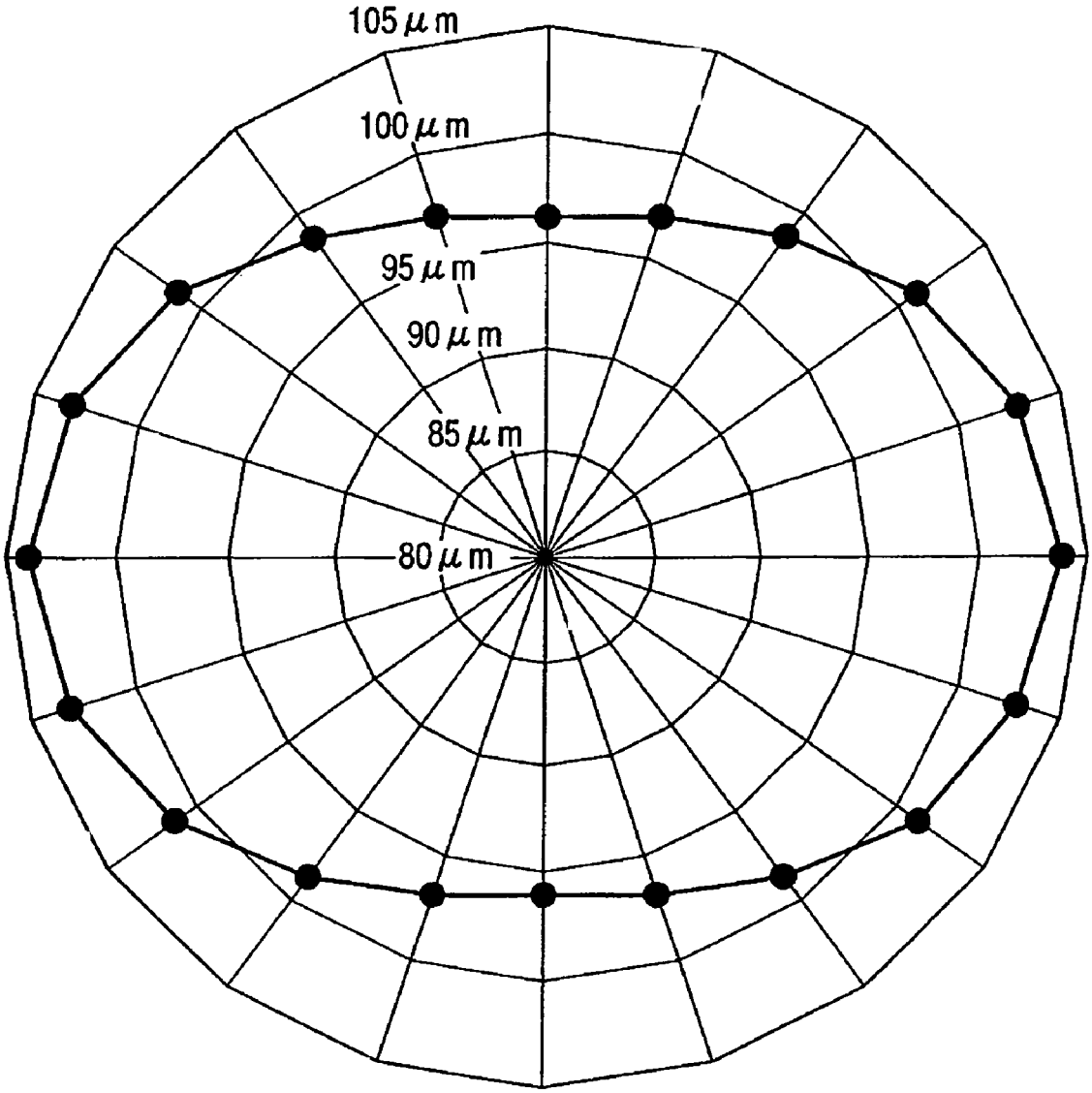
FIG. 6 is a view in the case where the wavelength of thickness unevenness is equal to half of the inner peripheral length of the electrophotographic belt.
Figure 7:
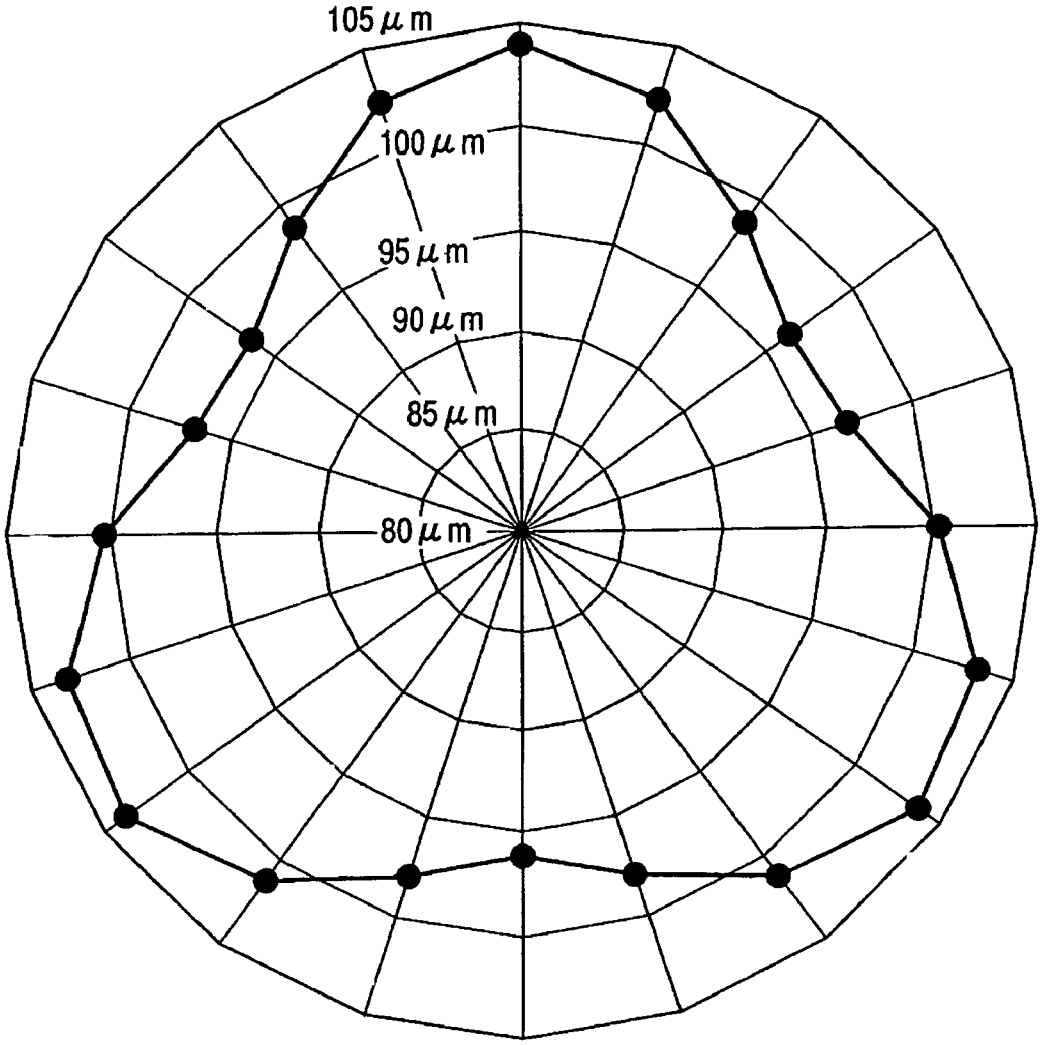
FIG. 7 is a view in the case where the wavelength of thickness unevenness is equal to one third of the inner peripheral length of the electrophotographic belt.
Figure 8:
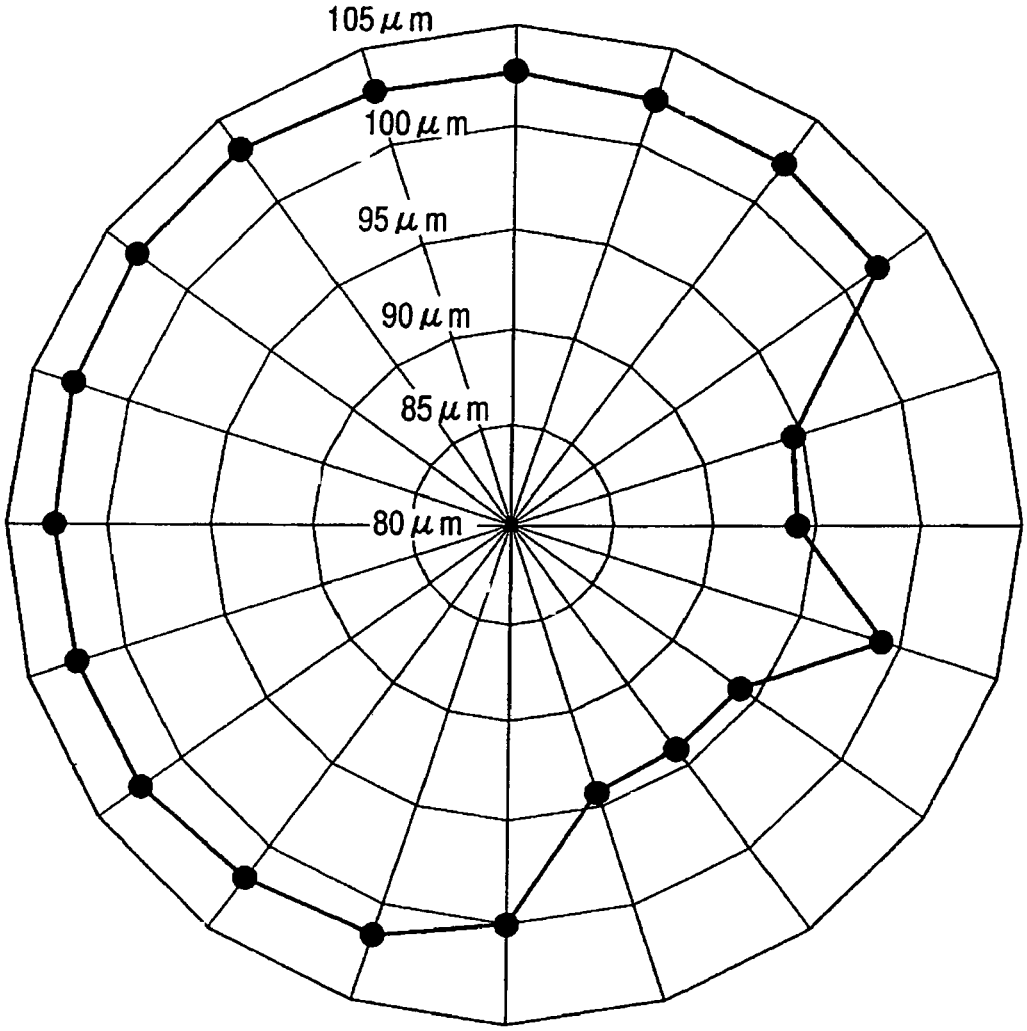
FIG. 8 is a view illustrating a case where the thickness is changed in the vicinity of a specific position.

In case the waveform is expressed by a sin wave having one-half wavelength of the inner peripheral length of the electrophotographic belt, as is evident from FIG. 6, the center of gravity Z is not affected by the unevenness of the thickness, and is equal to the origin in the figure. In case the waveform is expressed by a sin wave having one-third wavelength of the inner peripheral length of the electrophotographic belt, since it does not exactly become a point symmetry with the origin taken as a center of symmetry, it affects the center of gravity Z, but slightly, and the center of gravity Z is almost equal to the origin (see FIG. 7).

It will be appreciated hereinafter that, in the case of a sin wave having 1/m (m is an integer number of 2 or more) wavelength of the inner peripheral length of the electrophotographic belt, the gravity of center Z is equal (approximately equal) to the origin.

In the present invention, since the number of measuring places is 20, in case there is no common factor other than 1 between m and 20 (for example, m=3, 7, 9), when $t_1$ to $t_{20}$ are shown in the circular graph, the waveform of this circular graph does not become a point symmetry with the origin taken as a center of symmetry. Hence, strictly speaking, the sin wave having 1/m wavelength of the inner peripheral length of the electrophotographic belt slightly affects the value of the center of gravity Z by collapse of symmetric property. The effect of the collapse of symmetric property on the center of gravity Z becomes smaller as the number of measuring places increase. However, despite of the fact that the labor hour of the measurement increases as the number of measuring places increases, the effect on the center of gravity Z ends up becoming much smaller. Consequently, the number of measurement places must be decided in consideration of the balance between the labor hour and the effect, and in the present invention, 20 places have been adopted. The details thereof are as follows.

The present inventors have conducted investigations regarding how many of the number n of measurement places is appropriate in deriving the center of gravity Z. As a result, first, if n is 16 or more, it was found that there is a close relation between the value of the center of gravity Z and the initial color shift. The present inventors have decided that the number of measurement places is 20 based on this result. This is because the numeral 20 is a numeral of 16 or more, and in addition, it has the following technological signification.

That is, in the case of the tandem type color electrophotographic apparatus, there are often the cases where, after the transfer of some page is completed, before the electrophotographic belt makes one turn, the transfer of the next page is started. That is, there is a possibility that, at the operating time of the electrophotographic apparatus, the specific position alone of the electrophotographic belt is not used every time, but any of the positions is used. Consequently, regardless of whichever position of the electrophotographic belt is used, in order to control the color shift, not only in one portion of the electrophotographic belt, but across the entire portion, the unevenness of the long period of the thickness is required to be small.

As described above, the winding amount (length) of the electrophotographic belt toward the driving roller to rotationally drive the electrophotographic belt is usually approximately 5%=1/20 of the inner peripheral length of the electronphotographic belt. Consequently, if the number of measurement places is 20, any of the measurement places almost inevitably falls upon the winding portion toward the driving roller.

On the other hand, a sin wave having a wavelength equal to the inner peripheral length of the electrophotographic belt affects the center of gravity Z. Further, even in case a specific position alone changes in thickness (for example, see FIG. 8), the sin wave affects the center of gravity Z. In particular, in case the electrophotographic belt is prepared by an extrusion molding, due to distortion of the annular die (low in circularity), there exists microscopic non-uniformity in the gap of die lips, and a state in which the thickness changes at the specific position alone is prone to be invited.

Although the electrophotographic belt of the present invention is below 2.0 μm in center of gravity Z, it is preferably below 1.5 μm. From the above described view point, as the center of gravity Z becomes smaller, much preferable it is, and though it may be Z=0 μm, when considering the unevenness at the time of mass production, the lower limit of Z becomes approx. 0.01 μm.

The material constituting the electrophotographic belt of the present invention will be described below.

The electrophotographic belt of the present invention is an electrophotographic belt comprising thermoplastic resin composition including the thermoplastic resin. The content of the thermoplastic resin in the thermoplastic resin composition is preferably equal to or more than 50 percent by mass for the entire mass of the thermoplastic resin composition.

Even among the thermoplastic resin, from two points of view of durability of the electrophotographic belt and easiness to obtain the unevenness of the short period of the thickness, polyamide, polyphenylene sulfide, polyvinylidene fluoride, and alicyclic polyester resin are preferable. As alicyclic polyester resin, for example, polycyclohexylene dimethylene terephthalate can be cited.

Even among these resins, polyamide and polyvinylidene fluoride are more preferable.

Among polyamide, aliphatic polyamide such as polyamide 11, polyamide 12, polyamide 6 to 10, polyamide 6 to 12, and the like are more preferable. Since aliphatic polyamide is low in water adsorption comparing with polyamide 6 and the like, it can reduce the fluctuation (fluctuation in high temperature high humidity environment–low temperature low humidity environment) due to the environment of the inner peripheral length of the electrophotographic belt. If the fluctuation due to the environment of the inner peripheral length of the electrophotographic belt is low, the fluctuation due to the environment of the tensile force of the electrophotographic belt is reduced, and a stabilized tensile force can be obtained. In particular, when the peripheral length of the electrophotographic belt becomes long in the high temperature high humidity environment, and the tensile force is lowered, the electrophotographic belt and the driving roller slip together, so that the color shift is prone to be generated.

Polyamide may be used in one type or may be combined with two or more types.

Further, in case polyamide is used as (one type of) the thermoplastic resin within the thermoplastic resin composition, in view of improving durability of the electrophotographic belt, copper iodide and potassium iodide are preferably allowed to contain 0.01 to 1 percent by mass for the entire content of the thermoplastic resin composition.

Similarly to polyamide, as particularly preferable resin, though polyvinylidene fluoride resin can be cited, in the present invention, polyvinylidene fluoride indicates copolymer copolymerizing homopolymer of vinylidene fluoride and vinilidene fluoride and comonomer. As comonomer used for copolymerization, propylene hexafluoride, tetrafluoethylene, and the like can be cited, and the content of comonomer is approximately 5 to 15 mol percent. However, homopolymer high in tensile elasticity rather than other polymers is hard to generate microscopic peripheral speed unevenness during the driving of the belt, and is advantageous over copolymer in color shift. In homopolymer of polyvinylidene fluoride resin, though a coupled portion of head to head and a coupled portion of head to tail often coexist, a ratio of such mixture does not affect the effect of the present invention. Since polyvinylidene fluoride resin is also low in water adsorption, it can reduce the fluctuation due to the environment of the inner peripheral length of the electrophotographic belt, and can obtain stabilized tensile force without depending on the use environment of the electrophotographic belt. As a result, it can be prevented that the peripheral length of the electrophotographic belt becomes long in high temperature high humidity environment and a tensile force is lowered, and the electrophotographic belt and the driving roller slip together, thereby creating the color shift.

Further, when polyvinylidene fluoride resin is added with graphite having 1 to 20 μm in arithmetic average value of a diameter equivalent to the area, the unevenness of the short period of the thickness is suitably adjusted to 2 to 20(%) in the range of the present invention. The reason why is not certain, but the following two reasons are conceivable.

1. The size of graphite of 1 μm or more and 20 μm or less is a size easy to contribute to form irregularity (unevenness of the short period) of the surface of the electrophotographic belt.

2. Since the interfacial energy between graphite and polyvinylidene fluoride resin is great, dispersion of graphite in polyvinylidene fluoride is moderately obstructed, thereby contributing to form irregularity (unevenness of the short period) of the surface of the electrophotographic belt.

Figure 15A:
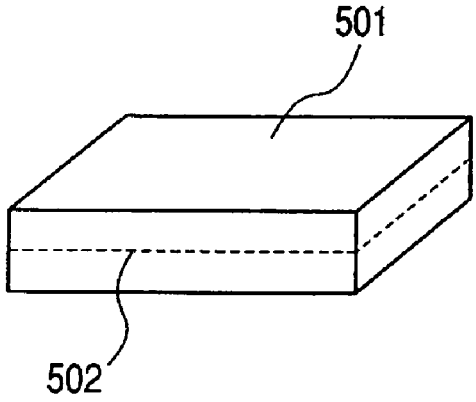
FIG. 15A is a view showing an observational direction when finding an average particle size of graphite before a slice surface is obtained.
Figure 15B:
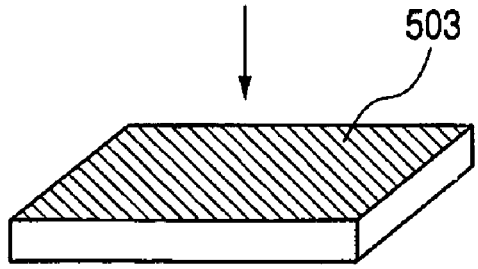
FIG. 15B is a view showing an observational direction when finding an average particle size of graphite after a slice surface is obtained.

The diameter equivalent to the area of graphite is found as follows. First, the electrophotographic belt, as shown in FIG. 15A, is sliced at a surface horizontal with a belt surface 501. A slice surface 502 is placed at the center position for the thickness direction of the belt. A slice surface 503 is observed directly above by a scanning electron microscope (SEM) (FIG. 15B). An observation magnifying power is set to such a power able to observe about 50 to 100 pieces of graphite particles in the observation field of view of the scanning electron microscope. The graphite particles are selected 30 pieces in a random order from the field of view observed, and the observed areas (the areas when observed by the scanning electron microscope) of the graphite particle of selected 30 pieces are found, respectively. Next, the arithmetic average value of the found observed areas of 30 pieces is found. Finally, the diameter of a circle having the same area as the arithmetic average value is calculated, and this value is taken as the arithmetic average value of the diameter equivalent to the area of graphite.

A preferable additive mass of graphite is 1% or more and 10% or less for the entire mass of the thermoplastic resin composition. When the load of graphite is less than 1% by mass, the effect of adding graphite is hard to obtain, and when it is more than 10% by mass, the electrophotographic belt is prone to become frail.

In polyphenylene sulfide, there are two forms of a cross-linking type and a straight-chain type. While either of the types can be used in the present invention, from the view point of improving durability of the electrophotographic belt, the straight-chain type polyphenylene sulfide is preferable.

Further, in case polyphenylene sulfide is used, it is preferably used together with polyamide. Poly phenylene sulfide is high in melting point comparing with polyamide, and is also different in melt viscosity. Consequently, at the preparing time of the electrophotographic belt, in case polyamide and poly phenylene sulfide are used together, in order to perform the mixture of polyamide and poly phenylene sulfide more uniformly, it is preferable to use granulated poly phenylene sulfide. The particle size of this granulated poly phenylene sulfide is preferably smaller than the thickness of the electrophotographic belt to be prepared. If the mixture of polyamide and poly phenylene sulfide is uniform, the lowering of durability due to non-uniformity of the mixture is hard to be brought about. Further, by using olefin resin having glycidyl group and olefin resin containing acid anhydride such as maleic anhydride together, the mixture of polyamide and poly phenylene sulfide can be performed more uniformly.

Further, as polycyclohexylene dimethylene terephthalate, it is generally obtained by allowing terephthalic acid as an acid component and cyclohexane dimethanol as an alcohol component to mutually react. Here, if resin synthesized by replacing a portion of terephthalic acid by isophthalic acid is used, much tougher electrophotographic belt can be obtained.

Further, by adding olefin resin containing glycidyl group and olefin resin containing anhydride such as maleic anhydride to thermoplastic resin composition, much tougher electrophotographic belt can be obtained.

Further, four types of polyamide, poly phenylene sulfide, polyvinylidene fluoride, and alicyclic polyester resin can be mixed and used. In this case, a total of these components is preferably 50% by mass or more for the entire mass of the thermoplastic resin composition.

Further, in the thermoplastic resin composition for the electrophotographic belt of the present invention, in addition to polyamide, poly phenylene sulfide, polyvinylidene fluoride, and alicyclic polyester resin, thermoplastic resin and thermosetting resin other than these resins can be used.

As thermoplastic resin other than polyamide, poly phenylene sulfide, polyvinylidene fluoride, and alicyclic polyester resin, for example, the following rein can be cited.

Poly olefin, ethylene-vinylalcohol copolymer, polystyrene, polyacrylonitrile, ABS resin, polyacetal, methacrylic resin, modified polyphenylene ether, polysulfone, polyethersulfone, polyamide-imide, thermoplastic polyamide, poly ether-ether ketone, aliphatic polyketone, poly methyl pentene, fluorine contained resin (ethylene-tetrafluoride ethylene copolymer, tetrafluoroethylene perfluoroalkylvinyl ether copolymer, fluoroethylene propylene copolymer, tetrafluoroethylene, and the like), liquid crystal polymer, and the like.

Among these resins, in particular, the copolymer with glycidyl methacrylate which is one type of poly olefin and/or maleic anhydride and/or ethylacrylate and ethylene is preferable. The reason why is because the copolymer is high in toughness due to unit of ethylene affiliation, and moreover, affinity with polyamide, poly phenylene sulfide, alicyclic polyester resin is good, the toughness is effectively exerted, and durability of the electrophotographic belt is improved.

In case the copolymer is used for the thermoplastic resin composition for the electrophotographic belt of the present invention, the content of the copolymer is preferably 1% by mass or more and 10% by mass or less for the entire mass of the thermoplastic resin composition. If the content is too little, the improvement effect of durability becomes small, and if too much, durability is lowered in reverse. The reason why durability is lowered if the content of the copolymer is too much is not certain. Speaking strictly of the case where polyamide, poly phenylene sulfide, polyvinylidene fluoride, and alicyclic polyester resin are used, the present inventors suspect that the reason why is because relative contents of these resins are lowered, so that the improvement effect of durability carried by these resins becomes small.

Further, the thermoplastic resin composition for the electrophotographic belt of the present invention can be also added with low resistance resin including polyether unit such as poly ether ester, poly ether esteramide, and the like. The low resistance resin, to be specific, means a resin having $10^{10}$ Ω·cm or less in specific volume resistance.

Further, the thermoplastic resin composition for the electrophotographic belt of the present invention can be also added with salt having perfluoroalkyl group such as perfluoro butane sulfonic potassium, and the like.

Further, the thermoplastic resin composition for the electrophotographic belt of the present invention is allowed to contain inorganic fine particles of 10% by mass or more and 40% by mass or less for the entire mass of the thermoplastic resin composition, so that it becomes easy to form the unevenness of the short period of the above described thickness. The reason why is believed to be as follows by the present inventors:

1. Melt viscosity of the entire thermoplastic resin composition rises, and melt fracture is easy to be generated at the preparing time of the electrophotographic belt, and the above described unevenness of the short period of the thickness is easy to occur.

Further, in case the electrophotographic belt is prepared by the extrusion molding, it is considered that the effects of the above item 1 and the item 2 below are also added.

2. The behavior of the molten thermoplastic resin composition at the preparing time of the electrophotographic belt draws closer to plastic deformation from viscous deformation, so that stripes parallel with the extruding direction are easy to occur, and the above described unevenness of the short period of the thickness is easy to occur.

When the content of the inorganic fine particles in the thermoplastic resin composition is too little, the above described effects become poor. Further, when the content of the inorganic fine particles in the thermoplastic resin composition is too much, toughness of the electrophotographic belt to be prepared is lowered, and durability is lowered. Preferable content of the inorganic fine particles is 12% by mass or more and 30% by mass or less for the entire mass of the thermoplastic resin composition, and more preferable content is 13% by mass or more and 26% by mass or less for the entire mass of the thermoplastic resin composition.

Further, in case carbon black and the inorganic fine particles other than carbon black are used together as an inorganic fine particle, the above described unevenness of the short period of the thickness is allowed to be more easy to occur, and is more preferable.

As the inorganic fine particles other than carbon black, zinc oxide, titanium oxide, talc, mica, and silica are preferable. Particularly, silica is more preferable. As silica, in particular, silica by dry process which is processed with dimethyldichrolosilane, hexamethyldisilazane, octylsilane, dimethyl silicone oil is preferable.

The content of carbon black in the thermoplastic resin composition is preferably 5% by mass or more and 15% by mass or less for the entire mass of the thermoplastic resin composition, and is more preferably 6% by mass or more and 14% by mass or less.

Further, the content of the inorganic fine particles other than carbon black in the thermoplastic resin composition is preferably 1% by mass or more and 35% by mass or less for the entire mass of the thermoplastic resin composition, and is more preferably 2% by mass or more and 25% by mass or less.

In case the thermoplastic resin composition is combined with carbon black and the inorganic fine particles other than carbon black, as described above, its total content is preferably 10% by mass or more and 40% by mass or less for the entire mass of the thermoplastic resin composition.

Next, the method of preparing the electrophotographic belt of the present invention will be described by citing an example.

In the present invention, a (tube) means a shaped matter of a cylindrical form, and its thickness is not particularly limited.

(Production Method—1)

Conductive agent is blended in the thermoplastic resin, thereby obtaining the thermoplastic resin composition, and this thermoplastic resin composition is extruded for the annular die, so that a tube of the thermoplastic resin composition is shaped. At this time, the inner peripheral surface and the outer peripheral surface of the tube extruded from an annular die are preferably drew out in the extruding direction of the tube without contacting a mandrel and the like because, on the surface of the tube immediately after extruded from the annular die, there exist stripes parallel with the extruded direction due to the effect or the like of microscopic melt fractures and microscopic scars of the annular die. These stripes can be brought into play as the unevenness of the short period of the thickness. If the tube is drew out while the mandrel and the like are brought into contact with the inner peripheral surface and the outer peripheral surface of the tube, the stripes and the like are crushed by the contact with the mandrel and the like, and the protrusions of the stripes are rubbed, and the height of the protrusions are made low or the like. As a result, the stripes having existed immediately after extruded are flattened.

Further, to completely uniform the intervals of the outlets (die lips) of the annular die across the peripheral direction is extremely difficult, and therefore, in the tube extruded from the annular die, usually there exists polarized thickness.

Usually, in case the tube is obtained by the extrusion molding, the intervals of the die lips are adjusted so that the polarized thickness of the tube to be obtained becomes small. However, since such adjustment is repeated every time the polarized thickness of the tube is confirmed, the adjustment operation takes a lot of trouble. Further, since it is only the coupling of the cores of a male type and a female type of the annular die that can be adjusted, even if both cores can be completely coupled, the polarized thickness due to distortion (low in circularity) of the annular die cannot be removed.

Hence, it is extremely difficult to obtain the value of the center of gravity Z of the present invention by the ordinary extrusion molding, and the electrophotographic belt small in the color shift of the initial period cannot be obtained.

To solve the above described problems and obtain the value of the center of gravity Z of the present invention, while spraying a gas (wind) in the peripheral direction of the tube extruded from the annular die and different in the temperature though with the same gas quantity with the same direction, the tube is preferably cooled and solidified. To be specific, the thick portion in thickness of the tube is sprayed with gas high in temperature, and the thin portion in thickness of the tube is sprayed with gas low in temperature. By so doing, the thick portion becomes high in temperature, and therefore, it takes a relatively long period of time until it is solidified. Since the tube before solidified is elongated by being drew out and becomes thin in thickness, slower the solidification is, thinner it is elongated. On the contrary, the portion sprayed with gas low in temperature is solidified relatively faster, and therefore, it is not elongated very much. As a result, a process comes into play in such a manner that the thick portion is made thinner and the thin portion is not extremely made thinner, thereby making it possible to reduce the polarized thickness.

From among the gasses to be sprayed, the temperature difference between the gas highest in temperature and the gas lowest in temperature is preferably 5° C. or higher and 100° C. or lower. If the temperature difference is lower than 5° C., the effect of removing the polarized thickness becomes poor. In case the polarized thickness of the tube is so large that the temperature difference is necessary to be higher than 100° C., it is difficult to draw out the tube upright.

Figure 10:
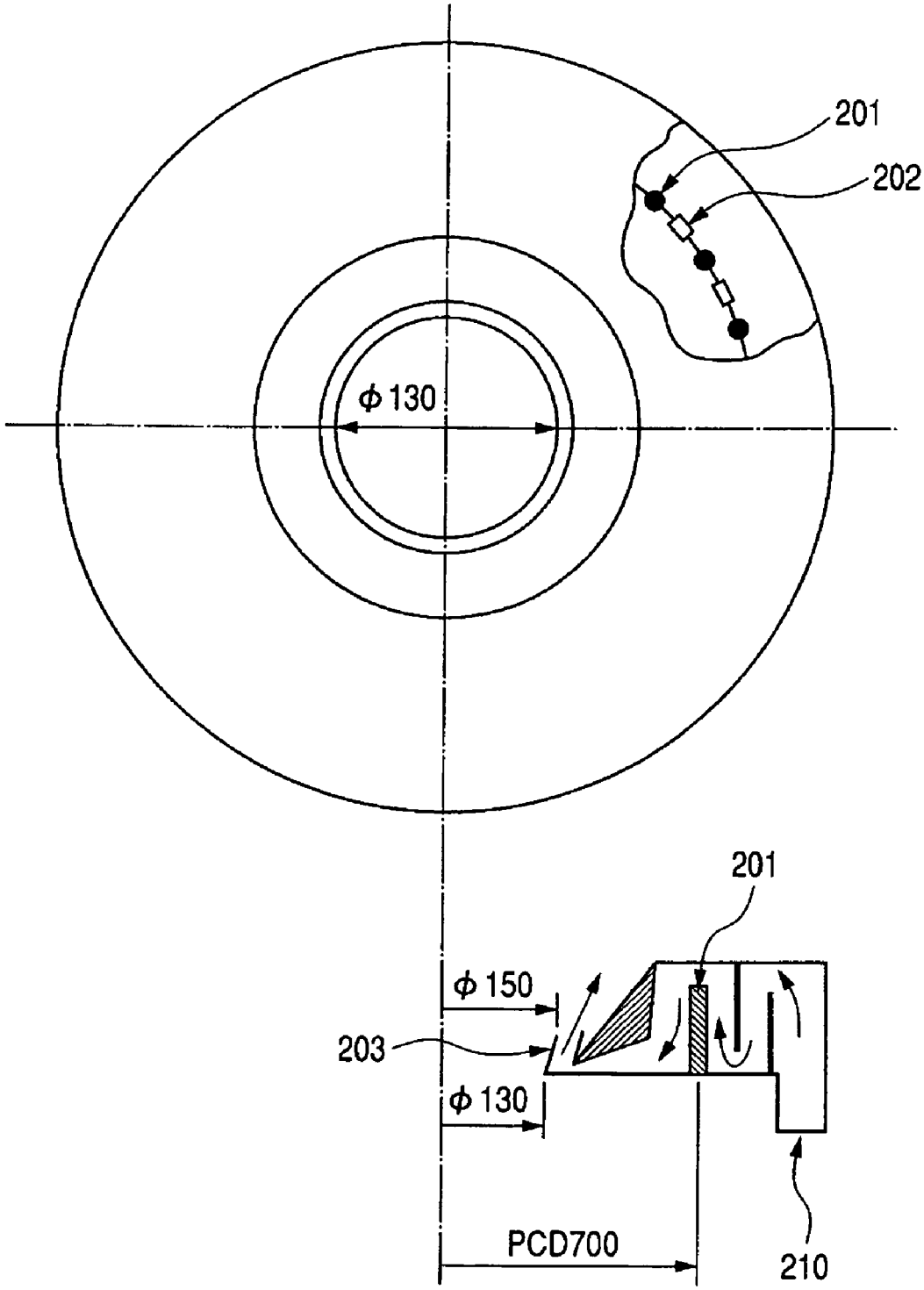
FIG. 10 is an airing block diagram.

To spray the gas different in temperature in the peripheral direction toward the peripheral direction of the tube extruded from the annular die, an airing is disposed on the upper portion of the annular die, and in the interior of the airing, there are circumferentially lined up and disposed plural heaters, and the power supply to the heaters is preferably controlled individually. FIG. 10 is a block diagram of the airing. At this time, the space between adjacent heaters is preferably provided with insulation members. When there are no insulation members, heat of the heaters adjacent to each other interferes, and the effect of individual control becomes attenuated.

When a partition is provided in the peripheral direction of the interior of the airing, and a heater is disposed one by one in the partitioned room, the interference between the heaters adjacent to each other can be avoided, and it looks preferable at first glance. However, in reality, when the partition is provided, the gas flow is divided, and uniformity of a flow rate and a flow speed in the peripheral direction of the gas is prone to be damaged, and therefore, it is better not to divide the flow path (wind path) of the gas of the interior of the airing in the peripheral direction.

The distance from the heater to the blowing outlet is preferably made 100 mm or more and 600 mm or less. In case it is closer than 100 mm, non-uniformity of the gas flow due to heater shape is not alleviated, thereby becoming a cause of the unevenness of the thickness. In case the distance is far away than 600 mm, the wind having flown by passing through the heaters adjacent to each other is mixed up, and the temperature difference of the wind disappears, thereby making polarized thickness reduction effect poor.

If the heat sink to be mounted on the heater is selected from those having small heat capacity, temperature control response of the gas is improved, and it is preferable.

The upper limit of the suitable range of the heat capacity of the heat sink changes depending on the output of the heater. When the output of the heater is taken as $W_H$ (W), the heat capacity (J/K) of the heat sink mounted on the heater is preferably 0.50 $W_H$ (J/K) or less, and is more preferably 0.15 $W_H$ (J/K) or less.

On the other hand, the lower limit of the suitable range of the heat capacity (J/K) of the heat sink is decided from the view point of the mechanical strength of the heat sink. This is because, in general, as smaller the heat capacity of the heat sink is made, thinner the heat sink is made, and mechanical strength becomes low. To be specific, the heat capacity (J/K) of the heat sink is preferably 2 J/K or more, and is more preferably 3 J/K or more.

From the above, for example, in case the output of the heater is 200 W, the heat capacity of the heat sink is preferably in the range of 2 J/K or more and 100 J/K or less, and is more preferably in the range of 3 J/K or more and 30 J/K or less. Further, the output of the heater is 100 W, the heat capacity of the heat sink is preferably in the range of 2 J/K or more and 50 J/K or less, and is more preferably in the range of 3 J/K or more and 15 J/K or less.

The number of heaters is preferably at least the same 20 as the number of measuring places when the unevenness of the long period of the thickness is measured. The number of heaters is increased to 20 pieces or more so that more fine adjustment is made, and it is more preferable. However, if the number of heaters is excessively increased, the adjacent heaters easily interfere with each other, and therefore, the upper limit of the number of heaters is approx. 100 pieces.

(Production Method—2)

First, by using the thermoplastic resin composition and by the known production method such as a centrifugal molding, a belt having few unevenness of the long period of the thickness is prepared. This is taken as a belt 1.

On the other hand, by using the material having a melting point higher than the melting point of the thermoplastic resin composition for the belt 1, a tube 2 is prepared in advance by extrusion (known extrusion molding) from the annular die. This is taken as a tube 2. The surface of this tube 2 is attached with stripes parallel with the extrusion direction. This tube 2 may be a tube having a large center of gravity Z (for example, larger than 1.5 μm or larger than 2.0 μm). As the material of the tube 2, tetrafluoroethylene-perfluoroalkylvinylether copolymer, tetrafluoroethylene-hexafluoropropylene copolymer, and tetrafluoroethylene-ethylene copolymer are suitable.

Next, the belt 1 is covered on the tube 2 with both ends thereof closed, and further on the tube 2, a metal tube is covered, and after that, an air is introduced into the tube 2, thereby inflating the tube 2. In this state, the metal tube is heated. The heating temperature is preferably in the range of Tm−10 to Tm+40 presuming that the melting point of the thermoplastic resin composition for the belt 1 is Tm (° C.).

After that, the whole body is cooled, and the air introduced into the tube 2 is evacuated, and the belt 1 is drew out.

By so doing as described above, the inner peripheral surface of the belt 1 is transferred with the stripes of the tube 2. The belt 1, as described above, is a belt having few unevenness of the long period of the thickness, and by being transferred with the stripes of the tube 2, this tube is also given the unevenness of the short period of the thickness.

In this manner, the electrophotographic belt of the present invention can be also obtained.

Now, volume resistivity of the electrophotographic belt of the present invention is preferably in the range of $10^8$ Ω·cm or more and $10^{13}$ Ω·cm or less.

Particularly, in case the electrophotographic belt of the present invention is used as a transfer material conveying belt, its volume resistivity is preferably in the range of $10^9$ Ω·cm or more and $10^{13}$ Ω·cm or less.

In case the electrophotographic belt having too low volume resistivity is used as the transfer material conveying belt, particularly in the high temperature high humidity environment, the transfer material is reliably absorbed, and ability of conveying this transfer material at a constant speed is lowered, and the color shift is easily prone to occur. On the other hand, in case the electrophotographic belt having too high volume resistivity is used as the transfer material conveying belt, the transfer current becomes difficult to flow, and high transfer voltage is required by that much, and therefore, abnormal discharge at the transfer time is prone to be generated, and an image defect is prone to be generated.

Further, in case the electrophotographic belt of the present invention is used as an intermediate transfer belt, its volume resistivity is preferably in the range of $10^8$ Ω·cm or more and $10^{12}$ Ω·cm or less. In case the electrophotographic belt having too low volume resistivity is used as an intermediate transfer belt, a penetration image (image where thin portions in density are partially generated) is prone to be outputted. In the case of the intermediate transfer system, the toner on the electrophotographic photosensitive member is not the transfer material, and is directly transferred (primarily transferred) on the electrophotographic belt being the intermediate transfer belt, and therefore, the effect of the resistance of the electrophotographic belt is great. The volume resistivity of the electrophotographic belt is too low, the substantial voltage applied to a transfer nip is increased, and the abnormal discharge is generated, and the primary transfer is hard to be fully performed. On the other hand, in case the electrophotographic belt having too high volume resistivity is used as an intermediate transfer belt, the transfer current becomes difficult to flow, and high transfer voltage is required by that much, and therefore, abnormal discharge at the transfer time is prone to be generated, and an image defect is prone to be generated.

In the present invention, the thickness of the electrophotographic belt has been measured as follows:

(Measuring Machine)

Figure 13:
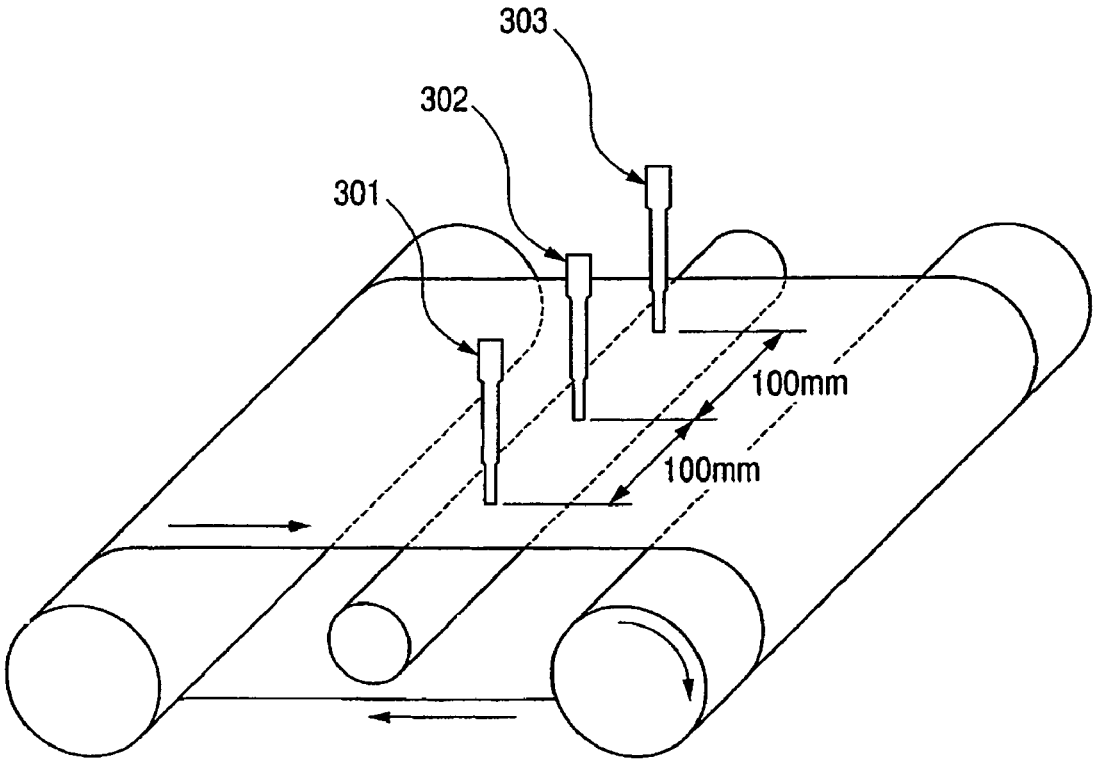
FIG. 13 is a block diagram of a thickness measuring machine of the electrophotographic belt.

In the present invention, a measuring machine has been used, in which three thickness gauges are installed at a position mutually 100 mm away and can measure the thickness of the electrophotographic belt at three places at the same time. The schematic structure of the measuring machine is shown in FIG. 13. In FIG. 13, reference numeral 301 denotes a gauge 1, reference numeral 302 a gauge 2, reference numeral 303 a gauge 3. To accurately measure the thickness of the electrophotographic belt, as the thickness gauge, repeated measuring accuracy is preferably 1 μm or less. In the present invention, a linear gauge LBG2-0105L (made by MITSUTOYO KIKO CO., LTD.) has been used. The top end of the gauge head has a shape having a part of spherical surface of 5 mm in diameter. The measuring machine having the structure shown in FIG. 13 has a mechanism in which, by intermittently rotating a roller to stretch across the electrophotographic belt by an arbitrary angle, the stretched electrophotographic belt can be intermittently funneled out by an arbitrary distance. When the measuring machine of FIG. 13 is used, though the thickness at three places can be measured in the axial direction at the same time, in the present invention, the arithmetic average values of these measured values was used for the calculation of the center of gravity Z and the calculation of the unevenness of the short period of the thickness of the electrophotographic belt.

In the present invention, the volume resistivity of the electrophotographic belt was calculated as follows.

(Measuring Instrument)

Resistance meter: Ultra-High Resistance Meter R8340A (made by ADVANTEST CORP.)

Sample Box: Sample Box for Ultra-High Resistance Meter TR42 (made by ADVANTEST CORP.)

For a main electrode, a metal of 22 mm in diameter and 10 mm in thickness was used, and for a guard ring electrode, a metal of 41 mm in inner diameter, 49 mm in outer diameter, and 10 mm in thickness was used.

(Sample)

A circular sample piece of 56 mm in diameter was cut out from the electrophotographic belt of the measuring target. One side of the cut out sample piece was provided with a deposited film electrode by performing a Pt—Pd vapor deposition on the entire surface. The other side of the sample piece was coaxially provided with a main electrode film of 25 mm in diameter and a guard ring electrode film of 38 mm in inner diameter and 50 mm in outer diameter similarly by a Pt—Pd deposited film. The Pt—Pd deposited film was obtained by using a mild spatter E1030 (made by Hitachi, Ltd.) and by performing a vapor deposition operation by a current value 15 mA for two minutes. The sample piece having finished the vapor deposition operation was taken as a measurement sample. At the measurement time, the main electrode of 22 mm in diameter was placed on the main electrode film so as not to run over from the main electrode film of 25 mm in diameter, and the guard ring electrode of 41 mm in inner diameter was placed and measured on the guard ring electrode film so that so as not to run over from the guard ring film of 38 mm in inner diameter.

(Measurement Condition)

Measurement Atmosphere: 23° C./50% RH

Note that the measurement sample was left as it was for 24 hours in advance under the measurement atmosphere.

Measurement Mode: Program Mode 5

Note that charge and measurement were taken as 30 seconds, and discharge was taken as 10 seconds.

Applied Voltage: 100 (V)

Other conditions and the calculation of the volume resistivity were made in conformity with ASTM-D257-78.

The diameter of the driving roller to rotationally drive the electrophotographic belt of the present invention is preferably in the range of 10 mm or more and 30 mm or less, and is more preferably in the range of 12 mm or more and 28 mm or less. As larger the diameter of the driving roller becomes, larger the size of the electrophotographic apparatus is prone to become. On the other hand, as smaller the diameter of the driving droller becomes, smaller the winding amount of the electrophotographic belt toward the driving roller is prone to become. When the winding amount of the electrophotographic belt toward the driving roller is small, by repeated usage, the rear surface of the electrophotographic belt and the front surface of the driving roller become easily slippable, thereby creating a cause of color shift.

The surface of the driving roller is preferably allowed to have a rubber layer of 0.05 mm or more and mm or less in thickness. By allowing the surface of the driving roller to have a rubber layer, a wedge-effect by the unevenness of the short period of the thickness of the electrophotographic belt is increased, the deterioration of the color shift by repeated usage is effectively reduced. However, when the thickness of the rubber layer is too thin, the augmentative effect of the wedge-effect becomes poor. On the other hand, when the thickness of the rubber layer becomes too thick, the diameter variation of the driving roller due to thermal expansion of rubber becomes larger, and therefore, the rotational speed of the electrophotographic belt changes by the use environment, and the color shift is prone to be generated.

The thickness of the electrophotographic belt of the present invention is preferably in the range of 70 μm or more and 150 μm or less in average (average thickness), and is more preferably in the range of 80 μm or more and 120 μm or less. When the average thickness is too thin, the mechanical strength of the electrophotographic belt runs short, and is prone to be broken down during repeated usage. On the other hand, when the average thickness becomes too thick, the electrophotographic belt becomes firm, and smooth rotational driving becomes difficult.

The present invention will be further described below in detail by citing specific Examples. However, the present invention is not limited to these Examples. A "part(s)" in the Examples indicates a "part(s) by mass".

Example 1

By using a twin screw extruder, a pellet-shaped thermoplastic resin composition (hereinafter referred to also as "pellet") comprising the blending of Table 1 was adjusted.

Figure 9:
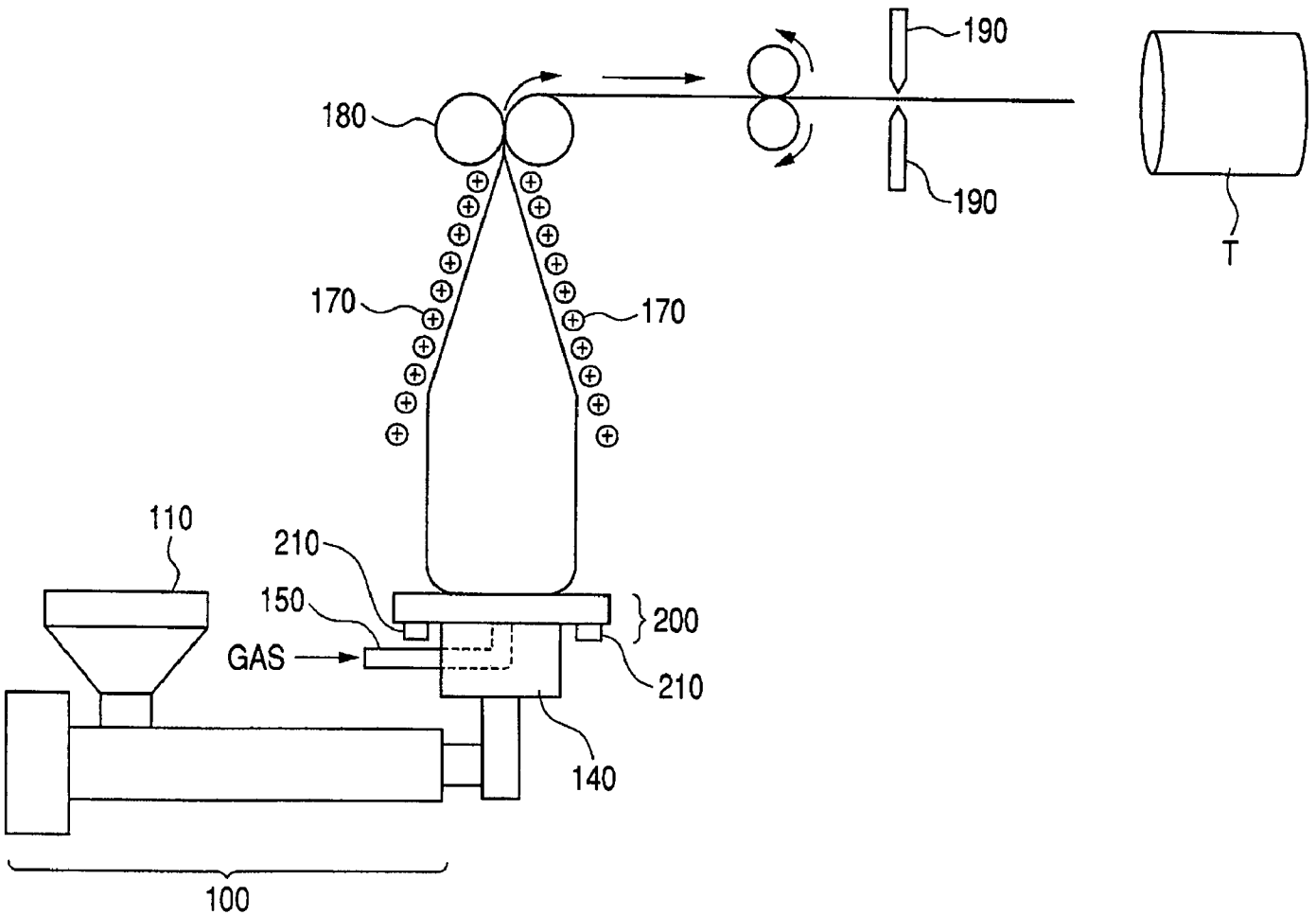
FIG. 9 is a block diagram of a tubular film process machine.

Next, by using this pellet, and by using a tubular film process machine shown in FIG. 9, a tube was prepared by tubular film process.

Figure 11:
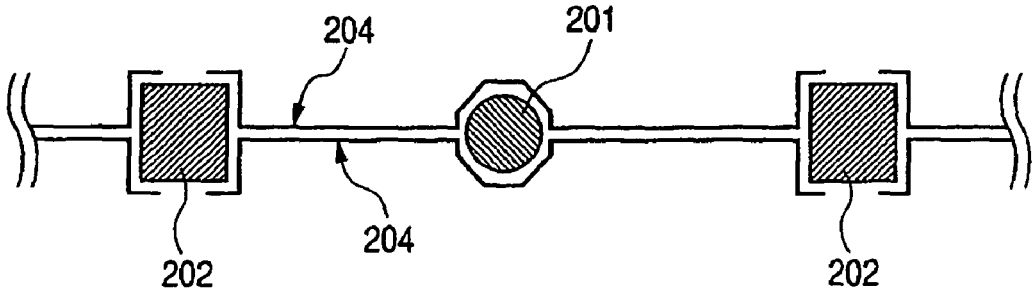
FIG. 11 is an enlarged view of a heater, a heat sink, an insulator disposed within the airing.
Figure 12:
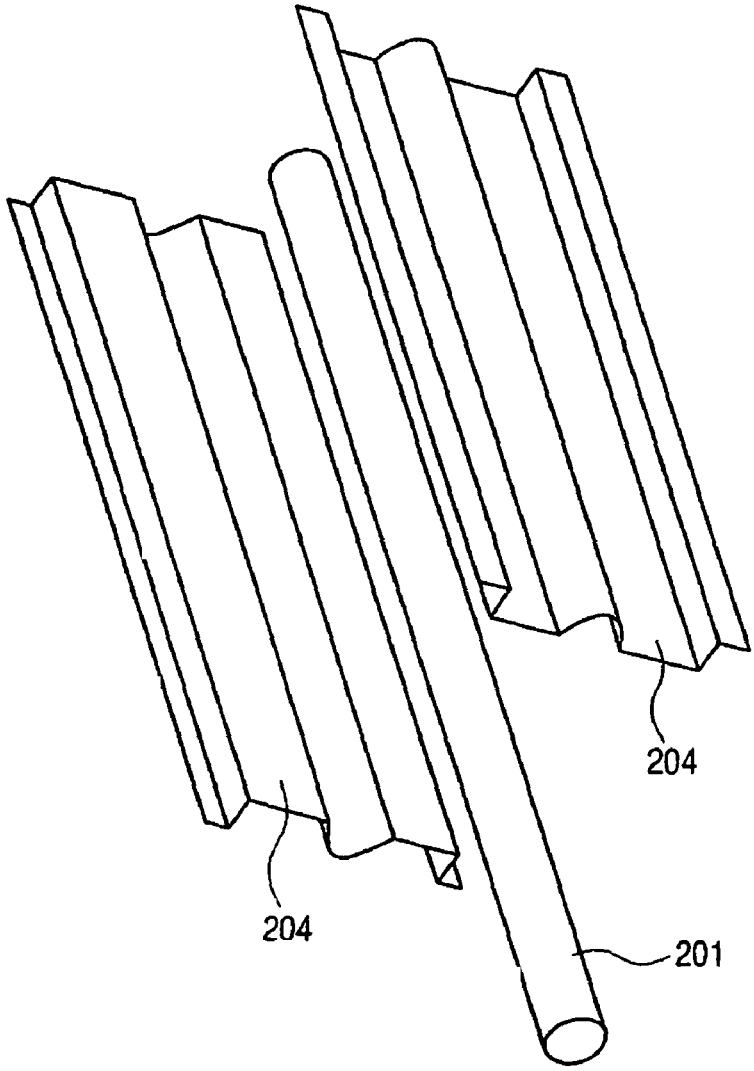
FIG. 12 is a view showing a nipping state of the heater by the heat sink.

Here, as shown in FIG. 10, the interior of an airing 200 is built with 20 pieces of heaters (cartridge heaters 201) of 200 (W) per piece on a pitch circle of 700 mm in diameter (each heater is disposed at equal intervals). Further, a heat sink 204 making a pair of two pieces (copper plate) was mounted on each heater so as to nip each heater (see FIGS. 11 and 12).

The heat capacity of the heat sink 204 is 30 (J/K) per pair.

Since a diameter in the lower end of an airing jet port 203 is 130 mm, from the heat sink to the jet port, it is 285 mm in a straight line ((700-130)/2=285). The diameter in the upper end of the airing jet portion 203 is 150 mm. The height (distance in the vertical direction) from the lower end to the upper end of the airing jet portion 203 is 30 mm, and in this space of 30 mm, the diameter of the jet port linearly increases from 130 mm to 150 mm.

Between the adjacent heat sinks, a bar (insulator 202) made of ceramic is nipped, and plays a role of heating insulation between the heat sinks, and at the same time, plays a role of filling up a gap between the heat sinks. The gap is prone to deteriorate uniformity of gas volume in the airing jet port, and prone to deteriorate the unevenness of the long period of the thickness.

As evident from FIG. 10, the interior of the airing is not divided in the peripheral direction.

Further, an air supply port 210 of the airing 200 is connected to an unillustrated blowing means (blower=sirocco fan), and the air delivered through this blowing means is uniformized to the flow of the peripheral direction within the airing 200, and is discharged from the jet port 203 of FIG. 10. Since the airing is not divided in its interior, the air volume in the jet port 203 of the airing is equaled (uniform) at any position. The airing having its interior not divided is advantageous in obtaining the belt having few color shift, that is, a small Z.

Further, the height of a stabilizer 170 is adjusted to such a height that its lower end contacts the tube after the extruded tube is solidified.

When the stabilizer 170 is brought into contact with the tube before solidified, microscopic irregularities of the tube are reduced by the stabilizer, and the unevenness of the short period of the thickness is reduced, while the portion not contacting the stabilizer and the portion contacting the stabilizer end up being different in thickness, thereby deteriorating the unevenness of the long period of the thickness.

The die lip of the annular die is 100 mm in outer diameter and 98.4 mm in inner diameter.

The melted pellet is extruded circularly (tube-shaped) from the die lip, and by introducing the air into the interior of the tube, the tube diameter was dilated to 153 mm in a drawing out process.

The ratio of the outer diameter of the die lip to the diameter of the tube in a solidified state is referred to as a blow ratio, and in this case, the blow ratio becomes 1.53. When the blow ratio is raised to 1.2 or more, the tube is a sufficiently elongated tube even in the peripheral direction, and therefore, the electrophotographic belt excellent in strength in the peripheral direction and having durability can be obtained. When the blow ratio is raised extremely, the tubular film process becomes unsteady, and therefore, the blow ratio is preferable to be 3.5 or less.

The drawing out speed of the tube by a pinch roller 180 is preferably 3 m/min or more and 20 m/min or less, and more preferably 5 m/min or more and 15 m/min or less. In the present Example, it is 9 m/min. When the drawing out speed is too slow, the diameter of the tube becomes unstable, and the tubular film process becomes unstable. When the drawing out speed is too fast, melt fractures are prone to be generated, and the unevenness of the short period of the thickness is prone to easily exceed 20%.

In FIG. 9, reference numeral 100 denotes an one screw extruding machine, reference numeral 110 a hopper, reference numeral 140 a die, reference numeral 150 an air intake and exhaust path for tube diameter adjustment, reference numeral 190 a cutter, and reference character T a tube in a state in which it is folded after being cut by the cutter 190.

First, with 20 pieces of the heaters all kept in an operation off state, the tubular film process was started. An unillustrated blower output connected with the air supply port 210, that is, a flow of the air and a flow speed blown from the airing jet port were adjusted so that the shortest distance between the tube and the airing jet port becomes approx. 5 mm. In the intake port of the blower, the temperature of the air to be absorbed is not controlled. The flow of the air and the flow speed blown from the airing jet port are preferably adjusted so that the shortest distance between the tube and the airing jet port becomes 1 mm or more and 30 mm or less, and preferably 2 mm or more and 20 mm or less. If the distance becomes closer than one millimeter, the tube is prone to contact the jet port, and it becomes difficult to be stably drawn out. If the distance becomes far away than 30 mm, a uneven thickness reduction effect at the operation on time becomes difficult to be exerted. In the present Example, the flow volume and the flow speed of the air blown form the jet port were adjusted so that the shortest distance between the tube and the airing jet port 203 becomes 12 mm. The distance between the tube and the airing jet port 203 is, in FIG. 10, referred to as the shortest distance between the surface making a part of the conical portion formed from the jet port lower end (ϕ30) to the upper end (ϕ150) and the tube surface.

Although the heater off state corresponds to the case where the tube is shaped by using a normal airing, the tube obtained at this time is taken as a tube A.

The positions of 20 heaters and the thickness measuring points of the tube A are allowed to correspond to one another, thereby measuring the thickness of the tube A in the peripheral direction at 20 places. The measurement of the thickness is performed by using a measuring machine as shown in FIG. 13 at three places in the axial direction to avoid the effect of the error of measurement, and the arithmetic average value of three measured values (values corresponding to gauges 1 to 3) was taken as a thickness at the measuring points. The measurement result is shown in Table 3.

As can be seen from Table 3, the thickness of the tube A in the peripheral direction is 96.0 to 104.9 μm, and stays within not more than 100 μm±5%. However, the center of gravity Z was 2.17 μm.

Next, a heater output decision to operate the heater of the airing will be described.

In the measurement data of 20 places previously measured, the thickness of each measuring point—the thickness of the most thin position was found, and that value was multiplied by proportional coefficient (gain), and then, the output of each heater was decided. Here, the gain was taken as 4. A list of the heater outputs is shown in Table 4.

The heater output performs a cycle control to take five seconds as one cycle, that is, a control to turn on the heater for 0.05 seconds within one cycle per the output 1%. In case the cycle control is performed, the period of one cycle is preferably set 30 seconds or less. If it is longer than 30 seconds, the extent of the temperature of the wind changing in association with ON/OFF of the heater is great, and hence, the extent of a change in the thickness ends up becoming also great. Although no lower limit of the period exists in particular, it is practically 0.1 second or more. Naturally, the control method of the input power to the heater is not limited to this, and can be replaced by other control methods such as a position control system and the like.

The heater control is started from the heater OFF state to the heater output state of Table 4, and the tube obtained after five minutes has elapsed since the control started is taken as a tube B. The measurement result of the thickness of the tube B is shown in Table 5.

Further, when a thermocouple of 50 μm in line diameter is held over the airing jet port and the temperature of the wind at 20 places in the peripheral direction was measured, it was 28° C. at a portion where the temperature is the most lowest, and 45° C. at a portion where the temperature is the most highest. That is, the temperature difference of the wind was 17° C.

The tube obtained after five minutes have passed since the heater control started is taken as a tube B. When the thickness of the tube B was measured, as shown in Table 5, the center of gravity Z was improved up to 0.74 μm.

Next, the measuring pitch in the measuring equipment of FIG. 13 was changed to 1 mm, and measured the unevenness of the short period of the thickness of the tube B across a length of 24 mm. Even here, to reduce the effect of the error of measurement, three places were measured in the axial direction and the average value thereof was used. The result is shown in Table 6. The unevenness of the short period of the thickness was 2.8%.

Next, the tube B was cut in the predetermined width, and was mounted with an anti-meandering guide, thereby obtaining the electrophotographic belt of the present invention. The inner peripheral length of the obtained electrophotographic belt of the present invention was 480 mm.

Figure 1:
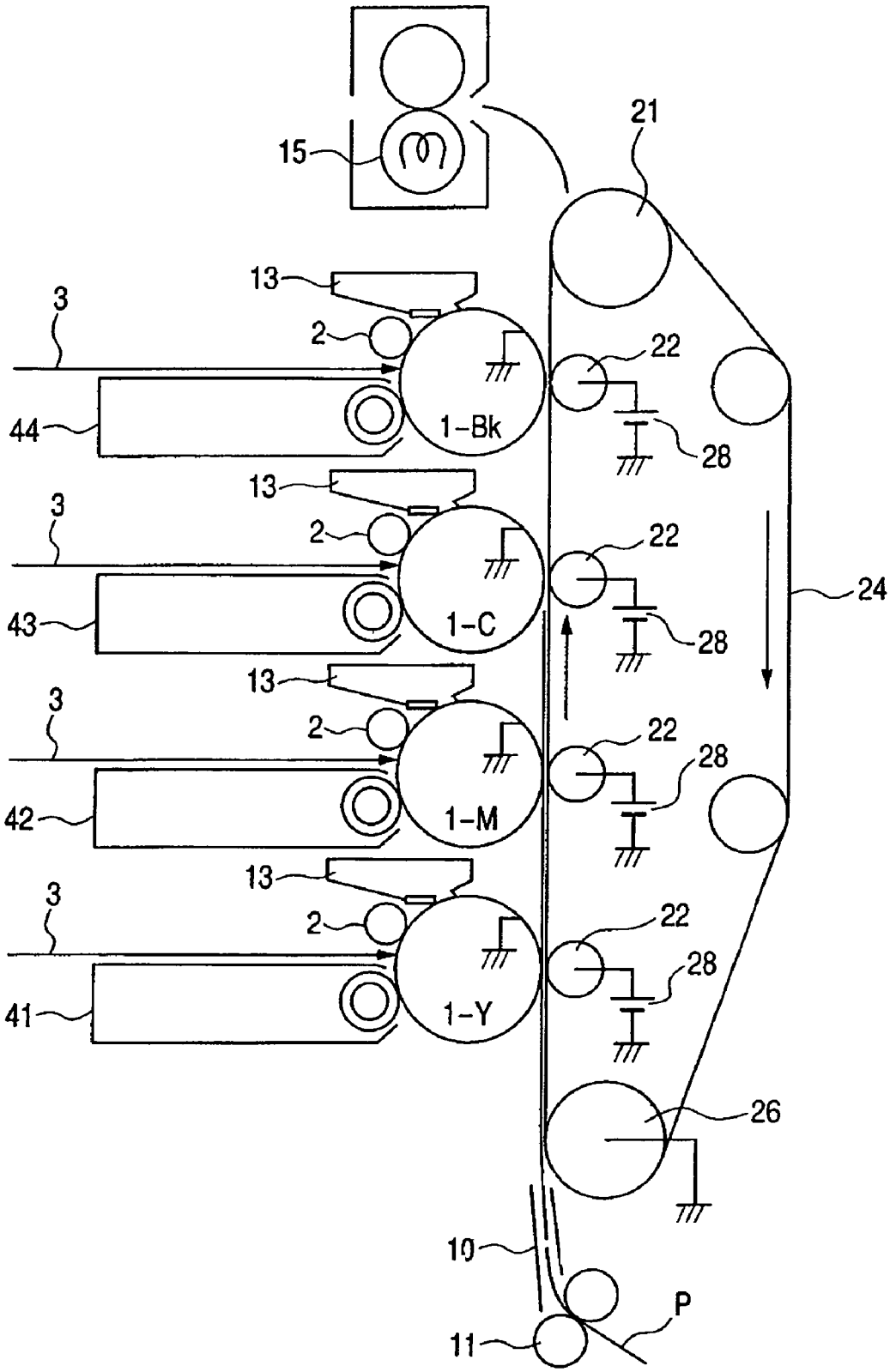
FIG. 1 is a view showing an electrophotographic apparatus having a transfer material conveying belt and plural electrophotographic photosensitive members.

The electrophotographic apparatus (color electrophotographic apparatus) having the constitution of FIG. 1 was fitted with the obtained electrophotographic belt as a transfer material conveying belt 24. The outer diameter of the driving roller 21 is 22 mm, and the surface thereof is provided with a rubber layer of 1 mm in thickness. The winding angle of the transfer material conveying belt 24 to the driving roller 21 was taken as 130°. That is, the winding amount of the transfer material conveying belt 24 to the driving roller 21 is 24.9 mm (22×3.14×130/360=24.9). The ratio of the winding amount of the transfer material conveying belt 24 to the inner peripheral length is 5.2% (24.9/480=0.052).

The rotational shafts of the adjacent drum shaped electrophotographic photosensitive members (hereinafter referred to also as photosensitive member) are mutually 45 mm away in the centers.

In FIG. 1, 1-Y, 1-M, 1-C, and 1-BK are the photosensitive drums, respectively, and are rotationally driven at a predetermined circumferential speed (process speed) in the direction of an arrow mark.

The process of forming a first color component image (for example, yellow color component image) will be described below.

The surface of the photosensitive drum 1-Y, in its rotational process, is charge-processed uniformly to the predetermined polarity and potential by a primary charging device 2, and then, receives an image exposure light 3 by unillustrated image exposure means. In this manner, an electrostatic latent image corresponding to a first color component image (yellow color component image in this example) of a color image is formed.

Next, the electrostatic latent image is developed into the yellow color component image by a first developing device (yellow color developing device 41). In this manner, a toner image of a first color (yellow) is formed on the photosensitive drum 1-Y. At the predetermined timing, the toner images of the second to the fourth colors are formed also on the photosensitive drums 1-M, 1-C, and 1-BK.

On the other hand, the transfer material conveying belt 24 is rotationally driven approximately at the same circumferential speed as the photosensitive drums 1-Y, 1-M, 1-C, and 1-BK in the arrow direction or at the circumferential speed having a predetermined circumferential speed difference (in many cases, the transfer material conveying belt is faster than the photosensitive drum).

Further, at the predetermined timing, a transfer material P is fed to the transfer material conveying belt 24 from a sheet feeding roller 11, and the transfer material P is absorbed by the transfer material conveying belt 24, and accompanied with the rotation of the transfer material conveying belt 24, the transfer material P is conveyed.

In the apparatus shown in FIG. 1, though it is necessary to convey the transfer material P in the upper direction against the gravity, the apparatus does not possess special means of increasing the adsorptive power of the transfer material P to the transfer material conveying belt 24.

Hence, in the apparatus having the constitution shown in FIG. 1, though the adsorption of the transfer material P to the transfer material conveying belt 24 is prone to be unsteady, and the color shift is prone to be generated, the electrophotographic belt of the present invention can be used suitable even for such an electrophotographic apparatus.

When the transfer material P passes through an adsorption transfer nip (portion where each photosensitive drum and a transfer roller 22 confront through the transfer material conveying belt 24) of the transfer material conveying belt 24, a transfer bias is applied to the transfer roller 22 through a bias power supply 28. In this manner, the toner image on the photosensitive drum is transferred on the transfer material P. That is, the toner image is laminated and transferred on the transfer material P in order of the yellow toner image which is the first color component, the magenta toner image which is the second color component, the cyan toner image which is the third color component, and the black toner image which is the fourth color component. The transfer bias at this time, for example, is approximately −3 kV to +3 kV. In the present Example, the transfer bias was taken as +1000 (V) (+1 (kV)).

Cleaning of the transfer material conveying belt 24 is performed by a so-called electrostatic cleaning method, in which the transfer roller 22 is applied with the same polarity bias as the toner on the transfer roller 22 so that the toner on the transfer material conveying belt 24 is returned to the photosensitive drum.

The electrophotographic photosensitive members 1-Y to 1-BK have charge transport layers of 20 μm in thickness, and are subjected to a primary charging and light exposure so that the potential (Vd) before the image exposure becomes −700 (V) and the potential (V1) after the image exposure becomes −150(V).

In FIG. 1, reference numeral 10 denotes a sheet feeding guide, reference numeral 13 a cleaning member for photosensitive drum, reference numeral 15 a fixing device, and reference numeral 26 a stretching roller.

The rotational speed of the transfer material conveying belt 24 was taken as 50 mm/s.

An image output durability test of 10,000 sheets was conducted, and the color shift of the output image was observed and estimated. The result is shown in Table 2. The estimation of the color shift was performed as follows.

(Estimation of Color Shift)

Figure 14:
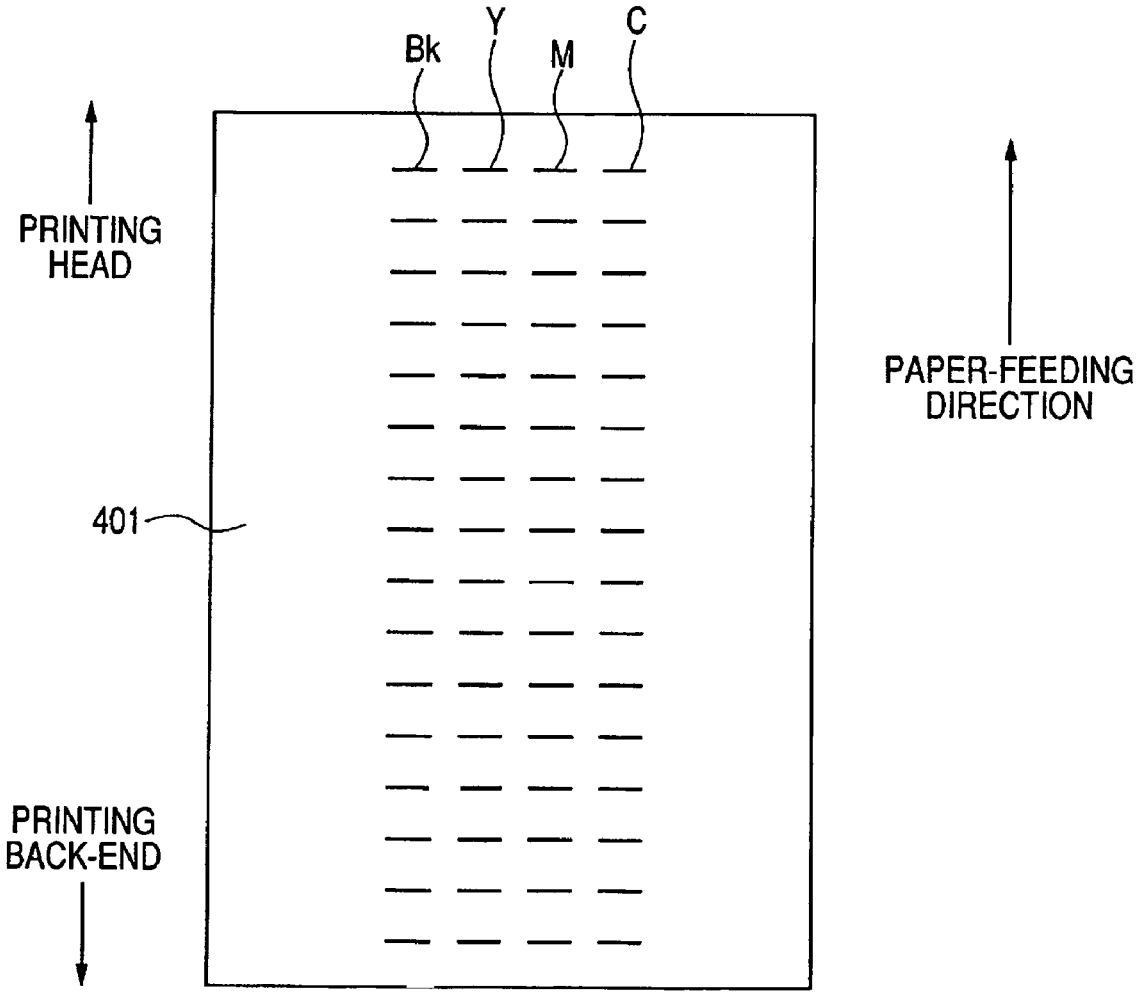
FIG. 14 is an image output pattern for color shift measurement.

An image output pattern for color shift measurement is shown in FIG. 14.

As shown in FIG. 14, in the center portion of a A4 paper 401, horizontal lines of 100 μm in line width (width of a line) and 5 mm in length of four colors (yellow Y, cyan C, magenta M, and black Bk) were lined up horizontally. When taking this horizontal line of four colors as a line, this line was shifted for every 2 mm in the vertical direction of the sheet, thereby drawing a total of 130 lines (approx. 20 mm of the upper and lower both ends of the A4 sheet were made blank, and an image was outputted in the center portion at 258 mm).

In each line of the output pattern for color shift measurement, on the basis of the horizontal line of black, the absolute value was measured as to how much the horizontal lines of other three colors are shifted in the vertical direction. The maximum value of the value measured in each line was taken as a color shift amount (μm) inside the page. An image output environment was taken as 23±2° C. and 50±10% RH.

The color shift amount was shown by the following criteria.

200 μm or less: AA
larger than 200 μm and 220 μm or less: A
larger than 220 μm and 240 μm or less: B
larger than 240 μm and 260 μm or less: C

TABLE 1

| | Thermoplastic resin | | | | | | Inorganic fine particles: Carbon Black | | Inorganic fine particles: Others | | |
|---|---|---|---|---|---|---|---|---|---|---|---|
| | Type | Blending amount (% by mass) | Type | Blending amount (% by mass) | Type | Blending amount (% by mass) | Type | Blending amount (% by mass) | Type | Blending amount (% by mass) | Volume Resistivity (Ωcm) |
| Example 1 | A | 30 | B | 39 | H | 1 | J | 10 | L | 20 | $5 \times 10^{10}$ |
| Example 2 | C | 35 | D | 55 | | | K | 5 | L | 5 | $1 \times 10^{12}$ |
| Example 3 | A | 60 | | | | | J | 15 | L | 25 | $3 \times 10^{8}$ |
| Example 4 | C | 60 | | | | | K | 5 | L | 35 | $5 \times 10^{12}$ |
| Example 5 | A | 10 | B | 76 | H | 4 | K | 6 | N | 4 | $9 \times 10^{11}$ |
| Example 6 | A | 50 | B | 34 | | | K | 14 | M | 2 | $1 \times 10^{9}$ |
| Example 7 | F | 60 | B | 22 | I | 1 | K | 10 | L | 7 | $2 \times 10^{10}$ |
| Example 8 | G | 75 | I | 10 | | | K | 10 | L | 5 | $9 \times 10^{10}$ |
| Example 9 | Same as Example 1 | | | | | | | | | | |
| Example 10 | Same as Example 1 | | | | | | | | | | |
| Example 11 | Same as Example 1 | | | | | | | | | | |
| Example 12 | P | 90 | | | | | J | 7 | L | 3 | $9 \times 10^{11}$ |
| Example 13 | P | 90 | | | | | J | 5 | L | 3 | $3 \times 10^{12}$ |
| | | | | | | | Q | 2 | | | |
| Comparative example 1 | Same as Example 1 | | | | | | | | | | |
| Comparative example 2 | A | 15 | B | 40 | | | J | 11 | L | 34 | $9 \times 10^{9}$ |

A: Polyamide 12 (Grillamid L25 made by MSU Showa Denko k.k.)

B: Polyamide 6-10 (Amilan CM 2006 made by Tokyo Rayon Co., Ltd.)

C: Polyamide 11 (Rilsan BESN-O-TL made by ATFINA JAPAN)

D: Polyamide 6-12 (Daiamid D22 made by Daicel Degussa Ltd.)

E: Polyamide 6 (Amilan CM1021XF made by Toyo Rayon Co., Ltd.)

F: Straight-chain polyphenylene sulfide particles (SA-SUTIRU B060 made by Tosoh Co., Ltd. Specific gravity 1.35; Average particle size 50 μm)

G: Poly cyclohexylene dimethylene terephthalate using terephthalic acid and isophthalic acid as acid components (DURASTER DS2000 made by Eastman Chemical Co., Ltd.)

H: Copolymer with Glycidyl methacrylate and ethylene having epoxy group (Bondfast E made by Sumitomo Chemical Industries. Co., Ltd.)

I: Copolymer with maleic anhydride and ethylene (F3000 made by Ube Industries, Ltd.)

J: Carbon black (DENKA BLACK particles made by Denki Kagaku Kyogo, Ltd.)

K: Carbon Black (Special black 100 made by Degussa Ltd.)

L: Zinc Oxide (one type of Zinc Oxide made by Sakai Chemical Industry Co., Ltd. Average particle size 0.6 μm)

M: Talc (Microace P-3 made by Nippon Talc Co., Ltd. Average Particle size 5.1 μm)

N: Silica by dry process surface-treated with dimethyl silicone oil (AEROSIL RY200 made by Nippon Aerosil Co., Ltd.)

P: PVDF (kaina 720 made by ARUKEMA. Homopolymer of vinylidene fluoride)

Q: Graphite (UF-G10, Average particle size 4 μm made by Showa Denko, K.K.)

TABLE 2

| | Z (μm) | Short period Unevenness of thickness (%) | Color shift Initial period | Color shift 10,000 sheets After durability test | Image density Uniformity |
|---|---|---|---|---|---|
| Example 1 | 0.74 | 2.8 | AA | A | Excellent |
| Example 2 | 0.33 | 2.0 | AA | B | Excellent |
| Example 3 | 1.50 | 20.0 | A | A | Slight unevenness (within practical range) |
| Example 4 | 1.99 | 15.1 | B | B | Excellent |
| Example 5 | 0.51 | 2.3 | AA | B | Excellent |
| Example 6 | 0.49 | 5.0 | AA | AA | Excellent |
| Example 7 | 0.01 | 6.1 | AA | AA | Excellent |
| Example 8 | 0.05 | 4.1 | AA | AA | Excellent |
| Example 9 | 0.20 | 3.5 | AA | AA | Excellent |
| Example 10 | 1.00 | 2.6 | AA | A | Excellent |
| Example 11 | Same as Example 1 | | AA | A | Excellent |
| Example 12 | 0.10 | 2.8 | AA | A | Excellent |
| Example 13 | 0.10 | 3.5 | AA | AA | Excellent |
| Comparative example 1 | 2.17 | 2.7 | C | C | Excellent |
| Comparative example 2 | 0.55 | 24 | A | A | Unevenness from initial period (not within practical range) |

TABLE 3

| n | Measuring point θ | Gauge 1 | Gauge 2 | Gauge 3 | Average value of gauges 1 to 3: $t_n$ | $t_n \times \cos\theta$ | $t_n \times \sin\theta$ |
|---|---|---|---|---|---|---|---|
| 1 | 0° | 100.1 μm | 100.6 μm | 100.5 μm | 100.4 μm | 100.39 μm | 0.00 μm |
| 2 | 18° | 99.8 μm | 99.6 μm | 99.7 μm | 99.7 μm | 94.81 μm | 30.80 μm |
| 3 | 36° | 103.4 μm | 103.4 μm | 103.6 μm | 103.5 μm | 83.72 μm | 60.83 μm |
| 4 | 54° | 104.1 μm | 103.9 μm | 104.2 μm | 104.1 μm | 61.18 μm | 84.21 μm |
| 5 | 72° | 104.5 μm | 104.5 μm | 104.7 μm | 104.6 μm | 32.31 μm | 99.45 μm |
| 6 | 90° | 104.8 μm | 104.9 μm | 105.0 μm | 104.9 μm | 0.00 μm | 104.89 μm |
| 7 | 108° | 104.3 μm | 104.4 μm | 104.4 μm | 104.4 μm | −32.25 μm | 99.25 μm |
| 8 | 126° | 104.0 μm | 103.6 μm | 104.4 μm | 104.0 μm | −61.13 μm | 84.13 μm |
| 9 | 144° | 103.1 μm | 103.5 μm | 103.2 μm | 103.3 μm | −83.54 μm | 60.69 μm |
| 10 | 162° | 101.9 μm | 101.5 μm | 102.3 μm | 101.9 μm | −96.89 μm | 31.48 μm |
| 11 | 180° | 101.6 μm | 101.4 μm | 101.7 μm | 101.6 μm | −101.58 μm | 0.00 μm |
| 12 | 198° | 98.1 μm | 98.5 μm | 98.5 μm | 98.4 μm | −93.56 μm | −30.40 μm |
| 13 | 216° | 97.1 μm | 96.6 μm | 97.6 μm | 97.1 μm | −78.54 μm | −57.07 μm |
| 14 | 234° | 96.8 μm | 97.0 μm | 96.4 μm | 96.8 μm | −56.87 μm | −78.28 μm |
| 15 | 252° | 96.9 μm | 97.3 μm | 96.5 μm | 96.9 μm | −29.94 μm | −92.16 μm |
| 16 | 270° | 96.1 μm | 95.9 μm | 96.1 μm | 96.0 μm | 0.00 μm | −96.04 μm |
| 17 | 288° | 96.3 μm | 96.0 μm | 96.3 μm | 96.2 μm | 29.73 μm | −91.49 μm |
| 18 | 306° | 97.6 μm | 98.1 μm | 97.4 μm | 97.7 μm | 57.42 μm | −79.03 μm |
| 19 | 324° | 97.3 μm | 96.8 μm | 97.3 μm | 97.1 μm | 78.59 μm | −57.10 μm |
| 20 | 342° | 99.5 μm | 99.8 μm | 99.6 μm | 99.6 μm | 94.75 μm | −30.79 μm |
| | | | Total sum | | | −1.41 μm | 43.40 μm |
| | | | Average | | | −0.07 μm | 2.17 μm |
| | | | Z | | | 2.17 μm | |

TABLE 4

| n | Measuring point: θ | Average value of gauges 1 to 3: $t_n$ | Difference with most thin position | Heater output |
|---|---|---|---|---|
| 1 | 0° | 100.4 μm | 4.3 μm | 17% |
| 2 | 18° | 99.7 μm | 3.6 μm | 15% |
| 3 | 36° | 103.5 μm | 7.4 μm | 30% |
| 4 | 54° | 104.1 μm | 8.0 μm | 32% |
| 5 | 72° | 104.6 μm | 8.5 μm | 34% |
| 6 | 90° | 104.9 μm | 8.8 μm | 35% |
| 7 | 108° | 104.4 μm | 8.3 μm | 33% |
| 8 | 126° | 104.0 μm | 7.9 μm | 32% |
| 9 | 144° | 103.3 μm | 7.2 μm | 29% |
| 10 | 162° | 101.9 μm | 5.8 μm | 23% |
| 11 | 180° | 101.6 μm | 5.5 μm | 22% |
| 12 | 198° | 98.4 μm | 2.3 μm | 9% |
| 13 | 216° | 97.1 μm | 1.0 μm | 4% |
| 14 | 234° | 96.8 μm | 0.7 μm | 3% |
| 15 | 252° | 96.9 μm | 0.9 μm | 3% |
| 16 | 270° | 96.0 μm | 0.0 μm | 0% |
| 17 | 288° | 96.2 μm | 0.2 μm | 1% |
| 18 | 306° | 97.7 μm | 1.6 μm | 7% |
| 19 | 324° | 97.1 μm | 1.1 μm | 4% |
| 20 | 342° | 99.6 μm | 3.6 μm | 14% |

TABLE 5

| n | Measuring point θ | Gauge 1 | Gauge 2 | Gauge 3 | Average value of gauges 1 to 3: $t_n$ | $t_n \times \cos\theta$ | $t_n \times \sin\theta$ |
|---|---|---|---|---|---|---|---|
| 1 | 0° | 99.9 μm | 101.1 μm | 100.7 μm | 100.6 μm | 100.56 μm | 0.00 μm |
| 2 | 18° | 100.5 μm | 101.5 μm | 101.7 μm | 101.2 μm | 96.29 μm | 31.29 μm |
| 3 | 36° | 101.0 μm | 101.6 μm | 102.3 μm | 101.6 μm | 82.20 μm | 59.72 μm |
| 4 | 54° | 101.1 μm | 101.8 μm | 102.2 μm | 101.7 μm | 59.80 μm | 82.30 μm |
| 5 | 72° | 102.2 μm | 103.0 μm | 101.0 μm | 102.1 μm | 31.54 μm | 97.08 μm |
| 6 | 90° | 102.8 μm | 101.7 μm | 101.4 μm | 101.9 μm | 0.00 μm | 101.93 μm |
| 7 | 108° | 102.7 μm | 100.4 μm | 101.8 μm | 101.7 μm | −31.41 μm | 96.68 μm |
| 8 | 126° | 102.3 μm | 102.0 μm | 100.5 μm | 101.6 μm | −59.73 μm | 82.20 μm |
| 9 | 144° | 101.9 μm | 100.5 μm | 101.3 μm | 101.2 μm | −81.90 μm | 59.51 μm |
| 10 | 162° | 101.4 μm | 100.0 μm | 101.3 μm | 100.9 μm | −95.96 μm | 31.18 μm |
| 11 | 180° | 101.2 μm | 99.8 μm | 100.7 μm | 100.6 μm | −100.57 μm | 0.00 μm |
| 12 | 198° | 99.3 μm | 99.8 μm | 101.2 μm | 100.1 μm | −95.17 μm | −30.92 μm |
| 13 | 216° | 99.4 μm | 99.8 μm | 99.8 μm | 99.7 μm | −80.65 μm | −58.60 μm |
| 14 | 234° | 98.6 μm | 100.1 μm | 98.9 μm | 99.2 μm | −58.31 μm | −80.26 μm |
| 15 | 252° | 100.0 μm | 98.1 μm | 99.6 μm | 99.2 μm | −30.66 μm | −94.36 μm |
| 16 | 270° | 98.8 μm | 99.0 μm | 99.3 μm | 99.0 μm | 0.00 μm | −99.00 μm |
| 17 | 288° | 98.1 μm | 99.3 μm | 100.0 μm | 99.1 μm | 30.64 μm | −94.29 μm |
| 18 | 306° | 99.7 μm | 99.7 μm | 98.5 μm | 99.3 μm | 58.35 μm | −80.31 μm |
| 19 | 324° | 98.8 μm | 100.5 μm | 99.1 μm | 99.5 μm | 80.47 μm | −58.46 μm |
| 20 | 342° | 100.2 μm | 99.7 μm | 100.1 μm | 100.0 μm | 95.09 μm | −30.90 μm |
| | | | Total sum | | | 0.57 μm | 14.78 μm |
| | | | Average | | | 0.03 μm | 0.74 μm |
| | | | Z | | | 0.74 μm | |

TABLE 6

| Position in peripheral direction | Gauge 1 | Gauge 2 | Gauge 3 | Average value of gauges 1 to 3: $t_n$ |
|---|---|---|---|---|
| 0 mm | 101.0 μm | 101.0 μm | 100.0 μm | 100.7 μm |
| 1 mm | 101.2 μm | 102.2 μm | 102.1 μm | 101.8 μm |
| 2 mm | 100.5 μm | 100.2 μm | 99.6 μm | 100.1 μm |
| 3 mm | 100.0 μm | 100.9 μm | 99.1 μm | 100.0 μm |
| 4 mm | 101.1 μm | 101.3 μm | 100.3 μm | 100.9 μm |
| 5 mm | 100.8 μm | 101.3 μm | 100.6 μm | 100.9 μm |
| 6 mm | 100.5 μm | 100.8 μm | 101.1 μm | 100.8 μm |
| 7 mm | 100.2 μm | 101.0 μm | 101.0 μm | 100.8 μm |
| 8 mm | 100.8 μm | 100.5 μm | 101.8 μm | 101.0 μm |
| 9 mm | 100.7 μm | 101.4 μm | 100.2 μm | 100.8 μm |
| 10 mm | 100.1 μm | 100.8 μm | 99.1 μm | 100.0 μm |
| 11 mm | 99.4 μm | 98.8 μm | 98.7 μm | 99.0 μm |
| 12 mm | 99.6 μm | 98.9 μm | 100.3 μm | 99.6 μm |
| 13 mm | 100.6 μm | 100.1 μm | 100.9 μm | 100.6 μm |
| 14 mm | 99.9 μm | 99.2 μm | 99.3 μm | 99.5 μm |
| 15 mm | 100.7 μm | 101.5 μm | 101.2 μm | 101.1 μm |
| 16 mm | 101.0 μm | 101.6 μm | 101.1 μm | 101.2 μm |
| 17 mm | 99.7 μm | 99.2 μm | 99.5 μm | 99.5 μm |
| 18 mm | 100.7 μm | 99.7 μm | 100.3 μm | 100.2 μm |
| 19 mm | 100.5 μm | 100.7 μm | 101.0 μm | 100.7 μm |
| 20 mm | 99.9 μm | 100.2 μm | 100.2 μm | 100.1 μm |
| 21 mm | 99.9 μm | 100.7 μm | 100.4 μm | 100.3 μm |
| 22 mm | 101.3 μm | 101.7 μm | 100.6 μm | 101.2 μm |
| 23 mm | 100.2 μm | 101.0 μm | 99.5 μm | 100.3 μm |
| 24 mm | 100.1 μm | 101.0 μm | 99.2 μm | 100.1 μm |
| Maximum value of $t_n$ | | | | 101.8 μm |
| Minimum value of $t_n$ | | | | 99.0 μm |
| Average value of $t_n$ | | | | 100.4 μm |
| (Maximum value − Minimum value)/average value | | | | 2.8% |

Example 2

The blending was changed as shown in Table 1, and the tube was prepared by tubular film process similarly to Example 1.

In order that the shortest distance between the tube and the airing jet port becomes 8 mm, the output (gas volume) of the blower was decided, and based on the thickness data in a heater off state, the output of the heater was decided, and the control of the heater was started. At the point of time when five minutes has passed after the control started, in the airing jet port, similarly to Example 1, when the temperature of the wind was measured. The lowest temperature was 28° C., and the highest temperature was 50° C., and the temperature difference was 22° C. By using the tube in which five minutes has passed since the heater control started, the electrophotographic belt (transfer material conveying belt) was prepared in the same manner as Example 1, and the estimation was made in the same manner as Example 1. The measurement result of the thickness is shown in Table 7 and Table 8, and the estimation result of the color shift is shown in Table 2.

Since the center of gravity Z is small as 0.33 μm, the initial color shift has been small. However, since the unevenness of the thickness of the short period was 2.0% and small, despite of the fact that the color shift stayed in the practical range after durability test of 10,000 sheets, it has become deteriorated comparing with the initial color shift. The reason why the unevenness of the short period of the thickness has become small is believed to come from the fact that the volume of the inorganic fine particles was 10 percent by mass and was few.

TABLE 7

| n | Measuring point θ | Gauge 1 | Gauge 2 | Gauge 3 | Average value of gauges 1 to 3: $t_n$ | $t_n \times \cos\theta$ | $t_n \times \sin\theta$ |
|---|---|---|---|---|---|---|---|
| 1 | 0° | 100.0 μm | 100.4 μm | 100.4 μm | 100.3 μm | 100.28 μm | 0.00 μm |
| 2 | 18° | 99.5 μm | 100.1 μm | 99.7 μm | 99.8 μm | 94.89 μm | 30.83 μm |
| 3 | 36° | 96.9 μm | 97.5 μm | 97.1 μm | 97.2 μm | 78.62 μm | 57.12 μm |
| 4 | 54° | 99.1 μm | 99.2 μm | 99.2 μm | 99.2 μm | 58.30 μm | 80.24 μm |
| 5 | 72° | 98.7 μm | 98.9 μm | 99.0 μm | 98.9 μm | 30.55 μm | 94.03 μm |
| 6 | 90° | 100.1 μm | 100.7 μm | 100.4 μm | 100.4 μm | 0.00 μm | 100.40 μm |
| 7 | 108° | 101.2 μm | 101.2 μm | 101.7 μm | 101.4 μm | −31.33 μm | 96.41 μm |
| 8 | 126° | 98.7 μm | 99.0 μm | 99.2 μm | 99.0 μm | −58.16 μm | 80.05 μm |
| 9 | 144° | 98.6 μm | 99.1 μm | 98.8 μm | 98.8 μm | −79.97 μm | 58.10 μm |
| 10 | 162° | 100.5 μm | 100.7 μm | 101.1 μm | 100.8 μm | −95.82 μm | 31.13 μm |
| 11 | 180° | 102.5 μm | 102.6 μm | 103.0 μm | 102.7 μm | −102.71 μm | 0.00 μm |
| 12 | 198° | 101.5 μm | 102.1 μm | 101.6 μm | 101.8 μm | −96.78 μm | −31.45 μm |
| 13 | 216° | 100.3 μm | 100.6 μm | 100.8 μm | 100.6 μm | −81.35 μm | −59.10 μm |
| 14 | 234° | 99.5 μm | 100.2 μm | 100.0 μm | 99.9 μm | −58.71 μm | −80.81 μm |
| 15 | 252° | 99.6 μm | 99.7 μm | 100.0 μm | 99.7 μm | −30.82 μm | −94.86 μm |
| 16 | 270° | 98.7 μm | 99.3 μm | 99.1 μm | 99.0 μm | 0.00 μm | −99.04 μm |
| 17 | 288° | 99.4 μm | 99.7 μm | 100.0 μm | 99.7 μm | 30.81 μm | −94.82 μm |
| 18 | 306° | 100.2 μm | 100.3 μm | 100.5 μm | 100.3 μm | 58.97 μm | −81.17 μm |
| 19 | 324° | 100.6 μm | 100.6 μm | 101.0 μm | 100.7 μm | 81.49 μm | −59.21 μm |
| 20 | 342° | 100.7 μm | 101.0 μm | 100.9 μm | 100.9 μm | 95.94 μm | −31.17 μm |
| | | | Total sum | | | −5.80 μm | −3.30 μm |
| | | | Average | | | −0.29 μm | −0.17 μm |
| | | | Z | | | 0.33 μm | |

TABLE 8

| Position in peripheral direction | Gauge 1 | Gauge 2 | Gauge 3 | Average value of gauges 1 to 3: $t_n$ |
|---|---|---|---|---|
| 0 mm | 100.0 μm | 100.0 μm | 100.0 μm | 100.0 μm |
| 1 mm | 100.1 μm | 100.1 μm | 100.2 μm | 100.1 μm |
| 2 mm | 100.2 μm | 100.1 μm | 100.2 μm | 100.2 μm |
| 3 mm | 100.2 μm | 100.3 μm | 100.2 μm | 100.2 μm |
| 4 mm | 100.2 μm | 100.2 μm | 100.5 μm | 100.3 μm |
| 5 mm | 100.3 μm | 100.3 μm | 100.2 μm | 100.3 μm |
| 6 mm | 100.5 μm | 100.5 μm | 100.7 μm | 100.5 μm |
| 7 mm | 100.6 μm | 100.8 μm | 100.4 μm | 100.6 μm |
| 8 mm | 100.6 μm | 100.6 μm | 100.8 μm | 100.6 μm |
| 9 mm | 100.6 μm | 100.9 μm | 100.8 μm | 100.7 μm |
| 10 mm | 100.7 μm | 101.0 μm | 101.0 μm | 100.9 μm |
| 11 mm | 100.7 μm | 101.0 μm | 101.0 μm | 100.9 μm |
| 12 mm | 100.8 μm | 101.3 μm | 100.9 μm | 101.0 μm |
| 13 mm | 101.0 μm | 101.1 μm | 101.1 μm | 101.1 μm |
| 14 mm | 101.1 μm | 101.2 μm | 101.2 μm | 101.2 μm |
| 15 mm | 101.0 μm | 101.4 μm | 101.4 μm | 101.3 μm |
| 16 mm | 101.0 μm | 101.6 μm | 101.6 μm | 101.4 μm |
| 17 mm | 101.1 μm | 101.6 μm | 101.6 μm | 101.4 μm |
| 18 mm | 101.4 μm | 101.5 μm | 101.5 μm | 101.5 μm |
| 19 mm | 101.4 μm | 101.7 μm | 101.8 μm | 101.6 μm |
| 20 mm | 101.6 μm | 101.9 μm | 101.8 μm | 101.8 μm |
| 21 mm | 101.4 μm | 101.9 μm | 102.1 μm | 101.8 μm |
| 22 mm | 101.6 μm | 102.1 μm | 102.0 μm | 101.9 μm |
| 23 mm | 101.6 μm | 102.3 μm | 102.2 μm | 102.0 μm |
| 24 mm | 101.8 μm | 102.2 μm | 102.2 μm | 102.1 μm |
| Maximum value of $t_n$ | | | | 102.1 μm |
| Minimum value of $t_n$ | | | | 100.0 μm |
| Average value of $t_n$ | | | | 101.0 μm |
| (Maximum value − Minimum value)/average value | | | | 2.0% |

Example 3

The blending was changed as shown in Table 1, and the tube was prepared by tubular film process similarly to Example 1.

In order that the shortest distance between the tube and the airing jet port becomes 15 mm, the output (gas volume) of the blower was decided, and based on the thickness data in a heater off state, the output of the heat was decided, and the control of the heater was started. At the point of time when five minutes has passed after the control started, in the airing jet port, similarly to Example 1, when the temperature of the wind was measured. The lowest temperature was 27° C., and the highest temperature was 32° C., and the temperature difference was 5° C. By using the tube in which five minutes has passed since the heater control started, the electrophotographic belt (transfer material conveying belt) was prepared in the same manner as Example 1, and the estimation was made in the same manner as Example 1. The measurement result of the thickness is shown in Table 9 and Table 10, and the estimation result of the color shift is shown in Table 2.

The unevenness of the short period of the thickness was large as 20.0%. This is believed to come from the fact that the volume of the inorganic fine particles was 40 percent by mass and was great. The value of the center of gravity Z was 1.50 μm. Hence, the color shift was few at the initial period and after 10,000 sheets durability test.

| n | Measuring point θ | Gauge 1 | Gauge 2 | Gauge 3 | Average value of gauges 1 to 3: $t_n$ | $t_n \times \cos\theta$ | $t_n \times \sin\theta$ |
|---|---|---|---|---|---|---|---|
| 1 | 0° | 104.1 μm | 105.1 μm | 104.8 μm | 104.7 μm | 104.65 μm | 0.00 μm |
| 2 | 18° | 103.5 μm | 103.5 μm | 104.3 μm | 103.8 μm | 98.71 μm | 32.07 μm |
| 3 | 36° | 102.1 μm | 103.3 μm | 100.7 μm | 102.0 μm | 82.55 μm | 59.98 μm |
| 4 | 54° | 97.2 μm | 98.2 μm | 97.0 μm | 97.5 μm | 57.29 μm | 78.85 μm |
| 5 | 72° | 102.5 μm | 101.4 μm | 101.6 μm | 101.8 μm | 31.47 μm | 96.85 μm |
| 6 | 90° | 107.6 μm | 108.9 μm | 106.7 μm | 107.7 μm | 0.00 μm | 107.73 μm |
| 7 | 108° | 100.9 μm | 99.8 μm | 101.3 μm | 100.7 μm | −31.11 μm | 95.74 μm |
| 8 | 126° | 96.1 μm | 96.5 μm | 96.7 μm | 96.5 μm | −56.69 μm | 78.03 μm |
| 9 | 144° | 104.1 μm | 103.9 μm | 103.3 μm | 103.8 μm | −83.97 μm | 61.01 μm |
| 10 | 162° | 98.6 μm | 99.1 μm | 97.4 μm | 98.4 μm | −93.55 μm | 30.40 μm |
| 11 | 180° | 94.1 μm | 95.0 μm | 94.7 μm | 94.6 μm | −94.59 μm | 0.00 μm |
| 12 | 198° | 100.5 μm | 100.2 μm | 99.4 μm | 100.0 μm | −95.12 μm | −30.91 μm |
| 13 | 216° | 94.3 μm | 93.8 μm | 94.9 μm | 94.3 μm | −76.31 μm | −55.44 μm |
| 14 | 234° | 99.1 μm | 97.9 μm | 99.2 μm | 98.7 μm | −58.03 μm | −79.87 μm |
| 15 | 252° | 101.5 μm | 100.2 μm | 100.1 μm | 100.6 μm | −31.08 μm | −95.66 μm |
| 16 | 270° | 94.8 μm | 95.5 μm | 93.7 μm | 94.7 μm | 0.00 μm | −94.69 μm |
| 17 | 288° | 100.5 μm | 99.5 μm | 100.0 μm | 100.0 μm | 30.91 μm | −95.12 μm |
| 18 | 306° | 93.8 μm | 92.7 μm | 92.8 μm | 93.1 μm | 54.72 μm | −75.32 μm |
| 19 | 324° | 98.5 μm | 100.0 μm | 97.3 μm | 98.6 μm | 79.76 μm | −57.95 μm |
| 20 | 342° | 104.3 μm | 104.2 μm | 103.8 μm | 104.1 μm | 99.01 μm | −32.17 μm |
| | | | Total sum | | | 18.62 μm | 23.53 μm |
| | | | Average | | | 0.93 μm | 1.18 μm |
| | | | Z | | | 1.50 μm | |

TABLE 10

| Position in peripheral direction | Gauge 1 | Gauge 2 | Gauge 3 | Average value of gauges 1 to 3: $t_n$ |
|---|---|---|---|---|
| 0 mm | 95.7 μm | 96.0 μm | 97.3 μm | 96.3 μm |
| 1 mm | 106.2 μm | 104.8 μm | 105.0 μm | 105.3 μm |
| 2 mm | 107.4 μm | 108.5 μm | 107.1 μm | 107.7 μm |
| 3 mm | 104.8 μm | 106.7 μm | 106.2 μm | 105.9 μm |
| 4 mm | 105.9 μm | 106.2 μm | 104.6 μm | 105.5 μm |
| 5 mm | 98.5 μm | 99.7 μm | 98.8 μm | 99.0 μm |
| 6 mm | 99.8 μm | 100.3 μm | 100.6 μm | 100.2 μm |
| 7 mm | 109.7 μm | 109.7 μm | 109.5 μm | 109.6 μm |
| 8 mm | 102.5 μm | 102.4 μm | 100.7 μm | 101.9 μm |
| 9 mm | 98.7 μm | 97.1 μm | 99.0 μm | 98.3 μm |
| 10 mm | 101.9 μm | 101.6 μm | 100.7 μm | 101.4 μm |
| 11 mm | 96.4 μm | 98.3 μm | 97.4 μm | 97.4 μm |
| 12 mm | 99.0 μm | 100.1 μm | 98.0 μm | 99.0 μm |
| 13 mm | 104.3 μm | 105.5 μm | 104.6 μm | 104.8 μm |
| 14 mm | 96.0 μm | 97.1 μm | 97.1 μm | 96.8 μm |
| 15 mm | 96.5 μm | 97.5 μm | 97.7 μm | 97.2 μm |
| 16 mm | 95.9 μm | 95.1 μm | 96.7 μm | 95.9 μm |
| 17 mm | 90.1 μm | 88.6 μm | 89.9 μm | 89.5 μm |
| 18 mm | 101.3 μm | 101.4 μm | 101.4 μm | 101.4 μm |
| 19 mm | 90.4 μm | 91.5 μm | 92.4 μm | 91.4 μm |
| 20 mm | 97.9 μm | 96.6 μm | 96.6 μm | 97.0 μm |
| 21 mm | 99.3 μm | 101.3 μm | 98.1 μm | 99.6 μm |
| 22 mm | 101.4 μm | 100.1 μm | 102.0 μm | 101.2 μm |
| 23 mm | 104.6 μm | 103.6 μm | 104.5 μm | 104.2 μm |
| 24 mm | 106.5 μm | 107.3 μm | 107.0 μm | 107.0 μm |
| | Maximum value of $t_n$ | | | 109.6 μm |
| | Minimum value of $t_n$ | | | 89.5 μm |
| | Average value of $t_n$ | | | 100.5 μm |
| | (Maximum value − Minimum value)/average value | | | 20.0% |

Example 4

The blending was changed as shown in Table 1, and the tube was prepared by tubular film process similarly to Example 1.

In order that the shortest distance between the tube and the airing jet port becomes 1 mm, the output (gas volume) of the blower was decided, and based on the thickness data in a heater off state, the output of the heat was decided, and the control of the heater was started. At the point of time when five minutes has passed after the control started, in the airing jet port, similarly to Example 1, when the temperature of the wind was measured. The lowest temperature was 30° C., and the highest temperature was 96° C., and the temperature difference was 66° C. By using the tube in which five minutes has passed since the heater control started, the electrophotographic belt (transfer material conveying belt) was prepared in the same manner as Example 1, and the estimation was made in the same manner as Example 1. The measurement result of the thickness is shown in Table 11 and Table 12, and the estimation result of the color shift is shown in Table 2.

The value of the center of gravity Z was 1.99 μm. Although the color shift of the initial period was slightly larger than other Examples, it was in the practical range. Since the unevenness of the short period of the thickness was large as 15.1%, the color shift has not deteriorated after 10,000 durability test. The reason why the unevenness of the short period of the thickness has become large is believed to come from the fact that the volume of the inorganic fine particles was 40 percent by mass and was great.

TABLE 11

| n | Measuring point θ | Gauge 1 | Gauge 2 | Gauge 3 | Average value of gauges 1 to 3: $t_n$ | $t_n \times \cos\theta$ | $t_n \times \sin\theta$ |
|---|---|---|---|---|---|---|---|
| 1 | 0° | 95.8 μm | 96.7 μm | 96.7 μm | 96.4 μm | 96.39 μm | 0.00 μm |
| 2 | 18° | 95.2 μm | 95.5 μm | 96.0 μm | 95.6 μm | 90.89 μm | 29.53 μm |
| 3 | 36° | 99.4 μm | 100.5 μm | 99.5 μm | 99.8 μm | 80.75 μm | 58.66 μm |
| 4 | 54° | 95.4 μm | 95.9 μm | 96.5 μm | 95.9 μm | 56.38 μm | 77.60 μm |
| 5 | 72° | 100.3 μm | 101.1 μm | 100.6 μm | 100.7 μm | 31.10 μm | 95.72 μm |
| 6 | 90° | 98.7 μm | 99.1 μm | 99.7 μm | 99.2 μm | 0.00 μm | 99.20 μm |

TABLE 11-continued

| n | Measuring point θ | Gauge 1 | Gauge 2 | Gauge 3 | Average value of gauges 1 to 3: $t_n$ | $t_n \times \cos\theta$ | $t_n \times \sin\theta$ |
|---|---|---|---|---|---|---|---|
| 7 | 108° | 104.1 μm | 104.5 μm | 106.4 μm | 105.0 μm | −32.45 μm | 99.86μm |
| 8 | 126° | 102.5 μm | 104.8 μm | 104.8 μm | 104.0 μm | −61.15 μm | 84.16 μm |
| 9 | 144° | 105.1 μm | 107.4 μm | 106.1 μm | 106.2 μm | −85.92 μm | 62.43 μm |
| 10 | 162° | 103.6 μm | 103.8 μm | 104.6 μm | 104.0 μm | −98.89 μm | 32.13 μm |
| 11 | 180° | 101.6 μm | 103.6 μm | 102.8 μm | 102.7 μm | −102.67 μm | 0.00 μm |
| 12 | 198° | 104.1 μm | 104.3 μm | 104.3 μm | 104.2 μm | −99.12 μm | −32.21 μm |
| 13 | 216° | 105.3 μm | 107.2 μm | 107.8 μm | 106.8 μm | −86.37 μm | −62.75 μm |
| 14 | 234° | 103.1 μm | 104.5 μm | 103.6 μm | 103.7 μm | −60.98 μm | −83.93 μm |
| 15 | 252° | 104.6 μm | 105.6 μm | 106.1 μm | 105.4 μm | −32.58 μm | −100.27 μm |
| 16 | 270° | 97.6 μm | 98.9 μm | 97.8 μm | 98.1 μm | 0.00 μm | −98.08 μm |
| 17 | 288° | 102.6 μm | 104.8 μm | 103.4 μm | 103.6 μm | 32.01 μm | −98.52 μm |
| 18 | 306° | 95.8 μm | 96.5 μm | 96.4 μm | 96.2 μm | 56.55 μm | −77.84 μm |
| 19 | 324° | 98.7 μm | 100.7 μm | 100.1 μm | 99.8 μm | 80.75 μm | −58.67 μm |
| 20 | 342° | 99.8 μm | 100.1 μm | 100.8 μm | 100.2 μm | 95.32 μm | −30.97 μm |
| | | | Total sum | | | −39.99 μm | −3.93 μm |
| | | | Average | | | −2.00 μm | −0.20 μm |
| | | | Z | | | 2.01μm | |

TABLE 12

| Position in peripheral direction | Gauge 1 | Gauge 2 | Gauge 3 | Average value of gauges 1 to 3: $t_n$ |
|---|---|---|---|---|
| 0 mm | 101.9 μm | 101.2 μm | 102.2 μm | 101.8 μm |
| 1 mm | 106.7 μm | 106.3 μm | 106.6 μm | 106.6 μm |
| 2 mm | 93.8 μm | 94.3 μm | 93.5 μm | 93.8 μm |
| 3 mm | 102.1 μm | 101.4 μm | 101.5 μm | 101.7 μm |
| 4 mm | 98.0 μm | 97.9 μm | 97.9 μm | 97.9 μm |
| 5 mm | 95.8 μm | 96.4 μm | 96.4 μm | 96.2 μm |
| 6 mm | 103.2 μm | 103.1 μm | 102.6 μm | 102.9 μm |
| 7 mm | 97.7 μm | 98.0 μm | 98.4 μm | 98.0 μm |
| 8 mm | 102.8 μm | 102.3 μm | 103.2 μm | 102.8 μm |
| 9 mm | 95.2 μm | 95.1 μm | 94.9 μm | 95.1 μm |
| 10 mm | 104.7 μm | 105.1 μm | 105.1 μm | 105.0 μm |
| 11 mm | 105.9 μm | 106.6 μm | 105.2 μm | 105.9 μm |
| 12 mm | 94.2 μm | 93.8 μm | 94.9 μm | 94.3 μm |
| 13 mm | 97.5 μm | 97.2 μm | 97.4 μm | 97.4 μm |
| 14 mm | 99.6 μm | 99.4 μm | 98.9 μm | 99.3 μm |
| 15 mm | 107.7 μm | 107.7 μm | 107.7 μm | 107.7 μm |
| 16 mm | 100.1 μm | 99.6 μm | 100.0 μm | 99.9 μm |
| 17 mm | 92.6 μm | 92.2 μm | 93.1 μm | 92.6 μm |
| 18 mm | 93.0 μm | 93.1 μm | 93.5 μm | 93.2 μm |
| 19 mm | 103.1 μm | 103.8 μm | 102.9 μm | 103.3 μm |
| 20 mm | 105.2 μm | 104.9 μm | 105.2 μm | 105.1 μm |
| 21 mm | 97.3 μm | 98.0 μm | 97.1 μm | 97.5 μm |
| 22 mm | 100.7 μm | 100.8 μm | 100.8 μm | 100.8 μm |
| 23 mm | 103.2 μm | 103.1 μm | 103.6 μm | 103.3 μm |
| 24 mm | 94.1 μm | 93.5 μm | 93.4 μm | 93.7 μm |
| | Maximum value of $t_n$ | | | 107.7 μm |
| | Minimum value of $t_n$ | | | 92.6 μm |
| | Average value of $t_n$ | | | 99.8 μm |
| | (Maximum value − Minimum value)/average value | | | 15.1% |

Example 5

The blending was changed as shown in Table 1, and the tube was prepared by tubular film process similarly to Example 1.

In order that the shortest distance between the tube and the airing jet port becomes 2 mm, the output (gas volume) of the blower was decided, and based on the thickness data in a heater off state, the output of the heat was decided, and the control of the heater was started. At the point of time when five minutes has passed after the control started, in the airing jet port, similarly to Example 1, when the temperature of the wind was measured. The lowest temperature was 26° C., and the highest temperature was 56° C., and the temperature difference was 30° C. By using the tube in which five minutes has passed since the heater control started, the electrophotographic belt (transfer material conveying belt) was prepared in the same manner as Example 1, and the estimation was made in the same manner as Example 1. The measurement result of the thickness is shown in Table 13 and Table 14, and the estimation result of the color shift is shown in Table 2.

The value of the center of gravity Z was 0.51 Although the color shift of the initial period was small, since the unevenness of the short period of the thickness was small as 2.3%, the color shift after durability test has become slightly deteriorated. However, it is in the practical range even after 10,000 sheets durability test.

TABLE 13

| n | Measuring point θ | Gauge 1 | Gauge 2 | Gauge 3 | Average value of gauges 1 to 3: $t_n$ | $t_n \times \cos\theta$ | $t_n \times \sin\theta$ |
|---|---|---|---|---|---|---|---|
| 1 | 0° | 100.0 μm | 100.3 μm | 100.1 μm | 100.1 μm | 100.13 μm | 0.00 μm |
| 2 | 18° | 99.5 μm | 100.0 μm | 100.2 μm | 99.9 μm | 94.99 μm | 30.86 μm |
| 3 | 36° | 96.9 μm | 97.5 μm | 97.4 μm | 97.3 μm | 78.68 μm | 57.16 μm |
| 4 | 54° | 97.6 μm | 98.0 μm | 98.0 μm | 97.9 μm | 57.53 μm | 79.18 μm |
| 5 | 72° | 98.7 μm | 98.8 μm | 98.8 μm | 98.8 μm | 30.52 μm | 93.92 μm |
| 6 | 90° | 100.1 μm | 100.5 μm | 100.7 μm | 100.5 μm | 0.00 μm | 100.45 μm |
| 7 | 108° | 99.7 μm | 99.8 μm | 99.9 μm | 99.8 μm | −30.84 μm | 94.92 μm |
| 8 | 126° | 98.7 μm | 99.3 μm | 99.2 μm | 99.1 μm | −58.23 μm | 80.14 μm |
| 9 | 144° | 98.6 μm | 99.3 μm | 98.9 μm | 98.9 μm | −80.03 μm | 58.15 μm |
| 10 | 162° | 100.5 μm | 101.1 μm | 100.6 μm | 100.7 μm | −95.79 μm | 31.12 μm |
| 11 | 180° | 102.5 μm | 102.8 μm | 102.6 μm | 102.6 μm | −102.64 μm | 0.00 μm |
| 12 | 198° | 102.1 μm | 102.7 μm | 102.7 μm | 102.5 μm | −97.47 μm | −31.67 μm |

TABLE 13-continued

| n | Measuring point θ | Gauge 1 | Gauge 2 | Gauge 3 | Average value of gauges 1 to 3: $t_n$ | $t_n \times \cos\theta$ | $t_n \times \sin\theta$ |
|---|---|---|---|---|---|---|---|
| 13 | 216° | 101.9 μm | 102.1 μm | 101.9 μm | 102.0 μm | −82.49 μm | −59.94 μm |
| 14 | 234° | 99.3 μm | 99.5 μm | 99.6 μm | 99.5 μm | −58.46 μm | −80.46 μm |
| 15 | 252° | 99.6 μm | 99.8 μm | 100.0 μm | 99.8 μm | −30.84 μm | −94.92 μm |
| 16 | 270° | 98.7 μm | 98.8 μm | 99.3 μm | 98.9 μm | 0.00 μm | −98.93 μm |
| 17 | 288° | 100.5 μm | 100.6 μm | 101.0 μm | 100.7 μm | 31.12 μm | −95.77 μm |
| 18 | 306° | 101.2 μm | 101.3 μm | 101.3 μm | 101.3 μm | 59.53 μm | −81.93 μm |
| 19 | 324° | 99.8 μm | 99.9 μm | 100.5 μm | 100.0 μm | 80.93 μm | −58.80 μm |
| 20 | 342° | 102.1 μm | 102.8 μm | 102.3 μm | 102.4 μm | 97.37 μm | −31.64 μm |
| | | | Total sum | | | −6.00 μm | −8.15 μm |
| | | | Average | | | −0.30 μm | −0.41 μm |
| | | | Z | | | 0.51μm | |

TABLE 14

| Position in peripheral direction | Gauge 1 | Gauge 2 | Gauge 3 | Average value of gauges 1 to 3: $t_n$ |
|---|---|---|---|---|
| 0 mm | 98.8 μm | 98.6 μm | 98.9 μm | 98.8 μm |
| 1 mm | 98.8 μm | 99.2 μm | 99.2 μm | 99.1 μm |
| 2 mm | 98.3 μm | 98.5 μm | 98.4 μm | 98.4 μm |
| 3 mm | 99.0 μm | 98.7 μm | 99.0 μm | 98.9 μm |
| 4 mm | 98.9 μm | 98.7 μm | 98.7 μm | 98.8 μm |
| 5 mm | 98.6 μm | 98.4 μm | 99.0 μm | 98.7 μm |
| 6 mm | 99.2 μm | 99.1 μm | 99.5 μm | 99.3 μm |
| 7 mm | 99.2 μm | 99.4 μm | 98.9 μm | 99.2 μm |
| 8 mm | 99.7 μm | 99.8 μm | 99.8 μm | 99.8 μm |
| 9 mm | 99.3 μm | 99.1 μm | 99.2 μm | 99.2 μm |
| 10 mm | 99.0 μm | 99.0 μm | 99.1 μm | 99.0 μm |
| 11 mm | 99.5 μm | 99.1 μm | 99.1 μm | 99.2 μm |
| 12 mm | 100.0 μm | 100.1 μm | 100.1 μm | 100.1 μm |
| 13 mm | 100.1 μm | 100.3 μm | 99.9 μm | 100.1 μm |
| 14 mm | 99.9 μm | 99.7 μm | 100.3 μm | 99.9 μm |
| 15 mm | 100.0 μm | 99.8 μm | 99.9 μm | 99.9 μm |
| 16 mm | 99.5 μm | 99.4 μm | 99.8 μm | 99.6 μm |
| 17 mm | 99.9 μm | 100.0 μm | 100.0 μm | 100.0 μm |
| 18 mm | 99.9 μm | 99.5 μm | 99.6 μm | 99.7 μm |
| 19 mm | 100.4 μm | 100.1 μm | 100.2 μm | 100.2 μm |
| 20 mm | 100.3 μm | 100.6 μm | 100.6 μm | 100.5 μm |
| 21 mm | 100.3 μm | 99.9 μm | 100.3 μm | 100.2 μm |
| 22 mm | 99.9 μm | 100.1 μm | 100.2 μm | 100.0 μm |
| 23 mm | 100.6 μm | 100.3 μm | 100.3 μm | 100.4 μm |
| 24 mm | 100.8 μm | 100.5 μm | 100.9 μm | 100.7 μm |
| | | Maximum value of $t_n$ | | 100.7 μm |
| | | Minimum value of $t_n$ | | 98.4 μm |
| | | Average value of $t_n$ | | 99.6 μm |
| | | (Maximum value − Minimum value)/average value | | 2.3% |

Example 6

The blending was changed as shown in Table 1, and the tube was prepared by tubular film process similarly to Example 1.

In order that the shortest distance between the tube and the airing jet port becomes 30 mm, the output (gas volume) of the blower was decided, and based on the thickness data in a heater off state, the output of the heat was decided, and the control of the heater was started. At the point of time when five minutes has passed after the control started, in the airing jet port, similarly to Example 1, when the temperature of the wind was measured. The lowest temperature was 29° C., and the highest temperature was 56° C., and the temperature difference was 27° C. By using the tube in which five minutes has passed since the heater control started, the electrophotographic belt (transfer material conveying belt) was prepared in the same manner as Example 1, and the estimation was made in the same manner as Example 1. The measurement result of the thickness is shown in Table 15 and Table 16, and the estimation result of the color shift is shown in Table 2.

The value of the center of gravity Z was 0.49 μm. The color shift has been small at the initial period and after durability test.

TABLE 15

| n | Measuring point θ | Gauge 1 | Gauge 2 | Gauge 3 | Average value of gauges 1 to 3: $t_n$ | $t_n \times \cos\theta$ | $t_n \times \sin\theta$ |
|---|---|---|---|---|---|---|---|
| 1 | 0° | 100.8 μm | 101.2 μm | 101.2 μm | 101.1 μm | 101.06 μm | 0.00 μm |
| 2 | 18° | 99.5 μm | 99.8 μm | 99.8 μm | 99.7 μm | 94.82 μm | 30.81 μm |
| 3 | 36° | 96.1 μm | 96.3 μm | 96.6 μm | 96.3 μm | 77.94 μm | 56.63 μm |
| 4 | 54° | 97.6 μm | 97.9 μm | 98.0 μm | 97.8 μm | 57.49 μm | 79.13 μm |
| 5 | 72° | 98.7 μm | 98.7 μm | 99.0 μm | 98.8 μm | 30.54 μm | 93.98 μm |
| 6 | 90° | 100.1 μm | 100.2 μm | 100.7 μm | 100.3 μm | 0.00 μm | 100.34 μm |
| 7 | 108° | 99.7 μm | 99.8 μm | 100.3 μm | 99.9 μm | −30.87 μm | 95.02 μm |
| 8 | 126° | 98.7 μm | 99.0 μm | 99.4 μm | 99.0 μm | −58.20 μm | 80.11 μm |
| 9 | 144° | 98.6 μm | 98.8 μm | 98.8 μm | 98.7 μm | −79.88 μm | 58.03 μm |
| 10 | 162° | 100.5 μm | 100.7 μm | 100.7 μm | 100.6 μm | −95.71 μm | 31.10 μm |
| 11 | 180° | 102.7 μm | 102.9 μm | 103.3 μm | 103.0 μm | −102.97 μm | 0.00 μm |
| 12 | 198° | 100.3 μm | 100.5 μm | 100.6 μm | 100.5 μm | −95.56 μm | −31.05 μm |
| 13 | 216° | 101.9 μm | 102.2 μm | 102.1 μm | 102.1 μm | −82.59 μm | −80.00 μm |
| 14 | 234° | 99.3 μm | 99.8 μm | 99.5 μm | 99.5 μm | −58.51 μm | −80.53 μm |
| 15 | 252° | 99.6 μm | 100.2 μm | 99.8 μm | 99.9 μm | −30.86 μm | −94.99 μm |
| 16 | 270° | 98.7 μm | 98.9 μm | 99.2 μm | 98.9 μm | 0.00 μm | −98.94 μm |
| 17 | 288° | 100.5 μm | 100.7 μm | 101.2 μm | 100.8 μm | 31.14 μm | −95.85 μm |
| 18 | 306° | 101.2 μm | 101.6 μm | 101.5 μm | 101.4 μm | 59.62 μm | −82.06 μm |

TABLE 15-continued

| n | Measuring point θ | Gauge 1 | Gauge 2 | Gauge 3 | Average value of gauges 1 to 3: $t_n$ | $t_n \times \cos\theta$ | $t_n \times \sin\theta$ |
|---|---|---|---|---|---|---|---|
| 19 | 324° | 99.8 μm | 100.3 μm | 100.1 μm | 100.1 μm | 80.97 μm | −58.83 μm |
| 20 | 342° | 102.1 μm | 102.3 μm | 102.3 μm | 102.2 μm | 97.23 μm | −31.59 μm |
| | | | Total sum | | | −4.34 μm | −8.69 μm |
| | | | Average | | | −0.22 μm | −0.43 μm |
| | | | Z | | | 0.49 μm | |

TABLE 16

| Position in peripheral direction | Gauge 1 | Gauge 2 | Gauge 3 | Average value of gauges 1 to 3: $t_n$ |
|---|---|---|---|---|
| 0 mm | 100.1 μm | 100.3 μm | 99.6 μm | 100.0 μm |
| 1 mm | 102.3 μm | 101.9 μm | 101.9 μm | 102.0 μm |
| 2 mm | 100.6 μm | 100.4 μm | 100.9 μm | 100.7 μm |
| 3 mm | 102.2 μm | 102.3 μm | 102.7 μm | 102.4 μm |
| 4 mm | 99.8 μm | 99.7 μm | 99.6 μm | 99.7 μm |
| 5 mm | 100.3 μm | 100.7 μm | 100.4 μm | 100.5 μm |
| 6 mm | 99.0 μm | 99.1 μm | 98.8 μm | 99.0 μm |
| 7 mm | 98.8 μm | 98.5 μm | 98.8 μm | 98.7 μm |
| 8 mm | 101.2 μm | 101.5 μm | 101.1 μm | 101.3 μm |
| 9 mm | 101.6 μm | 101.3 μm | 101.8 μm | 101.6 μm |
| 10 mm | 97.8 μm | 97.4 μm | 97.6 μm | 97.6 μm |
| 11 mm | 101.5 μm | 101.5 μm | 101.3 μm | 101.4 μm |
| 12 mm | 97.9 μm | 97.4 μm | 97.5 μm | 97.6 μm |
| 13 mm | 99.9 μm | 99.6 μm | 99.6 μm | 99.7 μm |
| 14 mm | 99.6 μm | 99.6 μm | 99.5 μm | 99.6 μm |
| 15 mm | 102.5 μm | 103.0 μm | 102.5 μm | 102.6 μm |
| 16 mm | 97.9 μm | 97.9 μm | 98.0 μm | 97.9 μm |
| 17 mm | 98.0 μm | 98.0 μm | 98.2 μm | 98.1 μm |
| 18 mm | 101.6 μm | 101.7 μm | 101.2 μm | 101.5 μm |
| 19 mm | 99.3 μm | 99.4 μm | 99.2 μm | 99.3 μm |
| 20 mm | 102.1 μm | 102.0 μm | 102.0 μm | 102.0 μm |
| 21 mm | 100.0 μm | 100.1 μm | 99.9 μm | 100.0 μm |
| 22 mm | 101.4 μm | 101.2 μm | 101.7 μm | 101.4 μm |
| 23 mm | 102.2 μm | 101.9 μm | 101.8 μm | 102.0 μm |
| 24 mm | 98.6 μm | 98.9 μm | 98.9 μm | 98.8 μm |
| | Maximum value of $t_n$ | | | 102.6 μm |
| | Minimum value of $t_n$ | | | 97.6 μm |
| | Average value of $t_n$ | | | 100.2 μm |
| | (Maximum value − Minimum value)/average value | | | 5.0% |

Example 7

The blending was changed as shown in Table 1, and the tube was prepared by tubular film process similarly to Example 1.

In order that the shortest distance between the tube and the airing jet port becomes 20 mm, the output (gas volume) of the blower was decided, and based on the thickness data in a heater off state, the output of the heat was decided, and the control of the heater was started. At the point of time when five minutes has passed after the control started, in the airing jet port, similarly to Example 1, when the temperature of the wind was measured. The lowest temperature was 35° C., and the highest temperature was 120° C., and temperature difference was 85° C. By using the tube in which five minutes has passed since the heater control started, the electrophotographic belt (transfer material conveying belt) was prepared in the same manner as Example 1, and the estimation was made in the same manner as Example 1. The measurement result of the thickness is shown in Table 17 and Table 18, and the estimation result of the color shift is shown in Table 2.

The value of the center of gravity Z was 0.01 μm. The color shift has been small at the initial period and after durability test.

TABLE 17

| n | Measuring point θ | Gauge 1 | Gauge 2 | Gauge 3 | Average value of gauges 1 to 3: $t_n$ | $t_n \times \cos\theta$ | $t_n \times \sin\theta$ |
|---|---|---|---|---|---|---|---|
| 1 | 0° | 99.6 μm | 99.8 μm | 99.8 μm | 99.7 μm | 99.72 μm | 0.00 μm |
| 2 | 18° | 104.1 μm | 104.1 μm | 104.6 μm | 104.3 μm | 99.23 μm | 32.24 μm |
| 3 | 36° | 97.6 μm | 97.5 μm | 97.5 μm | 97.5 μm | 78.90 μm | 57.33 μm |
| 4 | 54° | 100.2 μm | 99.9 μm | 100.5 μm | 100.2 μm | 58.89 μm | 81.05 μm |
| 5 | 72° | 100.5 μm | 100.3 μm | 100.6 μm | 100.5 μm | 31.05 μm | 95.56 μm |
| 6 | 90° | 101.2 μm | 100.9 μm | 101.6 μm | 101.2 μm | 0.00 μm | 101.21 μm |
| 7 | 108° | 102.1 μm | 101.8 μm | 102.3 μm | 102.1 μm | −31.54 μm | 97.06 μm |
| 8 | 126° | 98.1 μm | 98.2 μm | 97.7 μm | 98.0 μm | −57.61 μm | 79.29 μm |
| 9 | 144° | 99.5 μm | 99.1 μm | 99.1 μm | 99.2 μm | −80.28 μm | 58.33 μm |
| 10 | 162° | 100.7 μm | 101.0 μm | 100.9 μm | 100.9 μm | −95.93 μm | 31.17 μm |
| 11 | 180° | 103.0 μm | 103.5 μm | 103.5 μm | 103.3 μm | −103.31 μm | 0.00 μm |
| 12 | 198° | 98.5 μm | 98.8 μm | 98.2 μm | 98.5 μm | −93.67 μm | −30.43 μm |
| 13 | 216° | 103.8 μm | 103.5 μm | 103.3 μm | 103.5 μm | −83.76 μm | −60.85 μm |
| 14 | 234° | 99.1 μm | 99.0 μm | 99.2 μm | 99.1 μm | −58.25 μm | −80.17 μm |
| 15 | 252° | 102.1 μm | 102.1 μm | 102.1 μm | 102.1 μm | −31.55 μm | −97.10 μm |
| 16 | 270° | 97.9 μm | 97.5 μm | 97.5 μm | 97.6 μm | 0.00 μm | −97.61 μm |
| 17 | 288° | 100.3 μm | 100.1 μm | 100.0 μm | 100.1 μm | 30.94 μm | −95.23 μm |
| 18 | 306° | 100.9 μm | 101.2 μm | 101.1 μm | 101.1 μm | 59.40 μm | −81.76 μm |
| 19 | 324° | 98.8 μm | 98.9 μm | 98.7 μm | 98.8 μm | 79.93 μm | −58.07 μm |
| 20 | 342° | 102.8 μm | 102.8 μm | 102.7 μm | 102.7 μm | 97.72 μm | −31.75 μm |
| | | | Total sum | | | −0.11 μm | 0.26 μm |
| | | | Average | | | −0.01 μm | 0.01 μm |
| | | | Z | | | 0.01 μm | |

TABLE 18

| Position in peripheral direction | Gauge 1 | Gauge 2 | Gauge 3 | Average value of gauges 1 to 3: $t_n$ |
|---|---|---|---|---|
| 0 mm | 97.7 μm | 98.0 μm | 97.8 μm | 97.8 μm |
| 1 mm | 101.2 μm | 101.1 μm | 101.5 μm | 101.3 μm |
| 2 mm | 97.2 μm | 97.0 μm | 97.1 μm | 97.1 μm |
| 3 mm | 101.4 μm | 102.1 μm | 102.3 μm | 101.9 μm |
| 4 mm | 101.4 μm | 100.4 μm | 101.2 μm | 101.0 μm |
| 5 mm | 101.9 μm | 102.0 μm | 101.6 μm | 101.8 μm |
| 6 mm | 99.0 μm | 99.3 μm | 98.8 μm | 99.1 μm |
| 7 mm | 98.9 μm | 99.8 μm | 99.1 μm | 99.3 μm |
| 8 mm | 100.4 μm | 101.0 μm | 99.9 μm | 100.4 μm |
| 9 mm | 100.4 μm | 99.6 μm | 100.9 μm | 100.3 μm |
| 10 mm | 100.4 μm | 101.1 μm | 101.1 μm | 100.9 μm |
| 11 mm | 101.1 μm | 102.0 μm | 101.1 μm | 101.4 μm |
| 12 mm | 100.9 μm | 101.2 μm | 101.3 μm | 101.1 μm |
| 13 mm | 98.8 μm | 99.0 μm | 97.8 μm | 98.5 μm |
| 14 mm | 98.0 μm | 97.8 μm | 99.0 μm | 98.3 μm |
| 15 mm | 102.3 μm | 102.9 μm | 102.9 μm | 102.7 μm |
| 16 mm | 100.3 μm | 99.4 μm | 101.1 μm | 100.3 μm |
| 17 mm | 100.4 μm | 99.6 μm | 100.1 μm | 100.0 μm |
| 18 mm | 101.3 μm | 100.3 μm | 101.5 μm | 101.0 μm |
| 19 mm | 99.5 μm | 99.2 μm | 99.9 μm | 99.5 μm |
| 20 mm | 102.8 μm | 102.3 μm | 101.9 μm | 102.4 μm |
| 21 mm | 98.7 μm | 97.7 μm | 99.5 μm | 98.7 μm |

TABLE 18-continued

| Position in peripheral direction | Gauge 1 | Gauge 2 | Gauge 3 | Average value of gauges 1 to 3: $t_n$ |
|---|---|---|---|---|
| 22 mm | 98.7 μm | 99.5 μm | 98.2 μm | 98.8 μm |
| 23 mm | 100.4 μm | 100.9 μm | 101.1 μm | 100.8 μm |
| 24 mm | 103.1 μm | 103.3 μm | 103.5 μm | 103.3 μm |
| Maximum value of $t_n$ | | | | 103.3 μm |
| Minimum value of $t_n$ | | | | 97.1 μm |
| Average value of $t_n$ | | | | 100.3 μm |
| (Maximum value − Minimum value)/average value | | | | 6.1% |

Example 8

The blending was changed as shown in Table 1, and the tube was prepared by tubular film process similarly to Example 1.

In order that the shortest distance between the tube and the airing jet port becomes 8 mm, the output (gas volume) of the blower was decided, and based on the thickness data in a heater off state, the output of the heat was decided, and the control of the heater was started. At the point of time when five minutes has passed after the control started, in the airing jet port, similarly to Example 1, when the temperature of the wind was measured. The lowest temperature was 29° C., and the highest temperature was 69° C., and the temperature difference was 40° C. By using the tube in which five minutes has passed since the heater control started, the electrophotographic belt (transfer material conveying belt) was prepared in the same manner as Example 1, and the estimation was made in the same manner as Example 1. The measurement result of the thickness is shown in Table 19 and Table 20, and the estimation result of the color shift is shown in Table 2.

The value of the center of gravity Z was 0.05 μm. The color shift has been small at the initial period and after durability test.

TABLE 19

| n | Measuring point θ | Gauge 1 | Gauge 2 | Gauge 3 | Average value of gauges 1 to 3: $t_n$ | $t_n \times \cos\theta$ | $t_n \times \sin\theta$ |
|---|---|---|---|---|---|---|---|
| 1 | 0° | 99.3 μm | 99.4 μm | 99.4 μm | 99.4 μm | 99.39 μm | 0.00 μm |
| 2 | 18° | 101.6 μm | 101.9 μm | 102.1 μm | 101.9 μm | 96.88 μm | 31.48 μm |
| 3 | 36° | 96.1 μm | 96.6 μm | 96.8 μm | 96.5 μm | 78.05 μm | 56.71 μm |
| 4 | 54° | 100.2 μm | 100.3 μm | 100.4 μm | 100.3 μm | 58.96 μm | 81.15 μm |
| 5 | 72° | 100.5 μm | 101.1 μm | 101.1 μm | 100.9 μm | 31.17 μm | 95.93 μm |
| 6 | 90° | 99.1 μm | 99.7 μm | 99.8 μm | 99.5 μm | 0.00 μm | 99.52 μm |
| 7 | 108° | 102.1 μm | 102.3 μm | 102.7 μm | 102.3 μm | −31.62 μm | 97.33 μm |
| 8 | 126° | 98.1 μm | 98.4 μm | 98.7 μm | 98.4 μm | −57.84 μm | 79.61 μm |
| 9 | 144° | 99.5 μm | 100.1 μm | 100.0 μm | 99.9 μm | −80.80 μm | 58.70 μm |
| 10 | 162° | 100.7 μm | 101.0 μm | 101.0 μm | 100.9 μm | −95.97 μm | 31.18 μm |
| 11 | 180° | 101.6 μm | 101.7 μm | 102.0 μm | 101.8 μm | −101.75 μm | 0.00 μm |
| 12 | 198° | 98.5 μm | 98.8 μm | 99.1 μm | 98.8 μm | −93.94 μm | −30.52 μm |
| 13 | 216° | 101.3 μm | 101.5 μm | 101.4 μm | 101.4 μm | −82.04 μm | −59.60 μm |
| 14 | 234° | 99.1 μm | 99.2 μm | 99.6 μm | 99.3 μm | −58.35 μm | −80.32 μm |
| 15 | 252° | 100.5 μm | 100.8 μm | 100.6 μm | 100.6 μm | −31.10 μm | −95.71 μm |
| 16 | 270° | 97.9 μm | 98.1 μm | 98.0 μm | 98.0 μm | 0.00 μm | −98.01 μm |
| 17 | 288° | 100.3 μm | 100.4 μm | 100.8 μm | 100.5 μm | 31.05 μm | −95.57 μm |
| 18 | 306° | 100.9 μm | 101.3 μm | 101.0 μm | 101.1 μm | 59.41 μm | −81.77 μm |
| 19 | 324° | 99.8 μm | 100.5 μm | 100.4 μm | 100.2 μm | 81.08 μm | −58.91 μm |
| 20 | 342° | 102.8 μm | 103.4 μm | 103.3 μm | 103.1 μm | 98.10 μm | −31.87 μm |
| | | | Total sum | | | 0.66 μm | −0.69 μm |
| | | | Average | | | 0.03 μm | −0.03 μm |
| | | | Z | | | 0.05 μm | |

TABLE 20

| Position in peripheral direction | Gauge 1 | Gauge 2 | Gauge 3 | Average value of gauges 1 to 3: $t_n$ |
|---|---|---|---|---|
| 0 mm | 100.9 μm | 100.5 μm | 100.9 μm | 100.7 μm |
| 1 mm | 99.2 μm | 98.8 μm | 99.8 μm | 99.3 μm |
| 2 mm | 99.1 μm | 98.7 μm | 99.3 μm | 99.0 μm |
| 3 mm | 98.4 μm | 99.0 μm | 97.6 μm | 98.3 μm |
| 4 mm | 101.0 μm | 102.1 μm | 100.5 μm | 101.2 μm |
| 5 mm | 100.7 μm | 99.9 μm | 100.3 μm | 100.3 μm |
| 6 mm | 98.1 μm | 99.2 μm | 99.0 μm | 98.8 μm |
| 7 mm | 98.4 μm | 98.4 μm | 97.3 μm | 98.0 μm |
| 8 mm | 98.1 μm | 97.7 μm | 97.3 μm | 97.7 μm |
| 9 mm | 97.7 μm | 97.6 μm | 98.4 μm | 97.9 μm |

TABLE 20-continued

| Position in peripheral direction | Gauge 1 | Gauge 2 | Gauge 3 | Average value of gauges 1 to 3: $t_n$ |
|---|---|---|---|---|
| 10 mm | 100.7 μm | 101.5 μm | 100.8 μm | 101.0 μm |
| 11 mm | 99.6 μm | 98.7 μm | 100.2 μm | 99.5 μm |
| 12 mm | 98.5 μm | 97.3 μm | 99.5 μm | 98.5 μm |
| 13 mm | 98.9 μm | 98.1 μm | 99.9 μm | 99.0 μm |
| 14 mm | 99.5 μm | 100.4 μm | 99.9 μm | 100.0 μm |
| 15 mm | 100.5 μm | 101.5 μm | 101.0 μm | 101.0 μm |
| 16 mm | 97.7 μm | 97.4 μm | 98.4 μm | 97.9 μm |
| 17 mm | 98.7 μm | 99.4 μm | 98.8 μm | 99.0 μm |
| 18 mm | 100.7 μm | 100.9 μm | 101.1 μm | 100.9 μm |
| 19 mm | 99.8 μm | 99.6 μm | 100.4 μm | 99.9 μm |
| 20 mm | 101.5 μm | 101.6 μm | 102.3 μm | 101.8 μm |
| 21 mm | 99.4 μm | 99.3 μm | 100.4 μm | 99.7 μm |
| 22 mm | 101.6 μm | 102.0 μm | 101.3 μm | 101.6 μm |
| 23 mm | 99.3 μm | 99.7 μm | 100.4 μm | 99.8 μm |
| 24 mm | 99.7 μm | 100.2 μm | 99.7 μm | 99.9 μm |
| Maximum value of $t_n$ | | | | 101.8 μm |
| Minimum value of $t_n$ | | | | 97.7 μm |
| Average value of $t_n$ | | | | 99.6 μm |
| (Maximum value − Minimum value)/average value | | | | 4.1% |

Example 9

By using the pellet of the same blending as Example 1 and by using the tubular film processing machine shown in FIG. 9, the molding of a tube was performed. In the present Example, the heater (cartridge heater) provided within the airing was 200 (W) per piece, and was installed 60 pieces in the peripheral direction (each heater is disposed at equal intervals). Each heater, similarly to Example 1, was provided with a heat sink made of copper plate and an insulator made of ceramic. Heat capacity per pair of heat sinks is 3(J/K).

Similarly to Example 1, at first, all heaters were turned off, and then, the tubular film process was started, and based on the measurement result of the thickness, the output of each heater was decided, and the control of the heater was started. In the present Example, since the number of heaters is 60 pieces, the thickness was measured at 60 places in the peripheral direction, and similarly to Example 1, a gain was decided, and the output of each heater was decided. Although the control of the heater is the same control as Example 1, one cycle was made as one second.

The shortest distance between the tube and the airing jet port was taken as 3 mm, and the drawing out speed was taken as 15 m/min. Further, the diameter of the tube was taken as 197.5 mm. Consequently, the blow ratio was taken as 1.975. Otherwise, similarly to Example 1, the electrophotographic belt (transfer material conveying belt) was obtained. The inner peripheral length of the transfer material conveying belt having been obtained after five minutes has elapsed since the heater control started was 620 mm.

To find the center of gravity Z of the transfer material conveying belt, by using the apparatus of FIG. 13, the thickness was measured at 31 mm pitch similarly to Example 1. The result is shown in Table 21. Further, the measurement result of the unevenness of the short period of the thickness is shown in Table 22.

The obtained transfer material conveying belt was fitted to the electrophotographic apparatus (color electrophotographic apparatus) having the constitution shown in FIG. 1. In the present Example, the rotational shafts of the adjacent photosensitive members are mutually 65 mm away from the centers. The diameter of the driving roller was taken as 20.7 mm, and the winding angle thereof was taken as 103°. Consequently, the winding amount is 18.6 mm, and is 3.0% of the inner peripheral length (18.6/620=0.030). Otherwise, electrophotographic operations were taken as similarly to Example 1.

The result of having performed the image output of 10,000 sheets is shown in Table 2.

TABLE 21

| n | Measuring point θ | Gauge 1 | Gauge 2 | Gauge 3 | Average value of gauges 1 to 3: $t_n$ | $t_n \times \cos\theta$ | $t_n \times \sin\theta$ |
|---|---|---|---|---|---|---|---|
| 1 | 0° | 98.9 μm | 99.4 μm | 99.4 μm | 99.2 μm | 99.23 μm | 0.00 μm |
| 2 | 18° | 101.3 μm | 101.8 μm | 101.5 μm | 101.5 μm | 96.55 μm | 31.37 μm |
| 3 | 36° | 98.6 μm | 98.6 μm | 98.9 μm | 98.7 μm | 79.86 μm | 58.02 μm |
| 4 | 54° | 100.2 μm | 100.2 μm | 100.2 μm | 100.2 μm | 58.91 μm | 81.08 μm |
| 5 | 72° | 101.5 μm | 101.9 μm | 102.0 μm | 101.8 μm | 31.45 μm | 96.79 μm |
| 6 | 90° | 99.1 μm | 99.7 μm | 99.6 μm | 99.4 μm | 0.00 μm | 99.44 μm |
| 7 | 108° | 102.1 μm | 102.6 μm | 102.2 μm | 102.3 μm | −31.62 μm | 97.30 μm |
| 8 | 126° | 98.1 μm | 98.5 μm | 98.1 μm | 98.2 μm | −57.74 μm | 79.48 μm |
| 9 | 144° | 99.5 μm | 100.2 μm | 99.6 μm | 99.8 μm | −80.72 μm | 58.65 μm |
| 10 | 162° | 100.7 μm | 100.8 μm | 101.1 μm | 100.9 μm | −95.93 μm | 31.17 μm |
| 11 | 180° | 101.6 μm | 102.1 μm | 101.8 μm | 101.9 μm | −101.85 μm | 0.00 μm |
| 12 | 198° | 98.9 μm | 99.1 μm | 99.2 μm | 99.1 μm | −94.23 μm | −30.62 μm |
| 13 | 216° | 100.7 μm | 101.4 μm | 101.0 μm | 101.0 μm | −81.74 μm | −59.39 μm |
| 14 | 234° | 98.6 μm | 99.3 μm | 99.1 μm | 99.0 μm | −58.19 μm | −80.10 μm |
| 15 | 252° | 100.1 μm | 100.7 μm | 100.4 μm | 100.4 μm | −31.02 μm | −95.48 μm |
| 16 | 270° | 97.3 μm | 97.5 μm | 97.3 μm | 97.4 μm | 0.00 μm | −97.39 μm |
| 17 | 288° | 100.3 μm | 100.7 μm | 100.6 μm | 100.5 μm | 31.06 μm | −95.60 μm |
| 18 | 306° | 99.8 μm | 100.0 μm | 100.2 μm | 100.0 μm | 58.78 μm | −80.90 μm |
| 19 | 324° | 98.9 μm | 99.2 μm | 99.4 μm | 99.2 μm | 80.22 μm | −58.28 μm |
| 20 | 342° | 101.8 μm | 102.2 μm | 101.9 μm | 101.9 μm | 96.95 μm | −31.50 μm |
| | | | Total sum | | | −0.04 μm | 4.06 μm |
| | | | Average | | | 0.00 μm | 0.20 μm |
| | | | Z | | | 0.20 μm | |

TABLE 22

| Position in peripheral direction | Gauge 1 | Gauge 2 | Gauge 3 | Average value of gauges 1 to 3: $t_n$ |
|---|---|---|---|---|
| 0 mm | 100.1 μm | 99.8 μm | 100.3 μm | 100.1 μm |
| 1 mm | 100.6 μm | 99.9 μm | 100.2 μm | 100.2 μm |
| 2 mm | 101.4 μm | 101.0 μm | 101.2 μm | 101.2 μm |
| 3 mm | 100.6 μm | 101.2 μm | 100.2 μm | 100.7 μm |
| 4 mm | 99.9 μm | 99.6 μm | 100.4 μm | 100.0 μm |
| 5 mm | 98.5 μm | 97.9 μm | 97.9 μm | 98.1 μm |
| 6 mm | 100.3 μm | 100.7 μm | 99.8 μm | 100.3 μm |
| 7 mm | 101.4 μm | 101.3 μm | 102.1 μm | 101.6 μm |
| 8 mm | 100.8 μm | 100.2 μm | 101.1 μm | 100.7 μm |
| 9 mm | 101.1 μm | 101.4 μm | 101.7 μm | 101.4 μm |
| 10 mm | 99.8 μm | 100.0 μm | 100.1 μm | 99.9 μm |
| 11 mm | 99.1 μm | 98.5 μm | 99.0 μm | 98.9 μm |
| 12 mm | 99.7 μm | 99.5 μm | 99.5 μm | 99.6 μm |
| 13 mm | 101.0 μm | 100.8 μm | 100.8 μm | 100.9 μm |
| 14 mm | 100.9 μm | 100.4 μm | 100.4 μm | 100.6 μm |
| 15 mm | 100.7 μm | 100.3 μm | 101.2 μm | 100.7 μm |
| 16 mm | 99.2 μm | 99.6 μm | 98.7 μm | 99.1 μm |
| 17 mm | 99.6 μm | 100.1 μm | 99.8 μm | 99.9 μm |
| 18 mm | 99.1 μm | 99.6 μm | 99.1 μm | 99.3 μm |
| 19 mm | 100.7 μm | 101.3 μm | 100.0 μm | 100.7 μm |
| 20 mm | 100.4 μm | 100.8 μm | 101.1 μm | 100.8 μm |
| 21 mm | 101.1 μm | 101.5 μm | 100.9 μm | 101.2 μm |
| 22 mm | 100.4 μm | 100.0 μm | 100.0 μm | 100.1 μm |
| 23 mm | 99.1 μm | 99.3 μm | 98.6 μm | 99.0 μm |
| 24 mm | 99.5 μm | 99.3 μm | 100.1 μm | 99.6 μm |
| 25 mm | 99.8 μm | 100.0 μm | 99.6 μm | 99.8 μm |
| 26 mm | 100.4 μm | 100.2 μm | 100.4 μm | 100.3 μm |
| 27 mm | 100.9 μm | 100.4 μm | 100.5 μm | 100.6 μm |
| 28 mm | 99.9 μm | 99.6 μm | 99.9 μm | 99.8 μm |
| 29 mm | 98.9 μm | 99.5 μm | 98.3 μm | 98.9 μm |
| 30 mm | 99.3 μm | 99.2 μm | 99.1 μm | 99.2 μm |
| 31 mm | 99.1 μm | 98.5 μm | 98.8 μm | 98.8 μm |
| | Maximum value of $t_n$ | | | 101.6 μm |
| | Minimum value of $t_n$ | | | 98.1 μm |
| | Average value of $t_n$ | | | 100.1 μm |
| | (Maximum value − Minimum value)/average value | | | 3.5% |

Example 10

Except that the diameter of the tube was made 130 mm, the electrophotographic belt (transfer material conveying belt) was obtained in the same manner as Example 1. The inner peripheral length of the transfer material conveying belt having been obtained after five minutes has elapsed since the heater control started was 380 mm.

To find the center of gravity Z of the transfer material conveying belt, by using the apparatus of FIG. 13, the thickness was measured at 19 mm pitch in the same manner as Example 1. The result is shown in Table 23. Further, the measurement result of the unevenness of the short period of the thickness is shown in Table 24.

The obtained transfer material conveying belt was fitted to the electrophotographic apparatus (color electrophotographic apparatus) having the constitution shown in FIG. 1. In the present Example, the rotational shafts of the adjacent photosensitive members are mutually away 45 mm from the center. The driving roller is made of rubber in surface, and is 20 mm in diameter, and the winding angle of a transfer material conveying belt 20 to the driving roller 21 was taken as 153°. Consequently, the winding amount is 26.7 mm, which is 7.0% of the entire peripheral length (26.7/380=0.070). Otherwise, electrophotographic operations were taken as similarly to Example 1.

The result of having performed the image output of 10,000 sheets is shown in Table 2.

TABLE 23

| n | Measuring point θ | Gauge 1 | Gauge 2 | Gauge 3 | Average value of gauges 1 to 3: $t_n$ | $t_n \times \cos\theta$ | $t_n \times \sin\theta$ |
|---|---|---|---|---|---|---|---|
| 1 | 0° | 98.9 μm | 99.6 μm | 98.4 μm | 99.0 μm | 98.97 μm | 0.00 μm |
| 2 | 18° | 101.4 μm | 101.4 μm | 101.1 μm | 101.3 μm | 96.36 μm | 31.31 μm |
| 3 | 36° | 98.6 μm | 98.7 μm | 98.7 μm | 98.7 μm | 79.83 μm | 58.00 μm |
| 4 | 54° | 101.4 μm | 101.2 μm | 101.1 μm | 101.2 μm | 59.50 μm | 81.89 μm |
| 5 | 72° | 102.6 μm | 102.7 μm | 101.9 μm | 102.4 μm | 31.65 μm | 97.42 μm |
| 6 | 90° | 101.2 μm | 101.2 μm | 101.9 μm | 101.4 μm | 0.00 μm | 101.4 μm |
| 7 | 108° | 102.5 μm | 103.0 μm | 102.3 μm | 102.6 μm | −31.70 μm | 97.57 μm |
| 8 | 126° | 103.5 μm | 102.8 μm | 103.3 μm | 103.2 μm | −60.65 μm | 83.47 μm |
| 9 | 144° | 102.5 μm | 103.2 μm | 102.2 μm | 102.6 μm | −83.02 μm | 60.32 μm |
| 10 | 162° | 101.6 μm | 101.6 μm | 102.1 μm | 101.8 μm | −96.78 μm | 31.45 μm |
| 11 | 180° | 102.6 μm | 102.6 μm | 102.1 μm | 102.4 μm | −102.44 μm | 0.00 μm |
| 12 | 198° | 99.9 μm | 100.3 μm | 99.4 μm | 99.9 μm | −94.98 μm | −30.86 μm |
| 13 | 216° | 100.7 μm | 101.0 μm | 101.2 μm | 101.0 μm | −81.70 μm | −59.36 μm |
| 14 | 234° | 98.6 μm | 98.9 μm | 98.4 μm | 98.6 μm | −57.96 μm | −79.78 μm |
| 15 | 252° | 100.1 μm | 99.8 μm | 99.7 μm | 99.9 μm | −30.86 μm | −94.98 μm |
| 16 | 270° | 97.3 μm | 97.6 μm | 96.8 μm | 97.3 μm | 0.00 μm | −97.26 μm |
| 17 | 288° | 99.6 μm | 99.1 μm | 99.5 μm | 99.4 μm | 30.72 μm | −94.55 μm |
| 18 | 306° | 98.4 μm | 98.5 μm | 97.9 μm | 98.3 μm | 57.76 μm | −79.50 μm |
| 19 | 324° | 98.9 μm | 99.3 μm | 98.4 μm | 98.9 μm | 79.98 μm | −58.11 μm |
| 20 | 342° | 100.7 μm | 100.2 μm | 100.4 μm | 100.4 μm | 95.52 μm | −31.04 μm |
| | | | Total sum | | | −9.81 μm | 17.46 μm |
| | | | Average | | | −0.49 μm | 0.87 μm |
| | | | Z | | | 1.00 μm | |

TABLE 24

| Position in peripheral direction | Gauge 1 | Gauge 2 | Gauge 3 | Average value of gauges 1 to 3: $t_n$ |
|---|---|---|---|---|
| 0 mm | 100.4 μm | 100.8 μm | 100.7 μm | 100.7 μm |
| 1 mm | 99.8 μm | 100.4 μm | 100.3 μm | 100.2 μm |
| 2 mm | 101.1 μm | 100.5 μm | 101.3 μm | 101.0 μm |
| 3 mm | 99.8 μm | 100.4 μm | 99.2 μm | 99.8 μm |
| 4 mm | 101.2 μm | 100.8 μm | 101.3 μm | 101.1 μm |
| 5 mm | 100.2 μm | 99.6 μm | 100.3 μm | 100.0 μm |
| 6 mm | 99.9 μm | 99.5 μm | 100.3 μm | 99.9 μm |
| 7 mm | 101.1 μm | 100.6 μm | 101.7 μm | 101.1 μm |
| 8 mm | 100.1 μm | 99.3 μm | 99.7 μm | 99.7 μm |
| 9 mm | 100.4 μm | 101.1 μm | 101.0 μm | 100.8 μm |
| 10 mm | 99.9 μm | 100.5 μm | 99.8 μm | 100.1 μm |
| 11 mm | 99.5 μm | 99.6 μm | 99.9 μm | 99.7 μm |
| 12 mm | 100.3 μm | 100.8 μm | 100.2 μm | 100.4 μm |
| 13 mm | 99.4 μm | 99.8 μm | 100.1 μm | 99.8 μm |
| 14 mm | 100.8 μm | 101.6 μm | 101.3 μm | 101.2 μm |
| 15 mm | 100.7 μm | 101.1 μm | 101.3 μm | 101.0 μm |
| 16 mm | 98.8 μm | 98.6 μm | 98.6 μm | 98.7 μm |
| 17 mm | 99.7 μm | 99.8 μm | 100.1 μm | 99.9 μm |
| 18 mm | 100.6 μm | 100.9 μm | 100.8 μm | 100.8 μm |
| 19 mm | 99.0 μm | 99.3 μm | 99.0 μm | 99.1 μm |
| Maximum value of $t_n$ | | | | 101.2 μm |
| Minimum value of $t_n$ | | | | 98.7 μm |
| Average value of $t_n$ | | | | 100.2 μm |
| (Maximum value − Minimum value)/average value | | | | 2.6% |

Example 11

Figure 2:
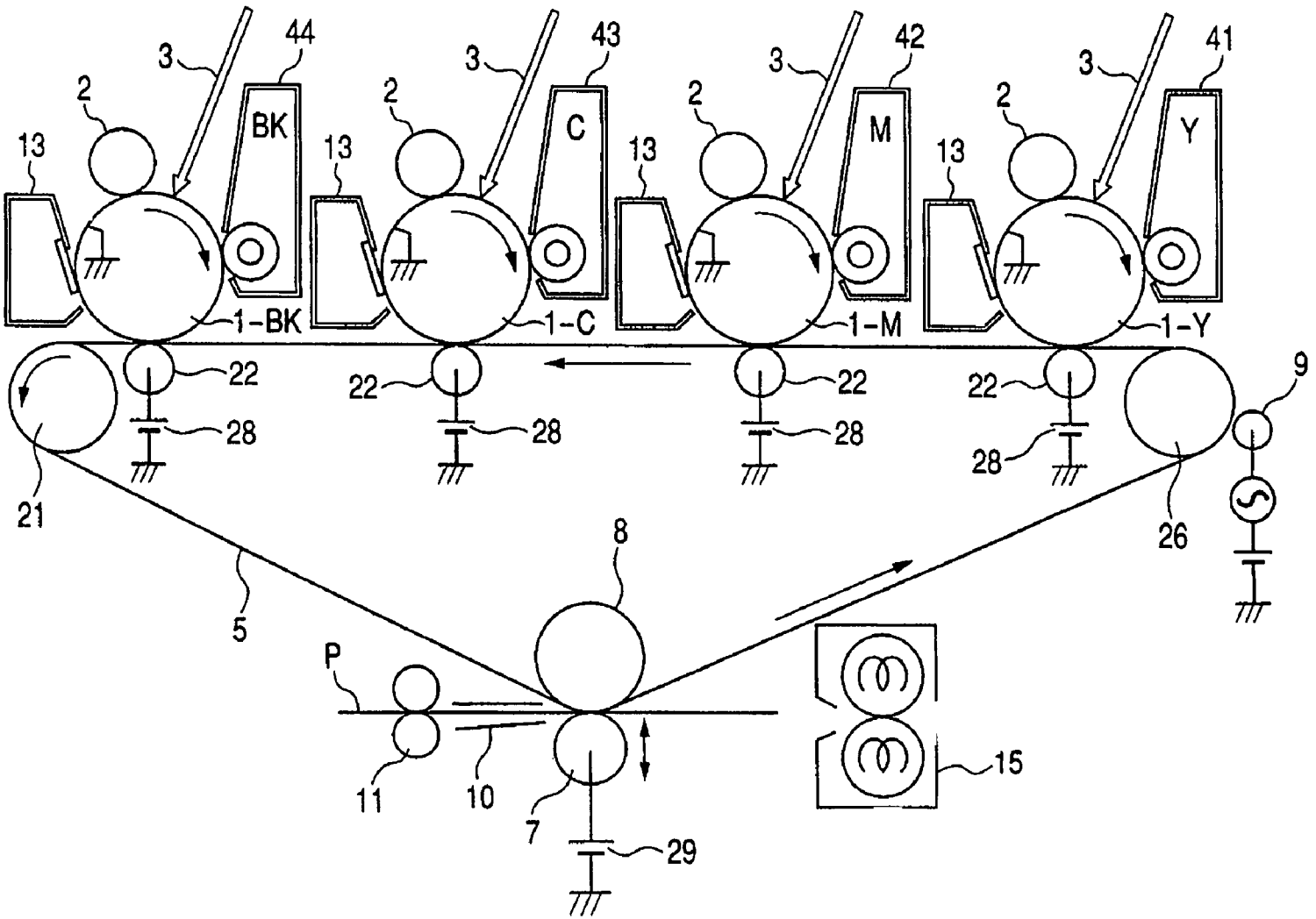
FIG. 2 is a view showing the electrophotographic apparatus having an intermediate transfer belt and plural electrophotographic photosensitive members.
Figure 3:
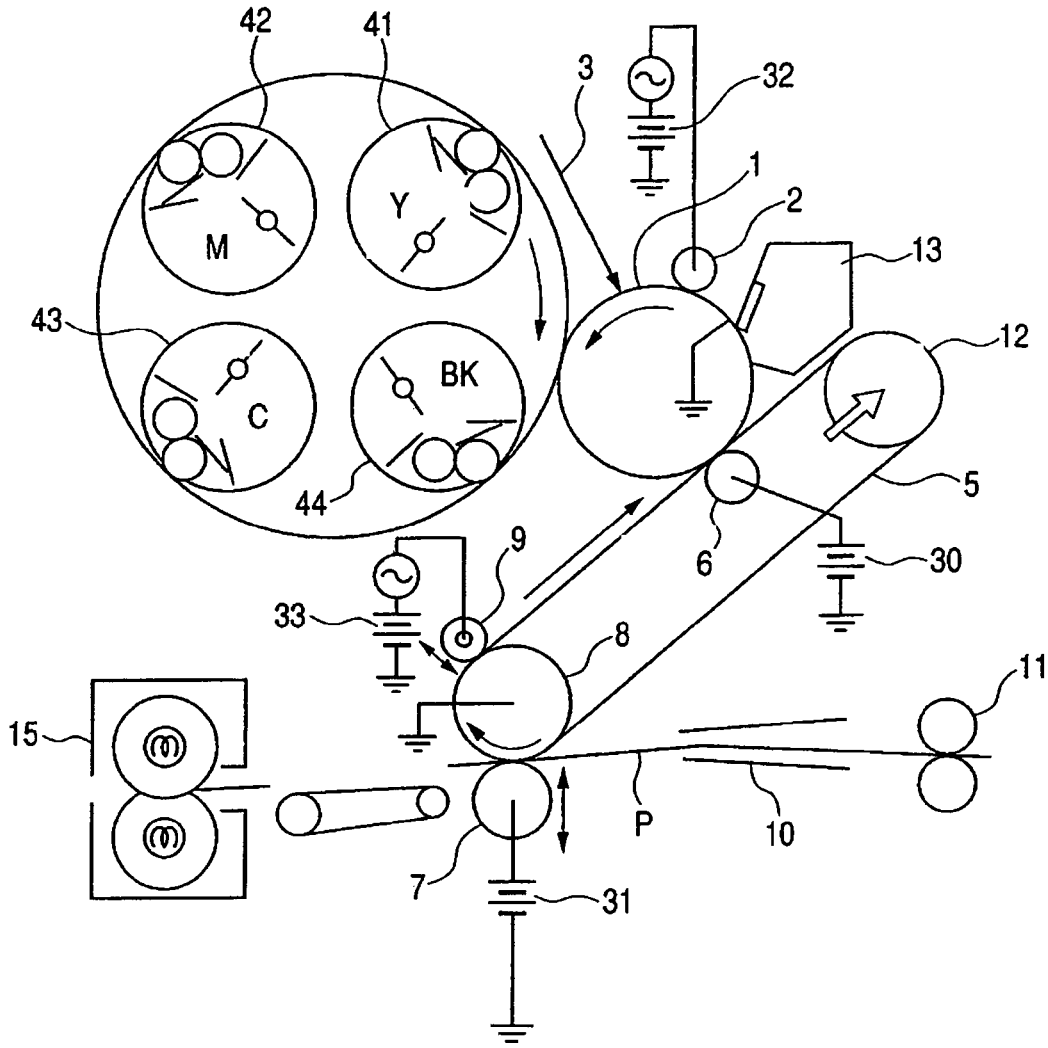
FIG. 3 is a view showing a four pass system electrophotographic apparatus having the intermediate transfer belt.

The electrophotographic belt obtained in the similar manner as Example 1 was fitted to the electrophotographic apparatus of FIG. 2 as an intermediate material belt.

In FIG. 2, 1-Y, 1-M, 1-C, and 1-BK are photosensitive drums, respectively, and are rotationally driven at a predetermined circumferential speed (process speed) in the direction to an arrow mark. The rotational shafts adjacent to each other are mutually 45 mm away in the centers.

The process of forming a first color component image (for example, yellow color component image) will be described below.

The surface of the photosensitive drum 1-Y, in its rotational process, is uniformly charge-processed to the predetermined polarity and potential by a primary charging device 2, and then, receives an image exposure light 3 by an unillustrated image exposure means. In this manner, an electrostatic latent image corresponding to a first color component image (yellow color component image in this example) of a color image is formed.

Next, the electrostatic latent image is developed into the yellow color component image by a first developing device (yellow color developing device 41). In this manner, a toner image of a first color (yellow) is formed on the photosensitive drum 1-Y. At the predetermined timing, the toner images of the second to the fourth colors are formed also on the photosensitive drums 1-M, 1-C, and 1-BK.

On the other hand, an intermediate transfer belt 5 is rotationally driven approximately at the same circumferential speed as the photosensitive drums 1-Y, 1-M, 1-C, and 1-BK or at the circumferential speed having the predetermined circumferential speed difference (in many cases, the transfer material conveying belt is faster than the photosensitive drum).

Further, a transfer roller 22 is applied with a transfer bias through a bias power supply 28. In this manner, the toner image on the photosensitive drum is transferred (primarily transferred) on the intermediate transfer belt 5. That is, the toner image is laminated and transferred on an intermediate transfer material belt 5 in order of the yellow toner image which is the first color component, the magenta toner image which is the second color component, the cyan toner image which is the third color component, and the black toner image which is the fourth color component. The transfer bias (primary transfer bias) at this time is, for example, approx. −3 kV to +3 kV.

The intermediate transfer belt 5 continues its rotation as it is, and at the predetermined timing, a transfer material P is supplied between the intermediate transfer belt 5 and a secondary transfer roller 7 through a sheet feeding roller. In the nip portion between the secondary transfer roller 7 and the intermediate transfer belt 5, the toner image on the intermediate transfer belt 5 is transferred (secondary-transferred) on the transfer material P. The transfer bias (secondary transfer bias) at this time is, for example, approve +500 V to +3 kV.

Cleaning of the transfer material conveying belt 5 is performed by a so-called electrostatic cleaning method, in which the transfer roller 22 is applied with the same polarity bias as the toner on the transfer roller 22, so that the toner on the intermediate transfer belt 5 is returned to an electrophotographic photosensitive member.

The electrophotographic photosensitive members 1-Y to 1-BK have charge transport layers of 20 μm in thickness, and were subjected to a primary charging and light exposure so that the potential (Vd) before the image exposure becomes −700(V), and the potential (V1) after the image exposure becomes −150(V).

The rotational speed of the intermediate transfer belt 5 was taken as 50 mm/s.

The surface of a driving roller 21 comprises a rubber layer of 0.5 mm in thickness, and its outer diameter is 14.3 mm. The winding angle of the intermediate transfer belt 5 to the driving roller 21 was taken as 140°. Consequently, the winding amount is 17.5 mm, which is 3.6% of the entire inner peripheral length (17.5 mm/480 mm).

In FIG. 2, reference numeral 8 denotes a secondary transfer opposed roller, reference numeral 9 a cleaning member for intermediate transfer belt, reference numeral 10 a sheet feeding guide, reference numeral 11 a sheet feeding roller, reference numeral 13 a cleaning member for photosensitive drum, reference numeral 15 a fixing device, reference numeral 21 a driving roller, and reference numeral 26 a stretching roller. Further, reference numerals 29 and 31 denote a bias power supply.

The result of the image output of 10,000 sheets is shown in Table 2.

As is evident from Table 2, since the center of gravity Z is 0.74 μm, and the unevenness of the short period of the thickness is 2.8%, the color shift has been small.

Example 12

The blending was changed as shown in Table 1, and the tube was prepared by tubular film process similarly to Example 1.

In order that the shortest distance between the tube and the airing jet port becomes 10 mm, the output (gas volume) of the blower was decided, and based on the thickness data in a heater off state, the output of the heat was decided, and the control of the heater was started. At the point of time when five minutes has passed after the control started, in the airing jet port, in the same manner as Example 1, when the temperature of the wind was measured. The lowest temperature was 28° C., and the highest temperature was 35° C., and temperature difference was 7° C. By using the tube in which five minutes has passed since the heater control started, the electrophotographic belt (transfer material conveying belt) was prepared in the same manner as Example 1, and the estimation was made in the same manner as Example 1. The measurement result of the thickness is shown in Table 28 and Table 29, and the estimation result of the color shift is shown in Table 2.

Since the center of gravity Z is small as 0.10 μm, the initial color shift has been small. However, since the unevenness of the thickness of the short period was 2.8% and small, despite of the fact that the color shift stayed in the practical range after durability test of 10,000 sheets, it has become slightly deteriorated comparing with the initial color shift. The reason why the unevenness of the short period of the thickness has become small is believed to come from the fact that the volume of the inorganic fine particles is 10 percent by mass and was few.

TABLE 28

| n | Measuring point θ | Gauge 1 | Gauge 2 | Gauge 3 | Average value of gauges 1 to 3: $t_n$ | $t_n \times \cos\theta$ | $t_n \times \sin\theta$ |
|---|---|---|---|---|---|---|---|
| 1 | 0° | 101.5 μm | 101.6 μm | 100.8 μm | 101.3 μm | 101.33 μm | 0.00 μm |
| 2 | 18° | 99.6 μm | 100.3 μm | 99.8 μm | 99.9 μm | 95.02 μm | 30.87 μm |
| 3 | 36° | 98.5 μm | 98.5 μm | 98.2 μm | 98.4 μm | 79.61 μm | 57.84 μm |
| 4 | 54° | 101.1 μm | 100.8 μm | 100.9 μm | 100.9 μm | 59.33 μm | 81.66 μm |
| 5 | 72° | 100.1 μm | 99.4 μm | 100.3 μm | 99.9 μm | 30.87 μm | 95.02 μm |
| 6 | 90° | 99.7 μm | 100.4 μm | 99.2 μm | 99.8 μm | 0.00 μm | 99.76 μm |
| 7 | 108° | 100.6 μm | 99.9 μm | 100.5 μm | 100.4 μm | −31.01 μm | 95.45 μm |
| 8 | 126° | 100.8 μm | 100.3 μm | 101.0 μm | 100.7 μm | −59.18 μm | 81.46 μm |
| 9 | 144° | 99.6 μm | 99.1 μm | 99.7 μm | 99.5 μm | −80.48 μm | 58.48 μm |
| 10 | 162° | 99.6 μm | 100.2 μm | 100.0 μm | 99.9 μm | −95.05 μm | 30.88 μm |
| 11 | 180° | 101.6 μm | 101.7 μm | 101.0 μm | 101.4 μm | −101.44 μm | 0.00 μm |
| 12 | 198° | 100.3 μm | 100.8 μm | 99.8 μm | 100.3 μm | −95.39 μm | −30.99 μm |
| 13 | 216° | 99.6 μm | 99.9 μm | 99.9 μm | 99.8 μm | −80.75 μm | −58.67 μm |
| 14 | 234° | 100.5 μm | 100.4 μm | 100.7 μm | 100.5 μm | −59.09 μm | −81.33 μm |
| 15 | 252° | 100.2 μm | 100.1 μm | 99.7 μm | 100.0 μm | −30.91 μm | −95.12 μm |
| 16 | 270° | 99.5 μm | 99.4 μm | 99.1 μm | 99.4 μm | 0.00 μm | −99.36 μm |
| 17 | 288° | 100.7 μm | 101.3 μm | 101.1 μm | 101.1 μm | 31.23 μm | −96.11 μm |
| 18 | 306° | 101.2 μm | 101.4 μm | 101.5 μm | 101.4 μm | 59.58 μm | −82.01 μm |
| 19 | 324° | 98.7 μm | 99.0 μm | 98.6 μm | 98.8 μm | 79.90 μm | −58.05 μm |
| 20 | 342° | 99.8 μm | 99.1 μm | 100.0 μm | 99.7 μm | 94.77 μm | −30.79 μm |
| | | | Total sum | | | −1.66 μm | −1.02 μm |
| | | | Average | | | −0.08 μm | −0.05 μm |
| | | | Z | | | 0.10 μm | |

TABLE 29

| Position in peripheral direction | Gauge 1 | Gauge 2 | Gauge 3 | Average value of gauges 1 to 3: $t_n$ |
|---|---|---|---|---|
| 0 mm | 101.0 μm | 101.2 μm | 101.3 μm | 101.2 μm |
| 1 mm | 99.5 μm | 99.9 μm | 99.6 μm | 99.7 μm |
| 2 mm | 99.7 μm | 99.4 μm | 99.2 μm | 99.4 μm |
| 3 mm | 100.4 μm | 100.4 μm | 100.7 μm | 100.5 μm |
| 4 mm | 99.5 μm | 100.0 μm | 99.7 μm | 99.8 μm |
| 5 mm | 99.4 μm | 99.2 μm | 99.5 μm | 99.4 μm |
| 6 mm | 100.3 μm | 100.1 μm | 100.4 μm | 100.2 μm |

TABLE 29-continued

| Position in peripheral direction | Gauge 1 | Gauge 2 | Gauge 3 | Average value of gauges 1 to 3: $t_n$ |
|---|---|---|---|---|
| 7 mm | 99.7 μm | 100.1 μm | 100.0 μm | 99.9 μm |
| 8 mm | 98.5 μm | 98.3 μm | 98.3 μm | 98.4 μm |
| 9 mm | 101.0 μm | 100.7 μm | 100.6 μm | 100.8 μm |
| 10 mm | 100.4 μm | 100.4 μm | 100.2 μm | 100.4 μm |
| 11 mm | 98.9 μm | 98.5 μm | 99.4 μm | 98.9 μm |
| 12 mm | 100.3 μm | 100.2 μm | 100.5 μm | 100.3 μm |
| 13 mm | 100.3 μm | 100.6 μm | 100.7 μm | 100.6 μm |
| 14 mm | 98.9 μm | 98.6 μm | 98.8 μm | 98.8 μm |
| 15 mm | 100.5 μm | 100.5 μm | 100.1 μm | 100.4 μm |
| 16 mm | 101.0 μm | 101.1 μm | 101.3 μm | 101.1 μm |
| 17 mm | 99.4 μm | 99.4 μm | 99.6 μm | 99.5 μm |
| 18 mm | 100.2 μm | 100.0 μm | 100.0 μm | 100.1 μm |
| 19 mm | 101.3 μm | 101.2 μm | 100.9 μm | 101.1 μm |
| | Maximum value of $t_n$ | | | 101.2 μm |
| | Minimum value of $t_n$ | | | 98.4 μm |
| | Average value of $t_n$ | | | 100.0 μm |
| | (Maximum value − Minimum value)/average value | | | 2.8% |

Example 13

The blending amount was changed as shown in Table 1, and the tube was prepared by tubular film process similarly to Example 12. Example 13 is different from Example 12 only in the presence or absence of the blending of graphite.

By using the tube in which five minutes having elapsed since the heater control started, an electrophotographic belt (transfer material conveying belt) was prepared in the same manner as Example 12, and an estimation wad performed in the same manner as Example 12. The measurement result of the thickness is shown in Table 30 and Table 31, and an estimation result of a color shift is shown in Table 2.

Since the center of gravity Z was small as 0.10 μm, the initial color shift has been small. Further, by adding graphite, the unevenness of the short period of the thickness has been increased to 3.5% from 2.8% of Example 12, and the color shift after 10,000 sheets durability test has been also excellent.

TABLE 30

| n | Measuring point θ | Gauge 1 | Gauge 2 | Gauge 3 | Average value of gauges 1 to 3: $t_n$ | $t_n \times \cos\theta$ | $t_n \times \sin\theta$ |
|---|---|---|---|---|---|---|---|
| 1 | 0° | 99.8 μm | 99.2 μm | 99.2 μm | 99.4 μm | 99.44 μm | 0.00 μm |
| 2 | 18° | 101.5 μm | 101.0 μm | 102.3 μm | 101.6 μm | 96.65 μm | 31.40 μm |
| 3 | 36° | 98.8 μm | 98.7 μm | 98.6 μm | 98.7 μm | 79.86 μm | 58.02 μm |
| 4 | 54° | 99.1 μm | 98.7 μm | 98.4 μm | 98.7 μm | 58.03 μm | 79.87 μm |
| 5 | 72° | 101.0 μm | 100.8 μm | 100.4 μm | 100.7 μm | 31.13 μm | 95.81 μm |
| 6 | 90° | 99.6 μm | 99.5 μm | 99.3 μm | 99.5 μm | 0.00 μm | 99.47 μm |
| 7 | 108° | 98.4 μm | 98.9 μm | 97.6 μm | 98.3 μm | −30.38 μm | 93.51 μm |
| 8 | 126° | 100.7 μm | 100.4 μm | 100.3 μm | 100.5 μm | −59.05 μm | 81.28 μm |
| 9 | 144° | 100.3 μm | 100.2 μm | 99.8 μm | 100.1 μm | −80.98 μm | 58.83 μm |
| 10 | 162° | 98.1 μm | 98.4 μm | 97.2 μm | 97.9 μm | −93.14 μm | 30.26 μm |
| 11 | 180° | 99.8 μm | 99.9 μm | 99.8 μm | 99.8 μm | −99.83 μm | 0.00 μm |
| 12 | 198° | 101.7 μm | 102.1 μm | 101.2 μm | 101.7 μm | −96.68 μm | −31.41 μm |
| 13 | 216° | 99.2 μm | 99.3 μm | 99.8 μm | 99.4 μm | −80.42 μm | −58.43 μm |
| 14 | 234° | 99.3 μm | 99.6 μm | 100.0 μm | 99.6 μm | −58.55 μm | −80.59 μm |
| 15 | 252° | 101.1 μm | 101.8 μm | 100.7 μm | 101.2 μm | −31.28 μm | −96.26 μm |
| 16 | 270° | 99.6 μm | 98.6 μm | 100.1 μm | 99.4 μm | 0.00 μm | −99.43 μm |
| 17 | 288° | 98.3 μm | 98.7 μm | 97.5 μm | 98.2 μm | 30.33 μm | −93.36 μm |
| 18 | 306° | 100.3 μm | 99.8 μm | 100.5 μm | 100.2 μm | 58.90 μm | −81.06 μm |
| 19 | 324° | 100.8 μm | 100.5 μm | 101.3 μm | 100.9 μm | 81.60 μm | −59.28 μm |
| 20 | 342° | 98.6 μm | 98.4 μm | 98.5 μm | 98.5 μm | 93.68 μm | −30.44 μm |
| | | | Total sum | | | −0.69 μm | −1.81 μm |
| | | | Average | | | −0.03 μm | −0.09 μm |
| | | | Z | | | 0.10 μm | |

TABLE 31

| Position in peripheral direction | Gauge 1 | Gauge 2 | Gauge 3 | Average value of gauges 1 to 3: $t_n$ |
|---|---|---|---|---|
| 0 mm | 100.0 μm | 99.9 μm | 99.5 μm | 99.8 μm |
| 1 mm | 101.7 μm | 101.6 μm | 101.5 μm | 101.6 μm |
| 2 mm | 99.4 μm | 99.1 μm | 98.9 μm | 99.2 μm |
| 3 mm | 98.5 μm | 98.7 μm | 98.9 μm | 98.7 μm |
| 4 mm | 101.1 μm | 100.8 μm | 101.1 μm | 101.0 μm |
| 5 mm | 101.1 μm | 101.1 μm | 101.4 μm | 101.2 μm |
| 6 mm | 98.5 μm | 98.1 μm | 98.7 μm | 98.4 μm |
| 7 mm | 99.4 μm | 98.9 μm | 99.9 μm | 99.4 μm |
| 8 mm | 101.7 μm | 101.3 μm | 101.2 μm | 101.4 μm |
| 9 mm | 100.0 μm | 99.7 μm | 99.8 μm | 99.8 μm |
| 10 mm | 98.3 μm | 98.6 μm | 98.1 μm | 98.3 μm |
| 11 mm | 100.6 μm | 100.6 μm | 101.0 μm | 100.8 μm |
| 12 mm | 101.5 μm | 101.7 μm | 101.5 μm | 101.6 μm |
| 13 mm | 98.9 μm | 98.6 μm | 98.7 μm | 98.7 μm |
| 14 mm | 98.9 μm | 98.5 μm | 99.1 μm | 98.8 μm |
| 15 mm | 101.5 μm | 101.6 μm | 101.5 μm | 101.5 μm |
| 16 mm | 100.6 μm | 100.7 μm | 100.4 μm | 100.5 μm |
| 17 mm | 98.3 μm | 98.6 μm | 98.7 μm | 98.5 μm |
| 18 mm | 100.0 μm | 100.2 μm | 100.1 μm | 100.1 μm |
| 19 mm | 101.7 μm | 101.6 μm | 102.1 μm | 101.8 μm |
| | Maximum value of $t_n$ | | | 101.8 μm |
| | Minimum value of $t_n$ | | | 98.3 μm |
| | Average value of $t_n$ | | | 100.1 μm |
| | (Maximum value − Minimum value)/average value | | | 3.5% |

Comparative Example 1

A tube A obtained in the preparation process of Example 1 was fitted to the electrophotographic apparatus (color electrophotographic apparatus) having the constitution shown in FIG. 1 as a transfer material conveying belt, and an estimation was made in the same manner as Example 1. The estimation result is shown in Table 2.

The result of having measured 5% of the inner peripheral length, that is, the distance of 24 mm at intervals of one millimeter is shown in Table 25.

As is evident from Table 2, the accuracy of the thickness of the electrophotographic belt is 96.0 to 104.9 μm, that is not more than 100 μm ±5%, and is preferable at first glance. However, since the center of gravity Z is 2.17 μm and great, the color shift has been great from the early state.

TABLE 25

| Position in peripheral direction | Gauge 1 | Gauge 2 | Gauge 3 | Average value of gauges 1 to 3: $t_n$ |
|---|---|---|---|---|
| 0 mm | 100.0 μm | 100.4 μm | 100.3 μm | 100.2 μm |
| 1 mm | 99.9 μm | 100.3 μm | 99.9 μm | 100.0 μm |
| 2 mm | 99.7 μm | 100.0 μm | 99.3 μm | 99.7 μm |
| 3 mm | 99.7 μm | 99.5 μm | 99.7 μm | 99.6 μm |
| 4 mm | 100.6 μm | 100.7 μm | 100.3 μm | 100.6 μm |
| 5 mm | 100.9 μm | 100.5 μm | 101.4 μm | 101.0 μm |
| 6 mm | 101.2 μm | 101.5 μm | 101.3 μm | 101.3 μm |
| 7 mm | 100.3 μm | 100.7 μm | 100.5 μm | 100.5 μm |
| 8 mm | 100.9 μm | 100.8 μm | 100.5 μm | 100.8 μm |
| 9 mm | 100.1 μm | 100.6 μm | 100.1 μm | 100.3 μm |
| 10 mm | 100.0 μm | 100.2 μm | 100.3 μm | 100.1 μm |
| 11 mm | 99.7 μm | 100.0 μm | 99.7 μm | 99.8 μm |
| 12 mm | 99.6 μm | 99.8 μm | 99.1 μm | 99.5 μm |
| 13 mm | 100.1 μm | 99.7 μm | 99.6 μm | 99.8 μm |
| 14 mm | 99.6 μm | 99.2 μm | 99.2 μm | 99.3 μm |
| 15 mm | 100.4 μm | 100.8 μm | 100.7 μm | 100.6 μm |
| 16 mm | 98.9 μm | 99.1 μm | 99.3 μm | 99.1 μm |
| 17 mm | 98.9 μm | 98.4 μm | 99.3 μm | 98.9 μm |
| 18 mm | 99.5 μm | 99.4 μm | 99.1 μm | 99.3 μm |
| 19 mm | 98.9 μm | 98.5 μm | 98.6 μm | 98.7 μm |
| 20 mm | 99.5 μm | 99.7 μm | 99.3 μm | 99.5 μm |
| 21 mm | 99.5 μm | 99.2 μm | 99.2 μm | 99.3 μm |
| 22 mm | 99.1 μm | 99.3 μm | 98.9 μm | 99.1 μm |
| 23 mm | 99.7 μm | 99.8 μm | 100.0 μm | 99.8 μm |
| 24 mm | 100.2 μm | 99.8 μm | 100.2 μm | 100.1 μm |
| | Maximum value of $t_n$ | | | 101.3 μm |
| | Minimum value of $t_n$ | | | 98.7 μm |
| | Average value of $t_n$ | | | 99.9 μm |
| | (Maximum value − Minimum value)/average value | | | 2.7% |

Comparative Example 2

The blending was changed as shown in Table 1, and the tube was prepared by tubular film process similarly to Example 1.

In order that the shortest distance between the tube and the airing jet port becomes 20 mm, a blower output was adjusted, and a heater gain was decided, and the control of the heater was started. By using a tube in which five minutes having elapsed since the control started, a transfer material conveying belt was prepared in the same manner as Example 1, and the same estimation was made in the same manner as Example 1. The measurement result of the thickness is shown in Tables 26 and 27, and the estimation result of a color shift is shown in Table 2.

Since the value of the center of gravity Z was 0.55 μm, the initial color shift has been small. Since the unevenness of the short period of the thickness was even 24%, the color shift due to the durability test was not observed. However, because the unevenness of the short period of the thickness was too large, uniformity in the image density has been deteriorated from the initial period.

Further, in the present comparative example, microscopic fractures were observed in the end portion of the electrophotographic belt after 10,000 sheets durability test. In other Examples and comparative example, no such fractures have developed. That is believed to come from the fact that since the additive amount of the inorganic fine particles has been 45 percent by mass and too great, the electrophotographic belt became fragile.

TABLE 26

| n | Measuring point θ | Gauge 1 | Gauge 2 | Gauge 3 | Average value of gauges 1 to 3: $t_n$ | $t_n \times \cos\theta$ | $t_n \times \sin\theta$ |
|---|---|---|---|---|---|---|---|
| 1 | 0° | 97.6 μm | 97.9 μm | 98.0 μm | 97.9 μm | 97.86 μm | 0.00 μm |
| 2 | 18° | 102.6 μm | 102.7 μm | 103.3 μm | 102.9 μm | 97.84 μm | 31.79 μm |
| 3 | 36° | 96.1 μm | 96.6 μm | 96.1 μm | 96.3 μm | 77.88 μm | 56.58 μm |
| 4 | 54° | 103.5 μm | 104.1 μm | 103.6 μm | 103.7 μm | 60.96 μm | 83.90 μm |
| 5 | 72° | 100.6 μm | 100.7 μm | 101.1 μm | 100.8 μm | 31.15 μm | 95.86 μm |
| 6 | 90° | 96.5 μm | 96.7 μm | 96.6 μm | 96.6 μm | 0.00 μm | 96.58 μm |
| 7 | 108° | 93.2 μm | 93.3 μm | 93.8 μm | 93.4 μm | −28.87 μm | 88.86 μm |
| 8 | 126° | 98.1 μm | 98.6 μm | 98.7 μm | 98.5 μm | −57.87 μm | 79.65 μm |
| 9 | 144° | 99.5 μm | 100.0 μm | 99.7 μm | 99.7 μm | −80.67 μm | 58.61 μm |
| 10 | 162° | 102.5 μm | 102.7 μm | 102.9 μm | 102.7 μm | −97.68 μm | 31.74 μm |
| 11 | 180° | 100.0 μm | 100.4 μm | 100.3 μm | 100.2 μm | −100.22 μm | 0.00 μm |
| 12 | 198° | 97.1 μm | 97.3 μm | 97.5 μm | 97.3 μm | −92.55 μm | −30.07 μm |
| 13 | 216° | 101.3 μm | 101.5 μm | 101.6 μm | 101.5 μm | −82.08 μm | −59.63 μm |
| 14 | 234° | 99.1 μm | 99.8 μm | 99.8 μm | 99.6 μm | −58.52 μm | −80.54 μm |
| 15 | 252° | 102.5 μm | 103.1 μm | 102.7 μm | 102.8 μm | −31.76 μm | −97.74 μm |
| 16 | 270° | 97.9 μm | 98.4 μm | 98.2 μm | 98.2 μm | 0.00 μm | −98.16 μm |
| 17 | 288° | 100.3 μm | 100.6 μm | 100.7 μm | 100.5 μm | 31.07 μm | −95.62 μm |
| 18 | 306° | 101.6 μm | 101.9 μm | 101.8 μm | 101.8 μm | 59.81 μm | −82.33 μm |
| 19 | 324° | 98.3 μm | 98.8 μm | 98.9 μm | 98.6 μm | 79.81 μm | −57.98 μm |
| 20 | 342° | 102.8 μm | 102.8 μm | 103.2 μm | 102.9 μm | 97.90 μm | −31.81 μm |
| | | | Total sum | | | 4.06 μm | −10.31 μm |
| | | | Average | | | 0.20 μm | −0.52 μm |
| | | | Z | | | 0.55 μm | |

TABLE 27

| Position in peripheral direction | Gauge 1 | Gauge 2 | Gauge 3 | Average value of gauges 1 to 3: $t_n$ |
|---|---|---|---|---|
| 0 mm | 102.3 μm | 103.1 μm | 103.5 μm | 103.0 μm |
| 1 mm | 106.2 μm | 106.0 μm | 104.8 μm | 105.7 μm |
| 2 mm | 97.9 μm | 96.9 μm | 97.0 μm | 97.3 μm |
| 3 mm | 112.3 μm | 113.4 μm | 112.0 μm | 112.6 μm |
| 4 mm | 99.6 μm | 98.1 μm | 99.8 μm | 99.2 μm |
| 5 mm | 107.1 μm | 107.5 μm | 105.9 μm | 106.8 μm |
| 6 mm | 102.5 μm | 102.5 μm | 102.6 μm | 102.5 μm |
| 7 mm | 98.8 μm | 99.7 μm | 99.8 μm | 99.4 μm |
| 8 mm | 91.8 μm | 90.7 μm | 91.8 μm | 91.5 μm |
| 9 mm | 93.8 μm | 94.3 μm | 94.6 μm | 94.2 μm |
| 10 mm | 100.2 μm | 101.0 μm | 101.6 μm | 101.0 μm |
| 11 mm | 106.0 μm | 106.5 μm | 106.1 μm | 106.2 μm |
| 12 mm | 110.8 μm | 112.3 μm | 112.3 μm | 111.8 μm |
| 13 mm | 99.5 μm | 99.3 μm | 99.5 μm | 99.4 μm |
| 14 mm | 93.0 μm | 92.8 μm | 92.7 μm | 92.8 μm |
| 15 mm | 89.9 μm | 88.9 μm | 88.5 μm | 89.1 μm |
| 16 mm | 96.8 μm | 98.0 μm | 95.6 μm | 96.8 μm |
| 17 mm | 88.4 μm | 89.4 μm | 87.5 μm | 88.5 μm |
| 18 mm | 111.5 μm | 112.9 μm | 112.2 μm | 112.2 μm |
| 19 mm | 105.4 μm | 105.2 μm | 104.1 μm | 104.9 μm |
| 20 mm | 95.3 μm | 95.1 μm | 95.0 μm | 95.1 μm |
| 21 mm | 99.9 μm | 99.6 μm | 100.3 μm | 99.9 μm |
| 22 mm | 98.8 μm | 100.1 μm | 97.6 μm | 98.8 μm |
| 23 mm | 103.4 μm | 102.7 μm | 102.3 μm | 102.8 μm |
| 24 mm | 99.5 μm | 99.8 μm | 98.0 μm | 99.1 μm |
| | | Maximum value of $t_n$ | | 112.6 μm |
| | | Minimum value of $t_n$ | | 88.5 μm |
| | | Average value of $t_n$ | | 100.4 μm |
| | | (Maximum value − Minimum value)/average value | | 24.0% |

This application claims priorities from Japanese Patent Application No. 2004-277567 filed on Sep. 24, 2004, which is incorporated hereinto by reference.

What is claimed is:

1. An electrophotographic belt composed of a thermoplastic resin composition including thermoplastic resin, wherein with respect to a flake-shaped portion of the electrophotographic belt, having an arc length of 5% of the inner peripheral length of the electrophotographic belt, when the thickness of the flake-shaped portion is measured at intervals of one millimeter in the peripheral direction, the difference between the maximum value and the minimum value of the measured value is 2% or more and 20% or less of an arithmetic average value, and wherein, when the thickness of the electrophotographic belt is measured at equal intervals at 20 points across the entire periphery in the peripheral direction of the electrophotographic belt, and the measured values are taken as $t_n$(n=1, 2, . . . 20) (μm), respectively, a center of gravity Z found by the following formula (1):

$$z=\sqrt{X^2+Y^2} \quad (1)$$

(in the formula (1), X and Y are, $$X = \frac{\sum_{n=1}^{20} t_n \cos\left\{\frac{360^\circ\ (n-1)}{20}\right\}}{20}$$

and $$Y = \frac{\sum_{n=1}^{20} t_n \sin\left\{\frac{360^\circ\ (n-1)}{20}\right\}}{20}$$

and respectively)
is 2.0 μm or less.

2. The electrophotographic belt according to claim 1, wherein said thermoplastic resin composition contains at least one type of resin selected from the group consisting of polyamide, poly phenylene sulfide, polyvinylidene fluoride, and alicyclic polyester resin, and its total content is 50% by mass or more for the entire mass of said thermoplastic resin composition.

3. The electrophotographic belt according to claim 1, wherein said thermoplastic resin composition at least contains one type of inorganic fine particles, and its total content is 10% by mass or more and 40% by mass or less for the entire mass of said thermoplastic resin composition.

4. The electrophotographic belt according to claim 3, wherein said inorganic fine particles comprise at least two types of carbon and inorganic fine particles other than carbon.

5. The electrophotographic belt according to claim 1, wherein said center of gravity Z is 1.5 or less.

6. A production method of the electrophotographic belt according to claim 1, comprising a molding process of a belt by performing an extrusion molding by using an installation provided with an airing containing plural heaters lined up in a peripheral direction and having an inner wind path not divided in a wind direction, an extruding machine, and an annular die, while spraying a gas different in temperature in the peripheral direction from a gas jet port of the airing.

7. An electrophotographic apparatus, comprising the electrophotographic belt according to claim 1, a roller to rotationally drive the electrophotographic belt, and plural electrophotographic photosensitive members disposed around the electrophotographic belt.

8. The electrophotographic apparatus according to claim 7, wherein a winding amount of said electrophotographic belt to said roller is 3% or more and 7% or less of the inner peripheral length of said electrophotographic belt.

* * * * *